US008959845B2

(12) United States Patent
Hauptman et al.

(10) Patent No.: US 8,959,845 B2
(45) Date of Patent: Feb. 24, 2015

(54) SYSTEM AND METHOD FOR STRUCTURE DESIGN

(75) Inventors: Jonas Hauptman, Saint Louis Park, MN (US); Paul James, Edina, MN (US); Walter Zesk, Providence, RI (US)

(73) Assignee: Liberty Diversified International, Inc., New Hope, MN (US)

( * ) Notice: Subject to any disclaimer, the term of this patent is extended or adjusted under 35 U.S.C. 154(b) by 730 days.

(21) Appl. No.: 12/975,917

(22) Filed: Dec. 22, 2010

(65) Prior Publication Data

US 2011/0146078 A1 Jun. 23, 2011

Related U.S. Application Data

(60) Provisional application No. 61/293,508, filed on Jan. 8, 2010, provisional application No. 61/289,936, filed on Dec. 23, 2009.

(51) Int. Cl.

| | |
|---|---|
| ***E04B 7/10*** | (2006.01) |
| ***E04B 1/32*** | (2006.01) |
| ***E04B 1/86*** | (2006.01) |
| ***E04B 2/74*** | (2006.01) |
| ***E04B 9/04*** | (2006.01) |
| ***E04F 13/08*** | (2006.01) |
| *E04B 1/84* | (2006.01) |

(52) U.S. Cl.

CPC ... *E04B 1/32* (2013.01); *E04B 1/86* (2013.01); *E04B 2/7405* (2013.01); *E04B 2/7416* (2013.01); *E04B 9/0407* (2013.01); *E04B 9/0478* (2013.01); *E04B 2001/327* (2013.01); *E04B 2001/8442* (2013.01); *E04F 13/0871* (2013.01)

USPC ..... 52/80.2; 52/81.4; 52/81.6; 52/506.05

(58) Field of Classification Search

USPC ..... 52/80.1, 80.2, 81.1, 81.4, 81.5, 81.6, 52/506.01, 506.05, 510; 40/605, 539

See application file for complete search history.

(56) References Cited

U.S. PATENT DOCUMENTS

| | | | | | |
|---|---|---|---|---|---|
| 3,201,894 | A | * | 8/1965 | Resch | 446/487 |
| 3,267,597 | A | * | 8/1966 | Jannes | 40/584 |
| 3,296,755 | A | * | 1/1967 | Chisholm | 52/81.4 |
| 3,369,727 | A | * | 2/1968 | Wright | 229/248 |
| 3,550,310 | A | * | 12/1970 | Bock-Greissau | 446/85 |
| 3,557,501 | A | * | 1/1971 | Kolozsvary | 52/81.4 |
| 3,561,757 | A | * | 2/1971 | Schillig | 482/35 |

(Continued)

FOREIGN PATENT DOCUMENTS

| | | |
|---|---|---|
| FR | 2067761 | 8/1971 |
| WO | WO2008/134824 | 11/2008 |

OTHER PUBLICATIONS

AlphaCorr FoldUp from Comnet; http://www.alphacorr.com/products/foldup-comnet.html.

(Continued)

*Primary Examiner* — James Ference

(74) *Attorney, Agent, or Firm* — Barnes & Thornburg LLP

(57) ABSTRACT

An embodiment of the present disclosure provides complex curved structures and methods of making the same without requiring specially made frames or the like. These structures may include complex multi-axis, spherical, semi-spherical, twisted, or other like curves, for example. In this illustrative embodiment, individually sized boxes are stacked or assembled to form the structure.

30 Claims, 63 Drawing Sheets

(56) References Cited

U.S. PATENT DOCUMENTS

| | | | | | |
|---|---|---|---|---|---|
| 3,596,396 | A * | 8/1971 | Thomson | 446/487 |
| 3,872,975 | A * | 3/1975 | Silver | 211/195 |
| 3,925,941 | A * | 12/1975 | Pearce | 52/82 |
| 4,302,897 | A * | 12/1981 | Deckys | 40/605 |
| 4,502,257 | A * | 3/1985 | Diamond | 52/80.1 |
| 4,723,382 | A * | 2/1988 | Lalvani | 52/81.1 |
| 4,821,471 | A * | 4/1989 | Stephens et al. | 52/81.1 |
| 4,901,483 | A | 2/1990 | Huegy | |
| 4,902,810 | A | 2/1990 | Ikeda et al. | |
| 5,036,635 | A * | 8/1991 | Lalvani | 52/80.1 |
| 5,155,951 | A * | 10/1992 | Lalvani | 52/80.2 |
| 5,448,868 | A * | 9/1995 | Lalvani | 52/648.1 |
| 5,623,790 | A * | 4/1997 | Lalvani | 52/81.2 |
| 5,702,054 | A * | 12/1997 | Philips et al. | 229/110 |
| 5,903,992 | A * | 5/1999 | Eisenberg | 40/738 |
| 5,904,006 | A * | 5/1999 | Evans | 52/81.4 |
| 6,059,631 | A * | 5/2000 | Maddock | 446/127 |
| 6,282,849 | B1 * | 9/2001 | Tuczek | 52/81.1 |
| 6,895,722 | B1 | 5/2005 | Ponder | |
| 7,029,364 | B1 * | 4/2006 | Thomasson | 446/488 |
| 7,694,479 | B2 * | 4/2010 | Killen | 52/309.5 |
| 2002/0059777 | A1 | 5/2002 | Saebi | |
| 2002/0069566 | A1 * | 6/2002 | Netter | 40/606 |
| 2006/0185275 | A1 * | 8/2006 | Yatt | 52/236.1 |
| 2009/0276070 | A1 * | 11/2009 | Burkes et al. | 700/98 |
| 2010/0076582 | A1 * | 3/2010 | Ferren et al. | 700/98 |

OTHER PUBLICATIONS

Butterfly curve (transcendental); Wikipedia, the free encyclopedia.
Kirigami; Origami Resource Center.
Luxology Forum; Triangulated mesh to quad mesh.
Math Forum; What Is a Tessellation?
Tessellations by Polygons—EscherMath; Tessellations by Polygons.
Unfolding Page; Designing cardmodels The theory and practice of unfolding.
Vial—convivial.
Design Exploration through Bidirectional Modeling of Constraints.
ITW Fastex; Rivets.
Technology LK; CRL Assorted Clip Kit for Japanese Cars—66 Pieces Kit.
Disc Magnets.
Door & Trim Panel Clips; Pricing.
Sonics; Hand Held Ultrasonic Plastics Welding Systems; Models H520/CV55 & H540/CVG54.
Salco; Salco heavy duty pliers offer exceptional ease of operation. Serving Industry since 1947.
Speed Nuts; Fold over clips, Pal nuts, Bolt retainers.
The Fastener Warehouse; Saves you 40-60% on the Most Popular Fasteners Bodyshops use each and every day . . . .
AlphaCorr; Product Overview.
Rhinophoto; for successful 3d digitizing with your camera.
EskoArtwork; Software Demos—MediaPlayer home.
Pepakura Designer—menuframe.
CNC Knife;—EZ Knife Systems—MultiCam Products; 2000 Series.
Aristo; Digitale Schneidemaschinen.
Commercial Furniture Industries: Xanita Inside.
Custom Industrial Product Packaging; Engineering Packaging Solutions.
Diversi-Plast—Home Page—Corrugated Plastic Products.
Equipment Capabilities—Formco Plastics, Inc.; Equipment Capabilities.
Fisher & Ludlow.
8300 CNC EPS Foam Cutting Video; http://www.hotwiredirect.com/videos/8300-cnc-eps-form-cutting-video/.
CNC Engravers, CNC Machines, CNC Routers, Engraving CNC Tools, Thermoforming Machine; http://www.infotec-group.com/go.live.php/EN-H133/artcam-pro.html.
I-cut tools.
Konsberg Movies—EskoArtwork; http://www.esko.com/web/site.aspx?p=874.
Calsak Plastics; Listing of plastic products; http://www.calsakplastics.com/plastic_materials_polypropylene.shtm.
Coroplast; Technical Product information.
Tilsner Carton Company; Displays.
Amana Tool; V Groove Router Bits.
Grimshaw —Architects.
BW Cutters—Manufacturers of Fixed Blade and Laser Flatbed Cutting Machines.
ESKO artwork; Kongsberg XP: digital cutting tables with new level of productivity.
Orion Range—Blade—BW Cutters.
Polycarbonate Panel Cutting—BW Cutters.
A Daily Dose of Architecture.
Design—podium for Annenberg theater.
Digital Design; + Fabrication (NOUS Gallery); core.form-ula.
Postgreen—Eco-modern homes for the rest of us.
SJET.
Welcome to cgarchitect.com.
Flickr: The curved fold Pool.
Theverymany.
Collection: IwamotoScott Architecture Work.
Collection: Paperwork(s).
Fabrication and Façade—a set on Flickr.
DSC00936 Flockr—Photo Sharing.
Tesselion: Adaptive Quadrilateral Flat Panelization; Part I.
Tesselion: Adaptive Quadrilateral Flat Panelization; Part II.
Holding the Press; Eureka.
Curved Folding—foldable=makeable.
Associated Fabrication—New York Magazine Best Bets.
Home Point B Ltd.
Marble Fairbanks.
Min/Day.
Ply—Borum & Daubmann; Ply Architecture.
Serpentina.
YouTube—X-Board WW Bulkhead Apr. 29, 2008.
YouTube—X-Board.
3FORM/Translucent Panels and Material Solutions.
Veritas—Our Products.
Stretch Ceiling Systems by Newmat USA.
Eventscape Inc.; we're building something extraordinary.
Hunter Douglas Commercial and Architectural products on HunterDouglasContract.com.
Barrisol USA—The revolutionary Stretch Ceiling System that's changing the spaces we live in.
Ceilings Plus, the leader in architectural metal and wood ceilings, wall products and more . . . .
Formglas—We are the world leader in molded gypsum, concrete and composite based architectural products.
ModularArts® Dimensional Surfaces.
Molo design.
Commercial Ceiling Overview—Armstrong.
Sensitile™.
Fuller-Phoenix-interior architectural—glass-systems-backpainted-walls-ceilings-elevators.
Tapered Series—Vertical Waves—dri-design.
Milgo Bufkin.
Industrial Origami Image Gallery.
IntePro Package Products—Construction.
PET Preform Making, PET Bottle Making.
Hi-Core® XL-500; HiCore® FR-500.
Repeating Clipart Vector and Illustration. 7392 repeating clip art vector EPS images available to search from thousands of royalty free stock art and stock illustration creators.
Digital Fabrication/IAAC MAA 2010: Digital Fabrication Class—BLOG.
Dezeen >> Blog Archive >> Goldberger by Tervhivatal; Apr. 26, 2010.
Christoph Schindler [CH/D]—Den Ocelovych Konstrukci—www.denok.cz.
Phil Cuttance; weld collection, 2009.
About rn601; foam structures.
Materialworks News #06.
Wafer Wall—Products: Atomic Rental.

(56) References Cited

OTHER PUBLICATIONS

RoboFold.
Dform.
Cinnabars design/build approach helped fast-track production for new Age of mammals exhibition at Natural History Museum of Los Angeles County.
LIFT architects—Home 13 [Andrew Payne]; Entries in Architecture (22) FLUX Opening Night.
Tessellated Group.
About Acrylite®; Evonik Industries.
Carton Plast Product Property.
Total Petrochemicals; Polypropylene engineered for a wide variety of applications.
EPO; European Extended Search Report; Aug. 5, 2014.

* cited by examiner

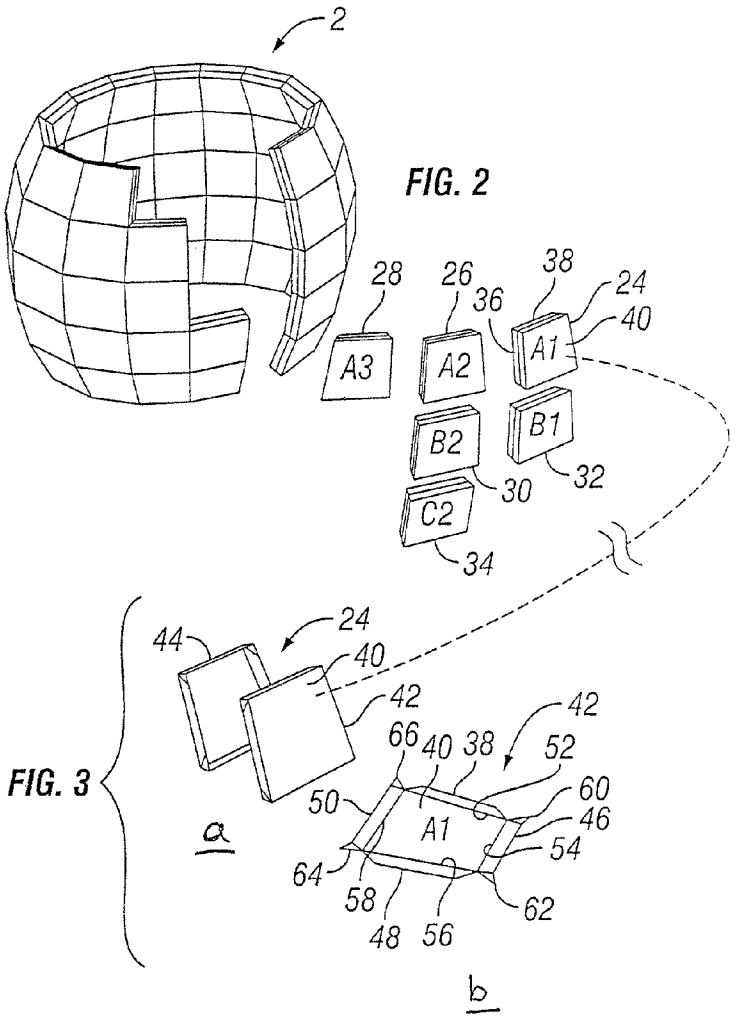
FIG. 2
FIG. 3
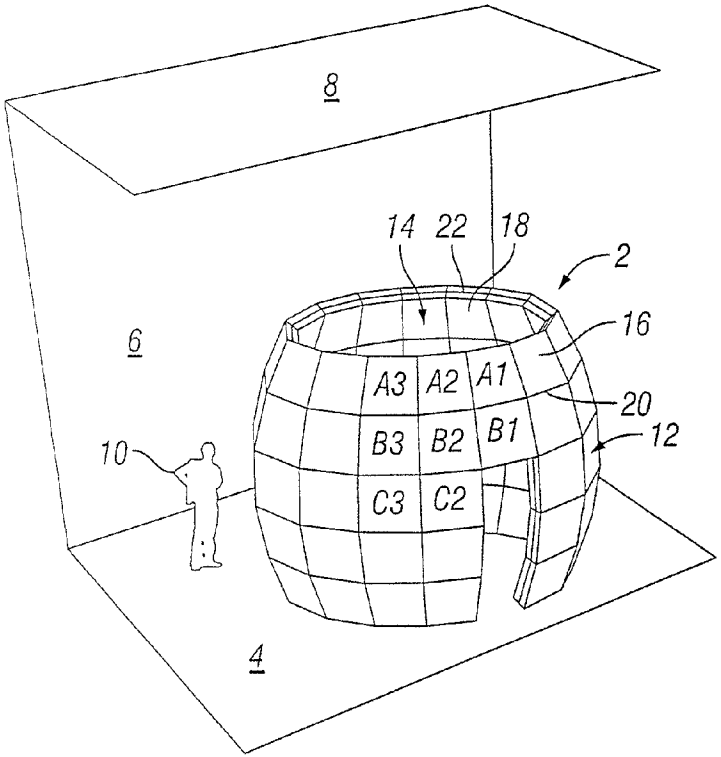
FIG. 1

328
312
314
316
318
330
332
334
346
348
350
352

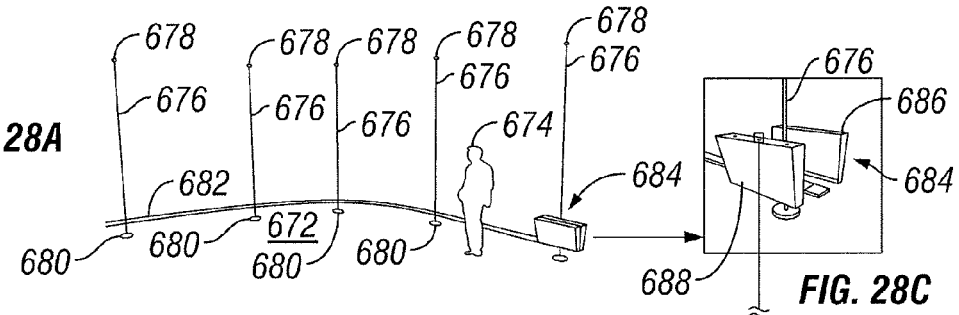
FIG. 28A
FIG. 28C
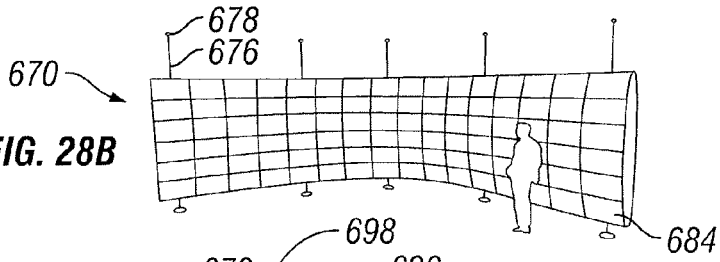
FIG. 28B
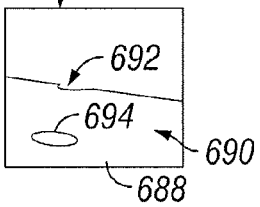
FIG. 28D
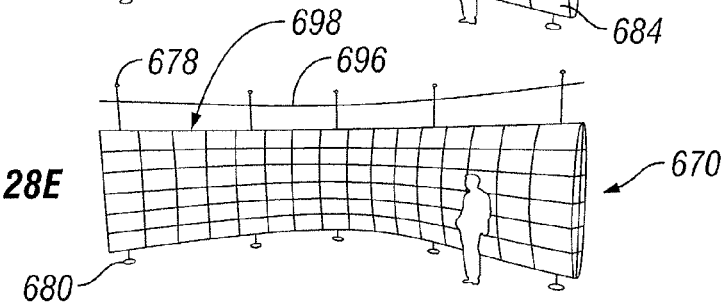
FIG. 28E
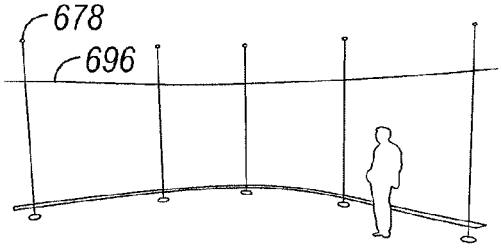
FIG. 28F
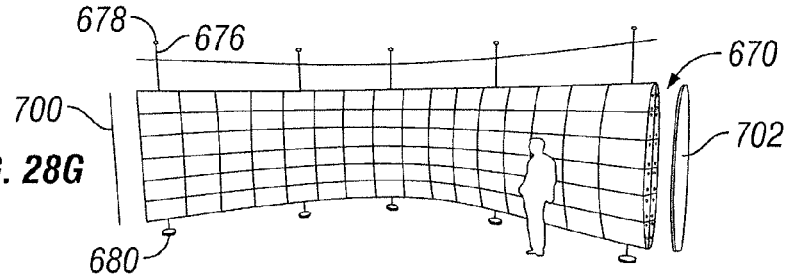
FIG. 28G

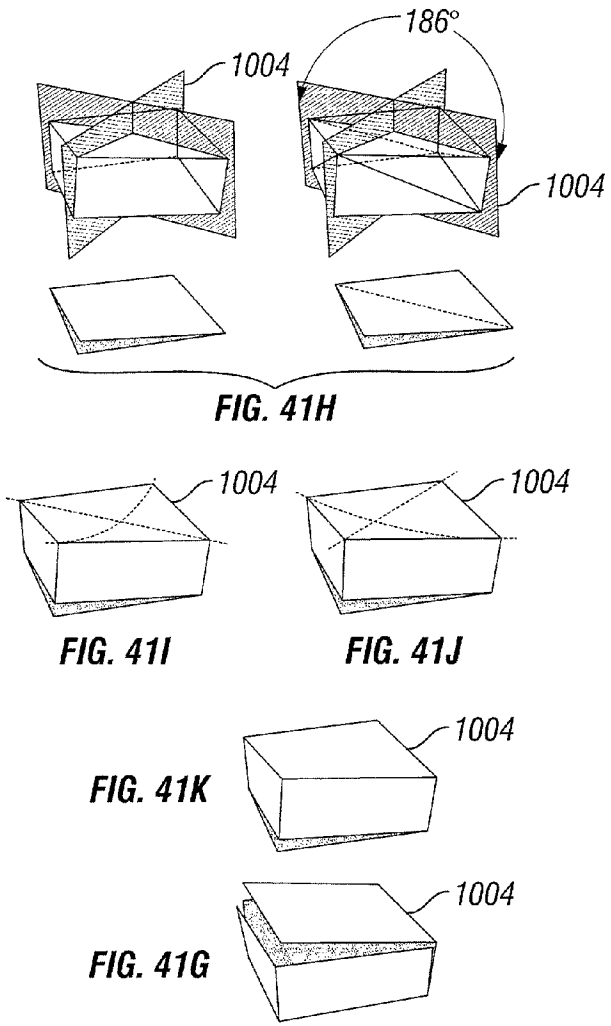
FIG. 41H
FIG. 41J
FIG. 41I
FIG. 41K
FIG. 41G
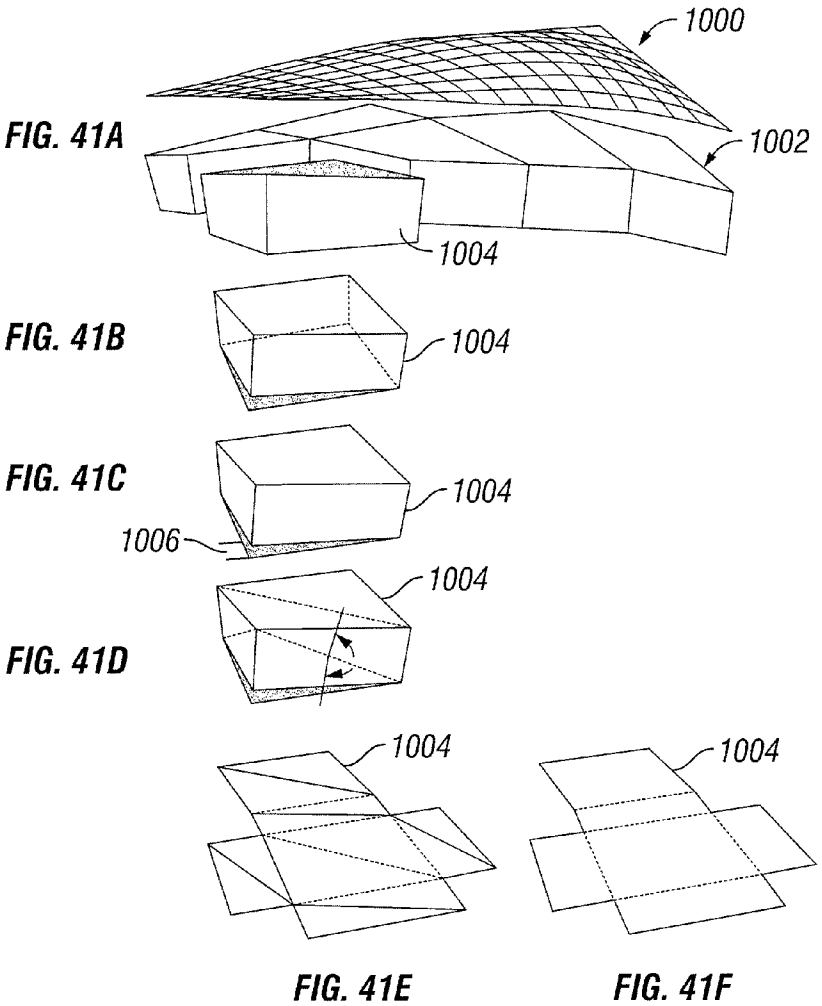
FIG. 41A
FIG. 41B
FIG. 41C
FIG. 41D
FIG. 41E
FIG. 41F

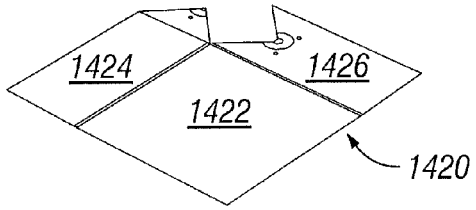
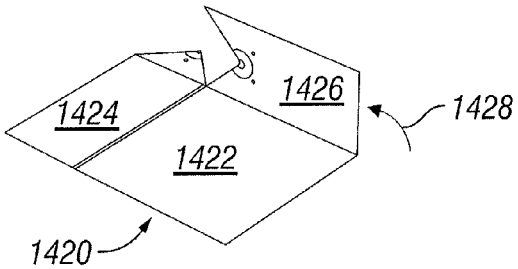
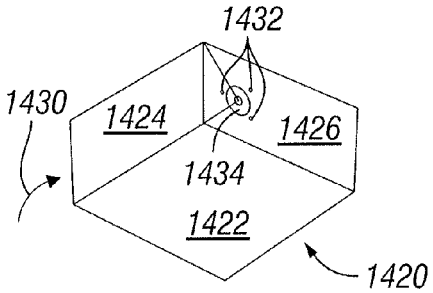
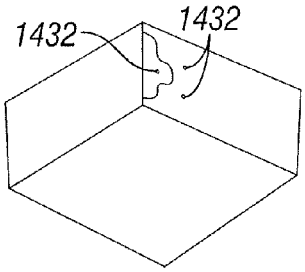
FIG. 57A
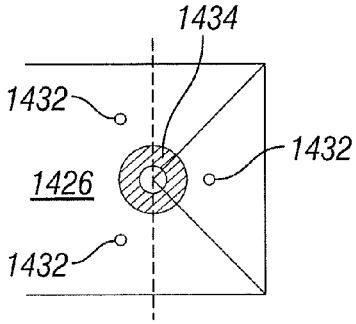
FIG. 57B
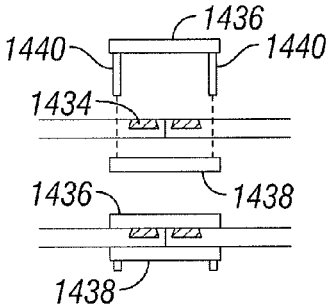
FIG. 57C
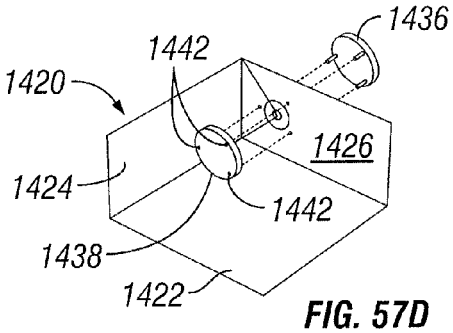
FIG. 57D
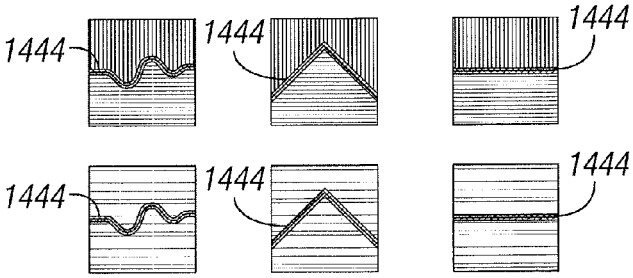
FIG. 57E

SYSTEM AND METHOD FOR STRUCTURE DESIGN

The present application is related to and claims priority to U.S. Provisional Patent Application Ser. No. 61/293,508 filed on Jan. 8, 2010, entitled "System and Method for Structure Design" and U.S. Provisional Patent Application No. 61/289,936 filed on Dec. 23, 2009, entitled "System and Method for Structure Design." To the extent not included below, the subject matter disclosed in those applications is hereby expressly incorporated into the present application.

TECHNICAL FIELD AND SUMMARY

The present disclosure is directed to self-supporting structural bodies that can have complex curved surfaces wherein each structural body is made up of smaller sub-bodies.

Structures, such as tradeshow displays, cubical partitions, room walls, and even ceilings are typically flat planar surfaces. They generally have plywood or gypsum drywall panels attached to wood or metal wall studs or frames, flat wall surfaces are conducive to hanging pictures, shelves, marketing materials, etc., but they lack instrinsic visual expression. Doubly curved walls, on the other hand, are more dynamic, expressive and modulate the experience of architectural space. They are uncommon, however, due to the high degree of geometric complexity and the extreme technical challenges that arise in fabrication and installation. This complexity arises from the fact that a doubly curved surface has curvature in two axis and, therefore, cannot be unrolled flat. For this reason, doubly curved architectural surface occurs either as an expensive custom installation, or is simplified down to one arc or "S" curve. Typically, these walls are constructed by placing either wood or metal studs or tubes in an arc, curve (for example a french curve or an ellipse vs. only a radial curve) or, at best, an "S" curve pattern and covering with bent drywall. If a more complex curved surface (such as a spherical or other double curved surfaces) is desired, a custom curved or highly mitered (faceted) frame is made to support curved panels placed over top. It is made through forming which is sometimes comprised of bent laminated panels made over molds for composite materials like wooden veneer layers or fiberglass and resin or thermal forming in thermal plastic materials. Other curved walls, such as landscaping walls, can be made by stacking identically-sized bricks, pavers or blocks in a curved pattern. But these too are often arcs or "S" curves and if they represent a more complex shape, they only approximate it with a shingled or fractured affect with some required noncontiguous edges between units, as well as generally also needing a frame.

In contrast, an illustrative embodiment of this present disclosure includes doubly curved structures and methods of making the same without requiring specially made frames or the like. These structures may accommodate variable gaussian curvature and may be used as curved walls, barriers, ceilings, columns, or other structures. Not limited to simple arcs, "S" curves, or shingled approximations of forms, these structures can easily and accurately approximate doubly curved surfaces including saddle shaped or hyperbolic, spherical, conical, folded, or twisted surfaces, or other gaussian curvature. In this illustrative embodiment, individually sized geometrically unique boxes are stacked or assembled to form the structure. Indeed, almost any doubly curved surface can now be closely approximated if not exactly formed (or perceptively identically formed) into a physical self-supporting structure. Put another way, partitions, displays, walls, and countless other structures are no longer limited to a simple flat wall shape or a single-axis curved shape that rely heavily on slow, labor intensive and, therefore, expensive frames.

Spherical, twisted, multi-directional waves or other complex curved shapes can be achieved by assembling the plurality of individually sized boxes in a specifically arranged order. Each box in the assembly has unique geometry specific to its location in the assembly. It is this continuously variable geometry that enables the construction system to accurately approximate doubly curved surfaces. Each box is stackable and attach to each other via magnets, fasteners, etc., so no support structure, skeleton, or frame is necessary. In an illustrative embodiment, all boxes that form the structure are made from a flat sheet blank of material. No specially molded cubes or blocks are required. Once the needed box sizes are calculated, the flat sheet blanks are cut and scored into the individual sizes and folded into boxes. By numbering or affixing the boxes with some indicia to indicate positioning, they can be assembled to make the structure. Rare earth magnets or other fasteners attach to the sides of each box to connect one to another. By assembling the boxes in this prearranged order, the resulting structure will be that of the designed shape.

Another illustrative embodiment of the present disclosure provides a digitally assisted design and specification method which a user employs to modify a base surface to create a three-dimensional design parametrically divides the design into individual box elements; and export two-dimensional representations of the individual box elements for rapid manufacture by robot and assembly into a physical manifestation of the three-dimensional design.

The above and other illustrative embodiments may further provide: parametrically dividing the design which includes dividing the three-dimensional design into a grid of contiguous panels, wherein each panel is defined by a series of shared 1-degree edge curves; the panels comprising triangular mesh surfaces; mapping graphics onto the box elements while maintaining alignment on non-planar assemblies of the three-dimensional design; the box elements being 3, 4, 5 or n sided; the panels being defined by sets of edge curves extruded or lofted to create sidewalls mated to each panel face; each sidewall being contiguous with a neighboring sidewall precisely offset to account for the installation specific material thickness; each edge of each face of each box abut an adjacent edge of a neighboring box except for edges located along the outer periphery of the design; two-dimensional representations being labeled to facilitate sorting and assembly of the three-dimensional design; comprising forming each box element as a two-dimensional panel; and the panel being formed of corrugated plastic, sheet metal, or paper-based board.

Another illustrative embodiment of the present disclosure provides a system comprising a graphic design tool, a box element module, and a panel module. The graphic design tool modifies a base surface to create a three-dimensional design. The box element module parametrically divides the design into individual box elements. The panel module provides two-dimensional panel representations of the individual box elements that are capable of being manufactured and assembled into a physical manifestation of the three-dimensional design.

The above and other illustrative embodiments may further provide: the box element module dividing the three-dimensional design into a grid of contiguous panels wherein each panel is defined by a series of shared 1-degree edge curves; the panels being comprised of triangular mesh surfaces; the panel module mapping graphics onto the box elements while maintaining alignment on non-planar assemblies of the three-dimensional design; the box elements being 3, 4, 5 or n sided; the panels being defined by sets of edge curves extruded (or lofted) to create sidewalls mated to each panel face; each sidewall being co-planar and contiguous to a neighboring sidewall; each non peripheral box sidewall having an edge that mates with a corresponding edge of a neighboring box element; the two-dimensional representations being labeled to facilitate sorting and assembly of the three-dimensional design; forming each box element as a two-dimensional panel; and the panel being formed of corrugated plastic.

Another illustrative embodiment of the present disclosure includes a method of making a structure. The method comprises: determining a base surface having a shape formed from at least two curves one of which not parallel to the other; subdividing the surface into a plurality of boxes wherein each box is uniquely shaped based on the shape of the base surface so assembling the boxes will form the structure that at least closely approximates the shape of the base surface, wherein each box includes a front surface and an at least one side, wherein at least two boxes each have their surface and side be non-orthogonal to each other and at least one face of one of the two boxes is a curved surface, and wherein each box has a corner edge located between the face and each side, wherein each box that is configured to be located adjacent to another box has its corner edge mate the corner edge of the another box; determining an order the plurality of boxes will be assembled in to create the structure; affixing an indicia on each of the plurality of boxes to indicate the position of each box with respect to each other to form the structure that at least closely approximates the shape of the base surface; forming each of the plurality of boxes by a scoring and cutting a flat sheet material; constructing each box by folding each box, wherein each box includes a magnet on at least one side which is configured to attract to and connect to a magnet attached to an adjacent box; assembling the structure by placing each box in order according to the indicia on each of the plurality of boxes so each box is located in the position with respect to each other to make the structure that at least closely approximates the shape of the base surface; and attaching each box to one another by placing the magnets from each box next to each other; and aligning each corner edge from each side of each of the plurality of boxes with each corner edge from each abutting side of each adjacently placed box.

Additional features and advantages of the structure assembly and method of making same will become apparent to those skilled in the art upon consideration of the following detailed description of the illustrated embodiment exemplifying the best mode of carrying out the structure assembly and method of making same as presently perceived.

BRIEF DESCRIPTION OF DRAWINGS

The present disclosure will be described hereafter with reference to the attached drawings which are given as non-limiting examples only, in which:

FIG. 1 is a perspective view of a freestanding, partially spherical-shaped structure;

FIG. 2 is a perspective partially exploded view of the freestanding partially spherical-shaped structure of FIG. 1;

FIGS. 3*a-b* are perspective views of box portions that make up the freestanding partially spherical-shaped structure and an unfolded box portion;

FIG. 5 is a perspective, partially exploded view of the ceiling structure of FIG. 4 depicting how the ceiling structure is composed of individual boxes;

FIG. 13*a* shows the same exploded view from FIG. 12 except with one of the box assembles removed, FIG. 13*b* shows the removed box assembly of FIG. 13*a* in further exploded view identifying the two box portions, and FIG. 13*c* shows the same box portions of FIG. 13*b* in unfolded blank form;

FIGS. 28*a-g* demonstrate an additional embodiment of a structure and how it is assembled;

FIGS. 41*a-k* are various perspective views demonstrating how a box, as a subcomponent of a structure, can be twisted to better approximate the shape of the structure's intended base surface;

FIGS. 57*a-e* are perspective progression views, detail, and pattern views of an intra box face joining mechanical tenon system for use with a folding box;

Figure 6:
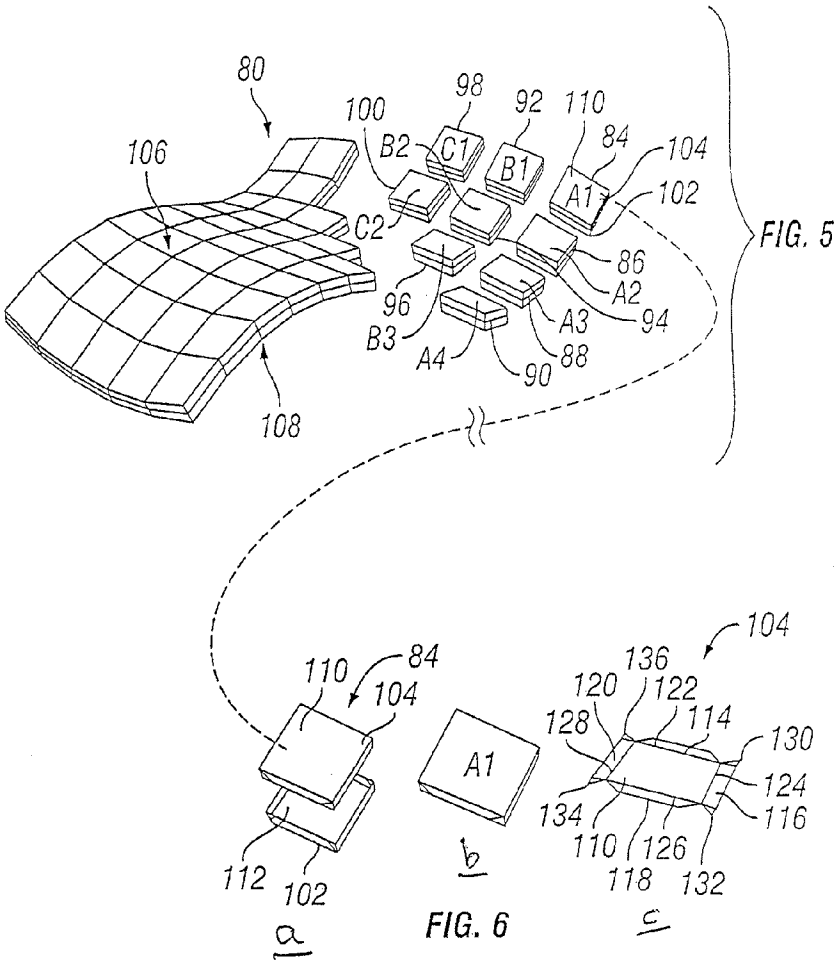
FIGS. 6*a-c* are perspective exploded views of first and second box portions of the ceiling structure of FIG. 4 along with one of those boxes shown in an unfolded blank condition.

The exemplification set out herein illustrates embodiments of the structures and methods of making the same, and such exemplification is not to be construed as limiting the scope of the structures and methods of making the same in any manner.

DETAILED DESCRIPTION OF THE DRAWINGS

A perspective view of a partially spherical freestanding structure 2 is shown in FIG. 1. Structure 22 illustratively sits on floor 4 of a dwelling or building that may include a wall 6 and ceiling 8. This embodiment stands freely without assistance from wall 6 or ceiling 8, however. Structure 22 only needs to rest on floor surface 4. An outline of a person 10 is included to show an illustrative scale for structure 2. It is appreciated that structure 22 may vary in size from relatively small, to relatively large.

Structure 22 is curved in multiple directions and on multiple axes. Structure 22 also has an outer surface 12 and an inner surface 14. Both the outer and inner surfaces 12 and 14 are formed entirely of box faces, such as outer face 16 and inner face 18 of inner and outer box portions 20 and 22, respectively. Each inner and outer box portion in addition to portions 20 and 22 are uniquely sized and shaped to form a small portion of the entire surface so that when all of the boxes are assembled in a predefined order, they form the desired predefined surface shape and structure. The letter/number system A-1-A-3, B-1, B-3 and C-2-C-3, is useful to ensure all the boxes are attached to each other in proper order. It is appreciated that this indicia does not have to be so prominently apparent on the boxes. It is further appreciated that this or other organizational indicia may appear on the sides of the boxes or any other less conspicuous location that obscures it from view when the structure is assembled, if that is the desired effect. It is still further appreciated from this view that structure 22 is only made up of these box portions. There are no skeletal or other support frames on studs needed to construct this complex-shaped structure.

In an illustrative embodiment, each box portion has a four-edged surface, like surfaces 12 or 14. Each box is uniquely sized and combined with other boxes to make up the surface of structure 22 as a whole. This means that each box surface, while having straight line edge curves, can still be assembled with other boxes to create a complex curved surface not achievable in this way by traditional stud framing or uni-sized block construction. In this illustrative embodiment, outside and inside box portions 20 and 22, respectively, are employed because the outside and inside surfaces 12 and 14 are not always the same and may be significantly different. For example, one side may be topographic (or doubly curved), while the other side may be planar (or singly curved) against a wall. The thickness of the box itself forces the inside surface 14 to be slightly different than outer surface 12. This arrangement also allows some independent control of the surface shape of both the inner or outer surface.

Another perspective view of structure 22 is shown in FIG. 2. This view shows how structure 22 is constructed entirely of boxes, such as boxes 24, 26, 28, 30, 32 and 34. Each of the boxes 24 through 34 in this illustrative embodiment is made up of outer and inner box portions, such as portions 20 and 22, except that each box is individually sized to create its portion of the entire surface. These boxes are then stacked one on top of another. Because of the way the boxes are formed, as discussed further herein, when assembled in proper order they create the desired curved surfaces of structure 22. For example in this case, unlike a traditional shipping box where all angles of the sides are generally orthogonal to each other, the sides of the boxes of this disclosure are not necessarily orthogonal to each other. Sides 36 and 38 of box 24 are formed to achieve a non-orthogonal angle with respect to face 40, so that when combined with the other boxes, such as box 32, they form a curved surface.

The perspective view in FIGS. 3*a-b* show box 24 split up into its outer box portion 42 and inner box portion 44. As demonstrated by this illustrative embodiment, each box portion can be a different size if needed so all the boxes form the overall desired shape; in this case, the partially spherical form of structure 2. This view also shows how face 40 is a planar face when unfolded. It is appreciated that in other embodiments, depending on how the box is ultimately cut, scored, and assembled, the box face may be twisted to further approximate or match a needed portion of a complex base surface. (See, also, FIG. 41). Also shown in this view is an unfolded blank version of box portion 42. As will be discussed further herein, each box has a surface, such as surface 40, that is individually sized to be part of the overall desired surface of structure 22. In addition, sidewalls, such as walls 38, 46, 48 and 50, are cut and scored illustratively along lines 52, 54, 56 and 58, respectively, so the blank can be folded into the box, as shown in this and FIGS. 13 and 14. Illustrative joints 60, 62, 64 and 66 attach one box portion side to another. For example, joints 60 and 62 which extend from side 46 attach to sides 38 and 48, respectively, when sides 38, 46 and 48 are folded along score lines 52, 54 and 56, respectively. The joint may be a tab cut of the box material or can be added separately. The joints may also be mechanically fastened, glued, or attached to the sides by some other similar type means. Properly attaching the joints to adjacent sides also ensures that those sides will be at the appropriate angle with respect to their adjacent surface. As previously discussed, unlike a conventional box the angle of the sides of these boxes with respect to the face are not necessarily orthogonal. They may be acute or obtuse with respect to the face depending on the ultimate shape of the surface and the box's location within that surface.

Figure 4:
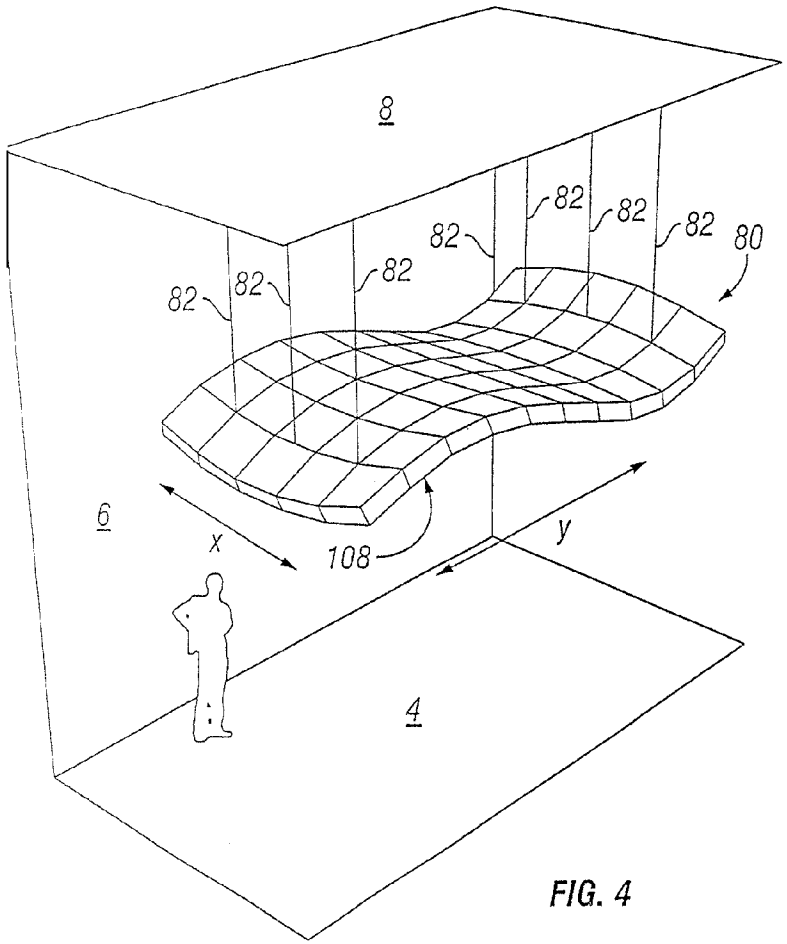
FIG. 4 is another illustrative embodiment of the present disclosure depicting a self-structuring and suspended ceiling structure.

A perspective view of another illustrative embodiment of these structures includes a suspended ceiling structure 80 shown in FIG. 4. Structure 80 is suspended from ceiling 8 via wires 82. In this illustrative embodiment, only enough wires are used to suspend the structure in the desired position. Additional structures or other wires are not needed to support each box that makes up structure 80 (but may be in alternative embodiments as shown in FIG. 47). It is appreciated in this view how structure 80, despite being made from a collection of straight edged twisted plane boxes, can form overall curved contours curves along both X and Y axes as shown.

The view of FIG. 5, is similar to that of FIG. 2, is structure 80 in partially exploded form having some of its component boxes separated therefrom. Boxes 84, 86, 88, 90, 92, 94, 96, 98, and 100 are each illustratively made from two box portions. Box 84, for example, includes box portions 102 and 104. In addition, each face of boxes 84 through 100 is individually sized, so when assembled in proper order with all of the other boxes, they form the surfaces 106 and 108 of structure 80. Likewise, the sides of the boxes are individually configured, as discussed with respect to the boxes shown in FIGS. 2 and 3. When assembling the boxes, however, the final shape will be that of structure 80 shown in FIG. 4. It is appreciated that this individualized box folding process may create a wide variety of structures having almost limitless complex form. A limiting factor in this regard is a designer's imagination.

Similar to FIGS. 3*a-b*, the perspective view of box 84 further exploded into its box portions 102 and 104 in FIGS. 6*a-b* show how the boxes can be assembled to create structure 80. Each box portion 102 and 104 may have its own unique box surface, such as surfaces 110 and 112, to serve as a component of the overall shape of surfaces 106, 108, respectively. And like box portions 42 and 44 of structure 2, each box portion 102 and 104 is made from a flat blank, such as the blank form of box portion 104 that is cut, scored and then folded into a box. As shown, sides 114, 116, 118, and 120 are cut out and surface 110 defined by score lines 122, 124, 126, and 128, respectively. This defines the size of the surface as well.

Joints 130, 132, 134, and 136, are formed and configured to attach to adjacent sidewalls to form the folded box portion. As previously discussed, it is appreciated that the joints are configured to ensure the sides are located at the proper angle with respect to the corresponding surface. As also discussed, that angle is not necessarily orthogonal. It is conceivable, based on a particular desired surface shape that some boxes may have orthogonal sides with respect to their surfaces, but as these illustrative embodiments demonstrate, it is not a requirement and it is this flexibility that allows such a variety of surface shapes to be constructed. It is further appreciated that the joints can be attached to corresponding sides via magnets, fasteners, adhesives, or the like.

Figure 7:
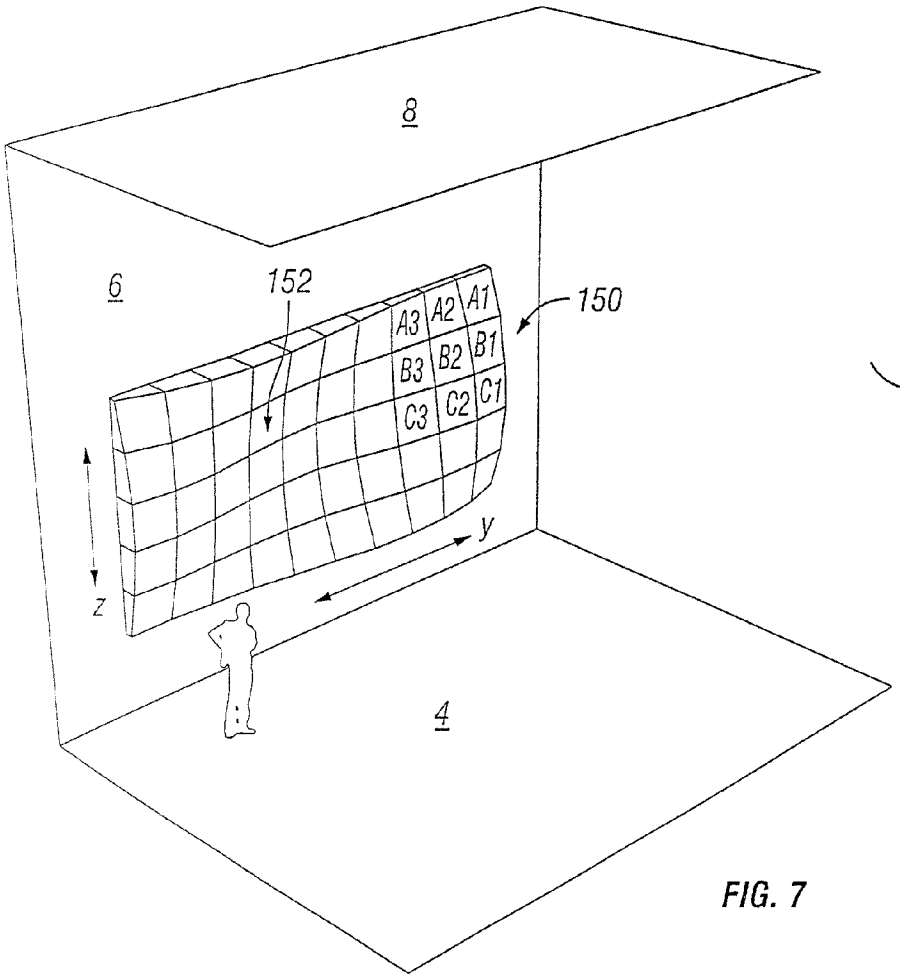
FIG. 7 is a perspective view of a wall mounted structure having a multi-curved surface.

A perspective view of another illustrative embodiment of a structure 150 mounted onto wall 6 is shown in FIG. 7. This further illustrates the versatility in shape and application of these structures. Structure 150, despite being mounted onto wall 6, still includes a plurality of curves in the Y and Z directions as shown. Like structures 2 and 80 shown in FIGS. 1 and 4, respectively, structure 150 is made up of individual boxes of unique size that when assembled in proper order, forms surface 152. The assembly order system shown for structure 150 is the same as that shown with respect to structures 2 and 80.

Using individually sized and shaped boxes, but boxes nonetheless, attached to each other without a frame or support structure, but in proper order may create radically varied surface forms. The boxes can be attached to each other via magnets or other structures, as discussed further herein. It is appreciated that the teachings of this disclosure are not limited to the specific surface forms or structures shown herein. Indeed, these examples demonstrate how many variably-shaped structures can be made.

Figure 8:
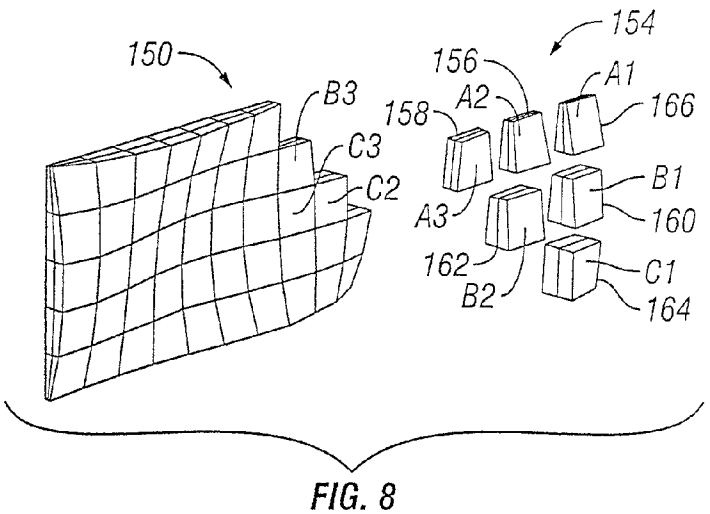
FIG. 8 is a perspective, partially exploded view of the wall mounted structure of FIG. 7 depicting individual boxes that compose the wall structure.

Similar to FIGS. 2 and 5, FIG. 8 shows structure 150 in partially exploded view to demonstrate how individual boxes 154, 156, 158, 160, 162, and 164 are connectable to form structure 150 and create surface 152. This view in particular shows how box 154 is very much different in shape than box 160 or box 158 for that matter. Again, this is not simply stacking identically-shaped boxes on top of one another. Each box is its own size and is a small contributor to the overall surface shape of the structure. As shown in this view, assembling boxes in order of A1, A2, A3 and so on, over boxes B1, B2, over Box C1 and so on, builds the final structure. It is appreciated that although not shown, the letter/numbering system starting with A1, A2 . . . is extended to all of the boxes. In addition, the location of the indicia is illustrative only. In other embodiments, box assembly sequence indicia can be located on the sides, back, or other discreet locations that may not even be visible when the final structure is assembled. Surface 166 of box 154 is real estate that may be used for such applications as advertising, murals, light, lenses, mirrors, etc. that might be applied to the entire structure 152 in a manner that runs across several or all of faces. It is also appreciated that these surfaces may be useful in the same and even more ways as conventional wall surfaces.

Figure 9:
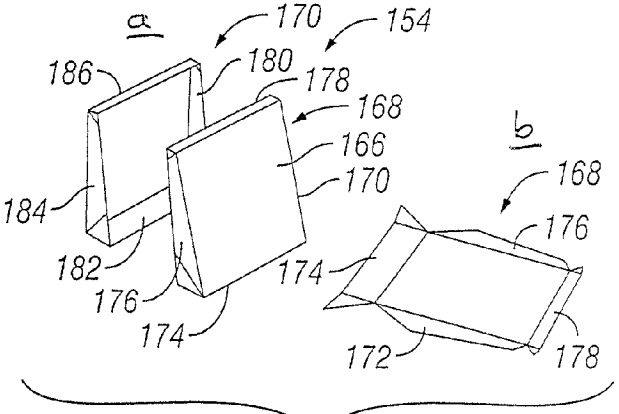
FIGS. 9*a-b* are perspective views of one set of the box portions from the wall mounted structures of FIGS. 7 and 8, and a perspective view of one of those boxes in an unfolded blank condition.

Perspective views of box 154 split into front and rear portions 168 and 170, respectively, are shown in FIGS. 9*a-b*. In addition, an unfolded blank version of box portion 168 is shown. This view depicts how sides 172, 174, 176, and 178 of box portion 168 and sides 180, 182, 184, and 186 of box 170 can all be different and have varied thicknesses depending on the boxes' location in the overall structure. Box portion 168, shown in blank form, depicts how sides 172, 174, 176, and 178 are formed and may vary the thickness of box 168 when folded. The same is true with sides 180-186 of box 170 and all the other boxes of the structure for that matter. Like the blanks shown in FIGS. 3 and 6, blank 168 is cut and scored to form sides 172, 174, 176, and 178.

Perspective detailed views in FIGS. 10-14 show boxes in various forms of assembly from unfolded blank form to fully assembled. It is the folding, assembling, and stacking these boxes that form the final structure. As seen in these views, as well as the others, there are no additional frames or skeletons needed to support the shape of the structure.

Figure 10:
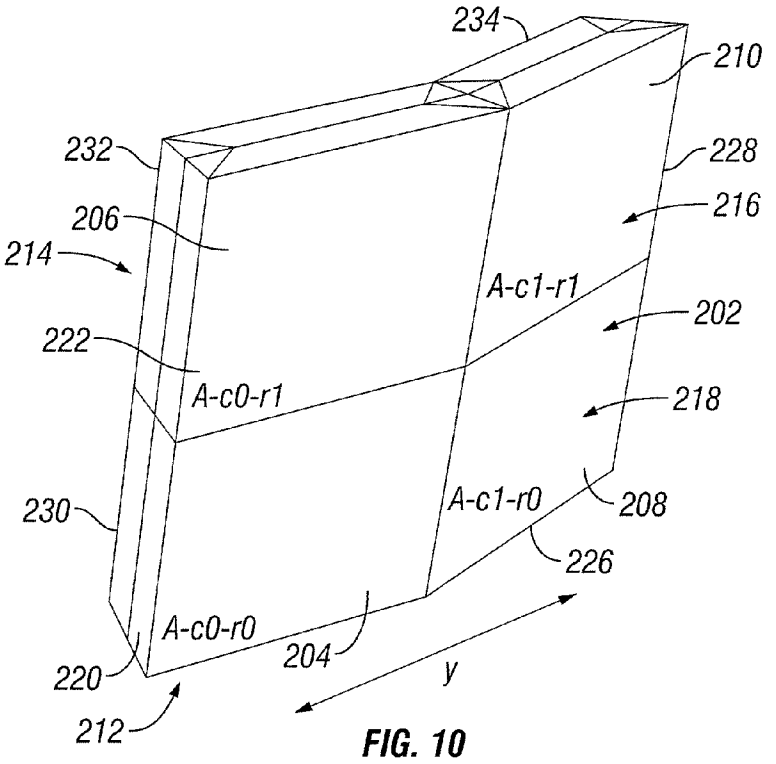
FIG. 10 is a perspective view of four box assemblies that make up a portion of a freestanding structure.

The perspective view of structure 200 in FIG. 10 includes a structure surface 202 composed of sub-surfaces 204, 206, 208, and 210 of boxes 212, 214, 216, and 218, respectively. Curves along axis Y is formed as part of surface 202. In order to assemble a structure that includes such curves, each box is specially formed as a small part of that surface. As shown in this view, each box is labeled so during assembly each box will have a predetermined location. For example, box 212 includes the indicia "A-c0-r0." In this embodiment, "A" indicates the outer surface, "c" is the column and "r" is the row. So box portion 220 is positioned on the outward side, in the 0 column and the 0 row. The next box portion 222 of box 214 is also shown in column 0, but is now in row 1, as indicated. Similarly, the other box portions 226 and 228 are located outwardly with box portion 226 now in column 1 while still in row 0. Lastly, box portion 228 is located in column 1, row 1. Knowing where each box portion is to be positioned with respect to the other box portions is what ensures the final surface of the structure is assembled properly. As previously discussed, each box surface size and sidewall angle is specific to its predetermined location within the scheme of the overall surface. In an illustrative embodiment, when designing a structure with a particular surface contour, there are often both inner and outer surfaces. Because many structures contemplated in this application have a thickness, the inner surface will be slightly different than the outer surface. In certain embodiments the surfaces may be the same, but in others very different. Accordingly for these embodiments, each box may be made up of two box portions, a single box portion in other embodiments, essentially inner and outer hemispheres, such that each box portion may connect together to form a box. Each box portion may also have different dimensions, particularly thickness. Box portions 230, 232, 234, and 236 all support the inner surface (not shown) of structure 200.

Figure 11:
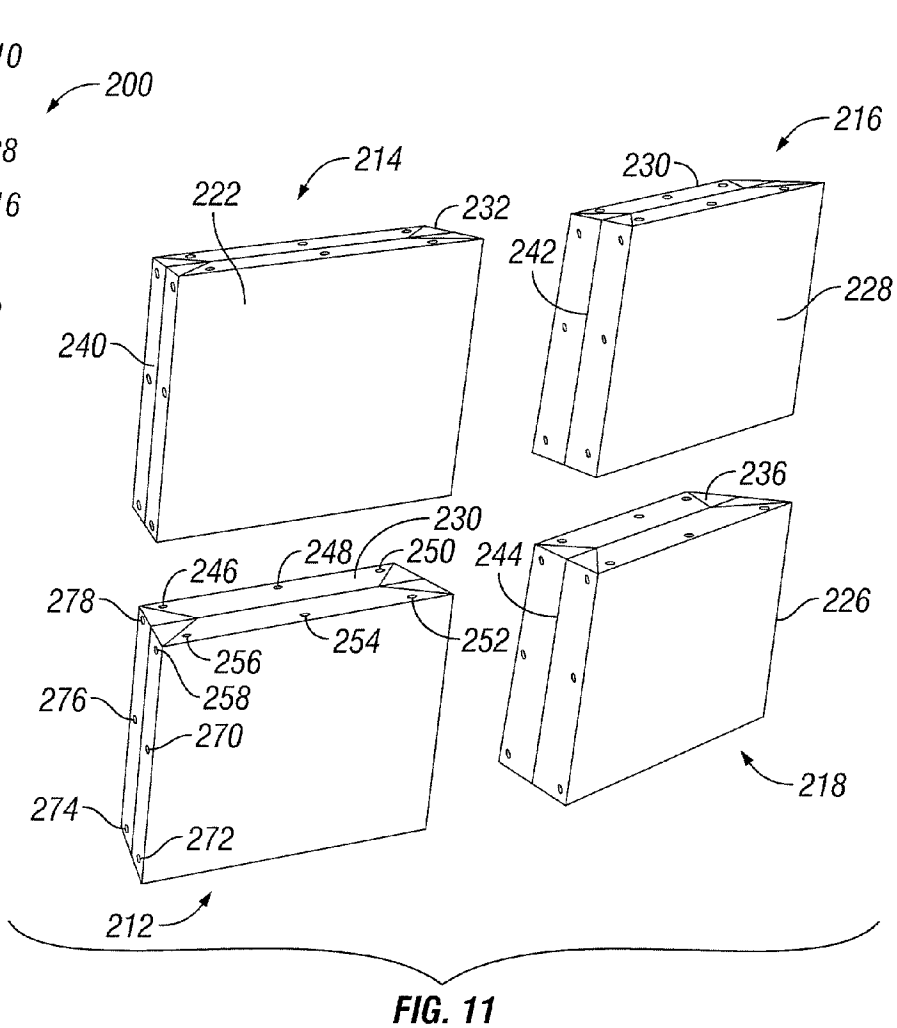
FIG. 11 is a perspective, exploded view of the box assemblies of FIG. 10.

An exploded view of structure 200 is shown in FIG. 11. In this view each box 212 through 218 is separated from each other. Illustratively, each box portion 220-228 and 230-236 join together as shown. Hemispherical lines 238, 240, 242, and 244 are the seams located between the box portions. It is appreciated that in these illustrative embodiments the box portions are not necessarily partially spherical. Each box portion is given this term to indicate how two box portions are combined form the single box. In order to connect the boxes together, each box portion includes attachment points, such as points 246, 248, 250, 252, 254, 256, 258, 270, 272, 274, 276, and 278. These attachment points, which are visible on boxes 212-218, may be magnets that attract corresponding magnets on other boxes to attach them together. Alternatively, the points may be through-holes that accept fasteners, such as bolts or screws; an adhesive that stick to adjacent boxes; or other like attachment structure so that each of the boxes will connect and secure to each other. It is appreciated that this securement may be temporary or permanent, depending on the need of the structure. These attachment points may also assist in aligning boxes together to ensure they assemble to the desired structure.

Figure 12:
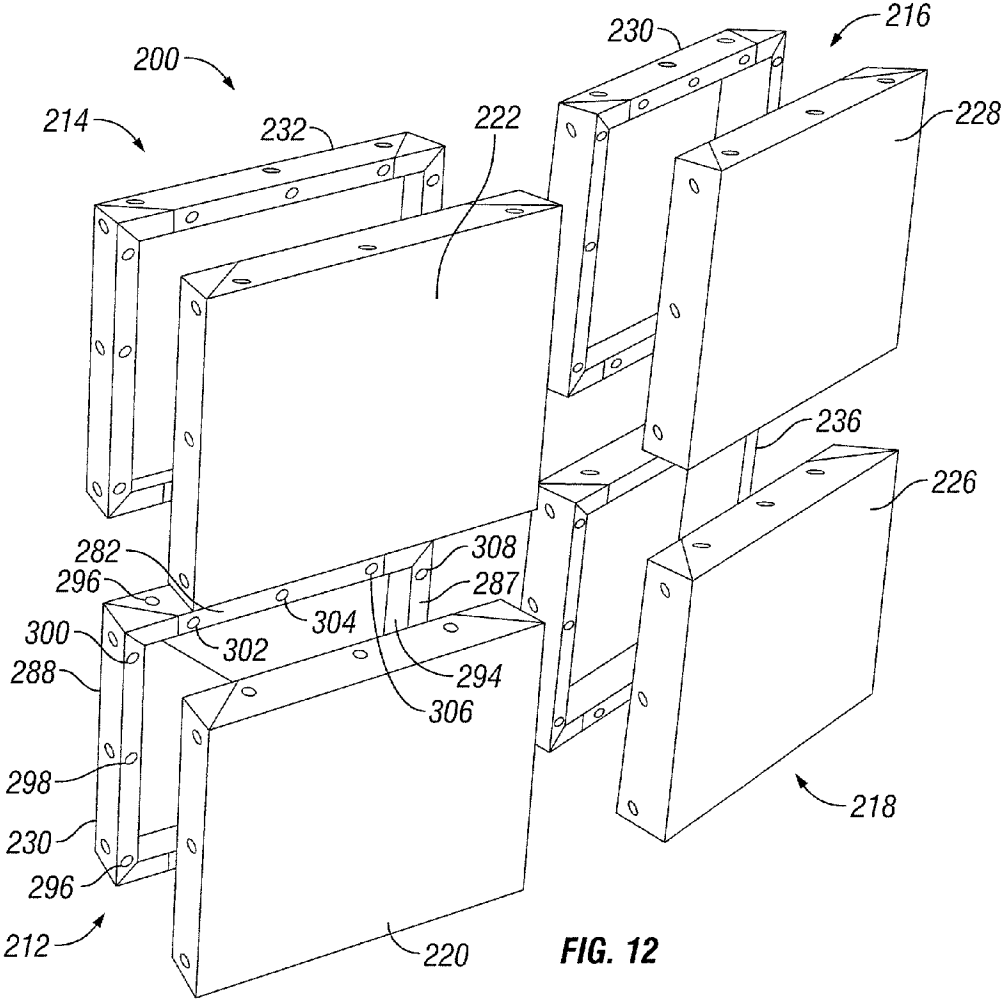
FIG. 12 is another view of the box assemblies of FIGS. 10 and 11, but further exploded to separate the inner and outer box portions.

A perspective, further exploded view of structure 200 is shown in FIG. 12. Here each box portion is separated. For example, box 212 is separated into box portions 220 and 230. The same is the case with box portions 222 and 232 of box 214, portions 226 and 236 of box portion 218, and portions 228 and 230 of box 216. This view further demonstrates how hemispherical box portions may attach to each other. With respect to box 212, for example, each box portion, such as box portion 230, includes flanges 280, 282, 284, and 286 that extend from sides 288, 290, 292, and 294, respectively. These flanges are configured to face corresponding flanges on the opposed box portion, such as flanges (not shown) on box portion 220. Magnets 296, 298, 300, 302, 304, 306, 308, are likewise, illustratively configured to attract to and thus attach to corresponding magnets (not shown) on the flanges of box portion 220. It is further appreciated that in alternative embodiments, the attachment means may include fasteners such as bolts or screws, adhesives, or they may be alignment holes to receive other attachment, structures, or mechanisms. As can be appreciated from FIG. 12, the same process may be applied to box portions 222/232, 226/236, and 228/230 as well.

Figures 13A, 13B, 13C:
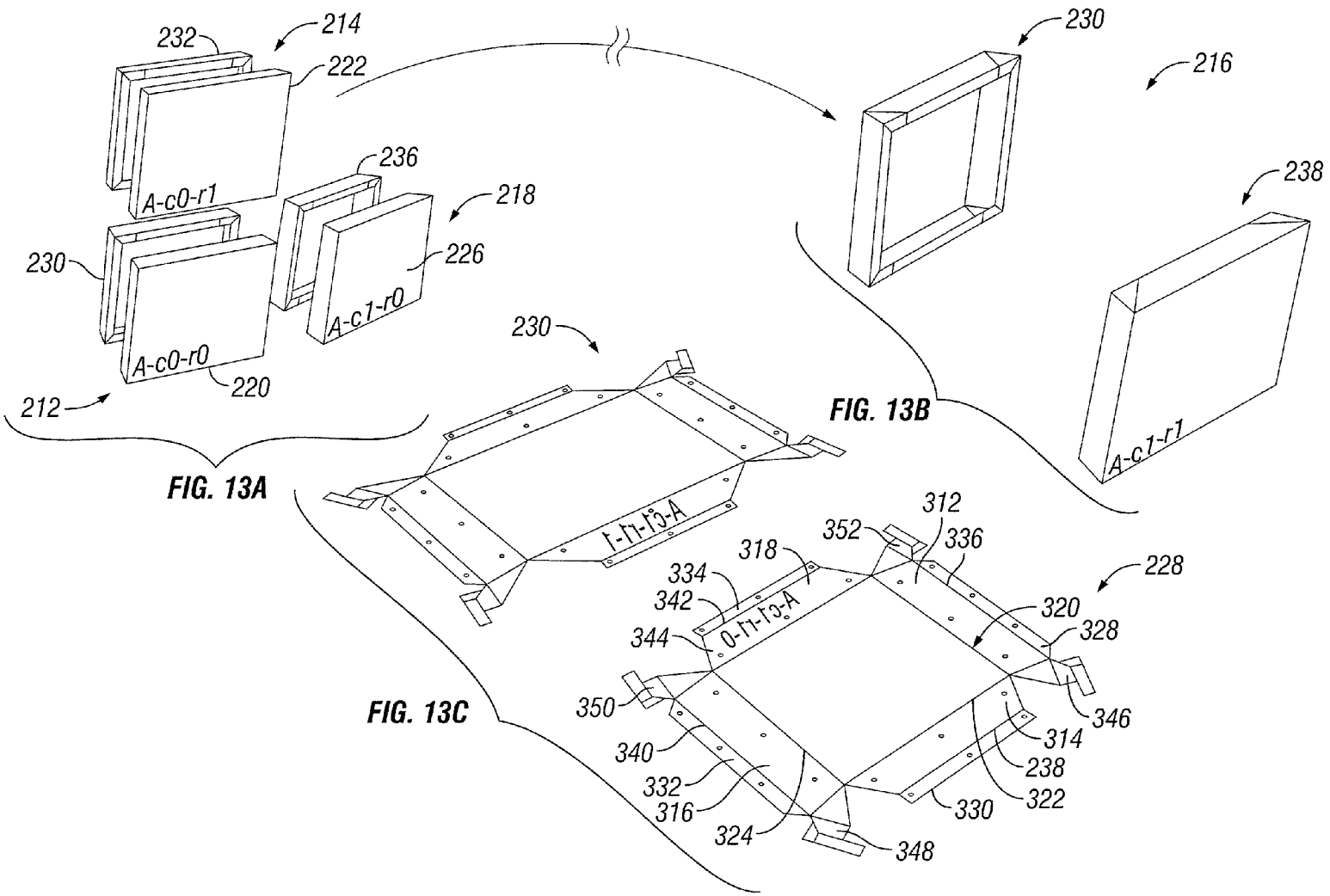
FIGS. 13*a-c* show the box assembles of FIGS. 10-12, where

An illustrative method of forming and assembling each box portion is shown in FIGS. 13*b-c*. The view in FIG. 13*a* is similar to that of FIG. 12 with each of boxes 212 to 214 and 218 in exploded view separating portions 220/230, 222/232, and 226/236 from each other. Box portions 228/230 of box 216 are shown in FIG. 13*b*. In this illustrative embodiment, each box portion 228 and 230 (as well as all the box portions for that matter) begin life as a cut blank, as shown in FIG. 13*c*. Portions 228 and 230, in blank form, are made from a sheet of material such as plastic, paper, or sheet metal, for example. Box portion 228 in blank form includes face 310 with sides 312, 314, 316, and 318 extending therefrom defined by score lines 320, 322, 324, 326. Extending from sides 312, 314, 316, and 318 are flanges 328, 330, 332, and 334, respectively, defined by score lines 336, 338, 340, and 342, respectively. Indicia 344 may be affixed to one of the sides to indicate assembly order as previously discussed. Joints 346, 348, 350, and 352 are cut and scored to attach adjacent sides together, such as sides 312 and 314, for example. It is appreciated that the joints may attach to adjacent sides via mechanical means, such as fasteners, adhesives, welding, etc.

Figures 14A, 14B, 14C, 14D, 14E, 14F, 14G:
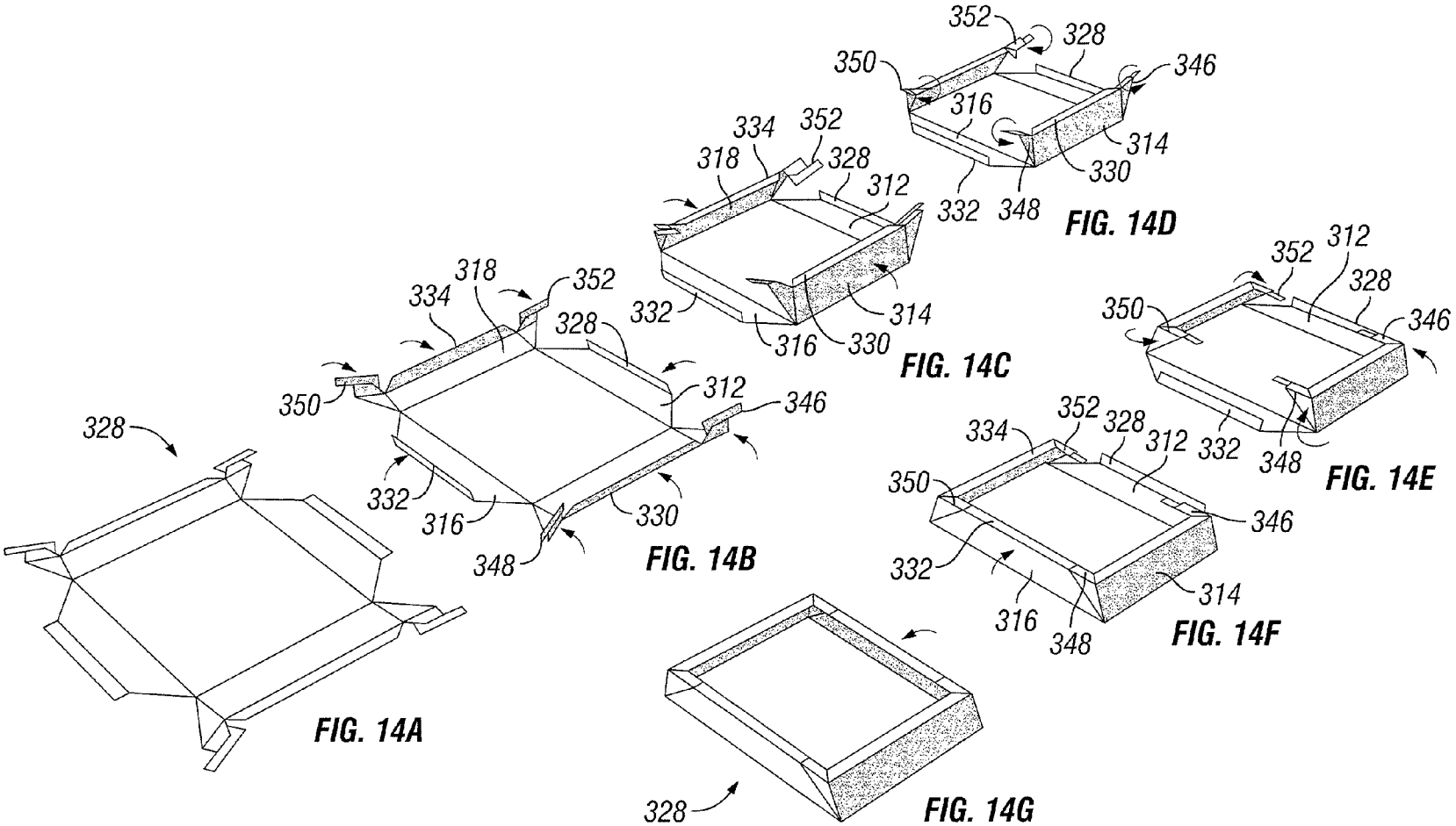
FIGS. 14*a-g* are perspective views of a single box portion showing a progression from their unfolded cut blank form in FIG. 14*a* to a completely folded box portion form in FIG. 14*g* with the other views demonstrating how the box portion is folded.

A perspective progression view of creating box portion 328 from a flat sheet blank is shown in FIGS. 14*a-g*. The view of FIG. 14*a* is the same as FIG. 13*c* where a flat sheet version of box portion 328 has been cut and scored. In this illustrative embodiment, flanges 328, 330, 332, and 344 are folded upwards. Similarly, portions of lap joints 346, 348, 350, and 352 are folded upward as shown. Then sides 314 and 318 are folded upward as well. This causes flanges 330 and 334 to be essentially positioned parallel to surface 310. This not only begins to form the shape of the box, but positions the flanges so they will be located opposite flanges from the opposed box portion thereby forming a complete box. Next, lap joints 346, 348, 350 and 352 are folded over adjacent their corresponding sides as shown so they may attach to both adjacent sidewalls and adjacent flanges, as shown in FIG. 14*d*. The view in FIG. 14*e* continues folding flanges 346, 348, 350 and 352 over to receive sides 312 and 316. In FIG. 14*f*, sides 312 and 316 are folded upward so both sides may attach to their adjacent lap joints, such as joints 346 and 352 with respect to side 312 and joints 348 and 350 with respect to side 316. Once all the lap joints have attached to the sides via means previously discussed, a finished box portion 328 is formed as shown in FIG. 14*g*.

Figure 15:
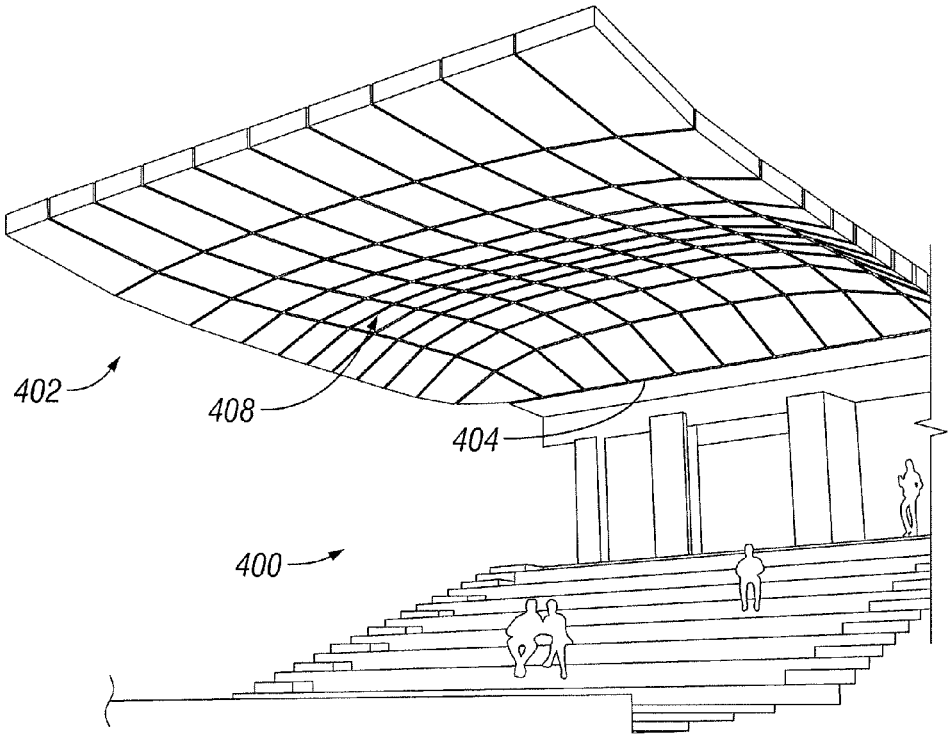
FIG. 15 is an upward looking perspective view of an interior ceiling of a theater space that includes a suspended structure overhead.

An upward looking perspective view of a theater interior space 400 with a suspended structure 402 located overhead is shown in FIG. 15. This embodiment demonstrates another application for these structures. In this case, structure 402 is suspended between two ends 404 and 406 of space 400 illustratively under roof, below a floor above or below a ceiling. The view of FIG. 15 only shows end 404, but a second end 406 is represented in the line drawings of FIG. 16*a-e*. Nevertheless, the view in FIG. 15 depicts another illustrative utility of these self-supporting structures. Though structure 402 is attached to building 400 at ends 404 and 406, there is no independent framing or skeleton needed to support the shape of the individual boxes that make up structure 402. It is also evident from this view how surface 408 of structure 402 can be arched or curved in multiple directions.

Figure 16A:
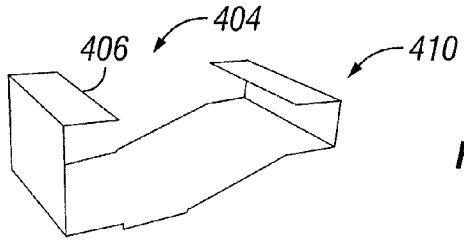
FIGS. 16*a-e* are side perspective views of the outline of a portion of the theater of FIG. 15 showing a progression from an empty space where the structure is to be located through the design of the base surface of the structure to the eventual formation of the individual boxes that connect to each other to form the structure.
Figure 16B:
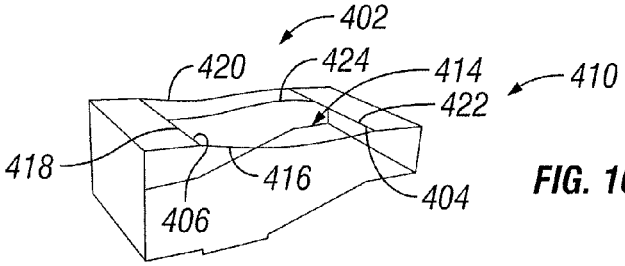
Figure 16C:
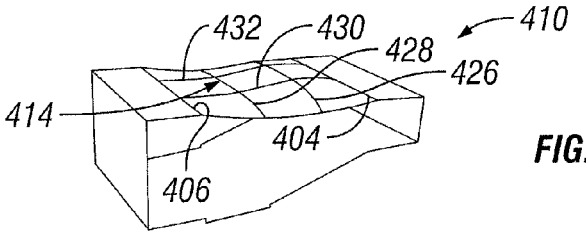
Figure 16D:
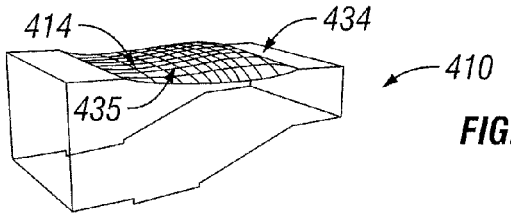

FIGS. 16*a-e* are side perspective views of an outline 410 portion of space 400 and a progression of how structure 402 is designed. Building outline 410 is shown in FIG. 16*a*. Outline 410 includes ends 404 and 406, as well as open space 412 to establish the location and boundaries for the yet to be created structure 402. It is appreciated that sight dimensions or CAD data from this outline may be used to establish the boundaries. Curves 418 and 422 are derived from boundaries 406 and 404 respectively. Curves 416, 420, and 424 are specified by designer of 402. Base surface 414 is created from curves 416, 418, 420, 422, and 424. It is appreciated, however, that the number and design of curves of the base surface can almost be limitless. As depicted in FIG. 16*c*, curves 426-432 are generated to show the contour lines of the curves. The base surface is the starting and end point of the structure. On one hand, the base surface is the desired surface shape of the final structure; while on the other hand, it is the starting point for creating that structure. The computer system based design system generates the boxes for the final installation from the surface automatically and the boxes can, therefore, be previewed in realtime as the base surface is manipulated. This process creates an ease in design because the focus always is on the final structure's intended look. The view in FIG. 16*d* shows a grid of curves 434 whose quantity and location are specified by the designer for aesthetic or functional reasons or both. A grid of points 435 lying on surface 414 is derived by the intersections of all lines in grid 434 and the end points of lines in 434 (which are also illustratively the intersection of 434 with lines 416, 418, 420, and 422). By connecting the points in 435 with straight line segments in the same pattern as the curves in 434, a group of quadrilateral polygon faces is formed. These faces are converted into box-like volumes to form the final structure shown in FIG. 16*e*. In this view, base surface 414 may form hexagonal tiles 437, quad tiles 439, or diamond tiles 441, for example.

Figure 16E:
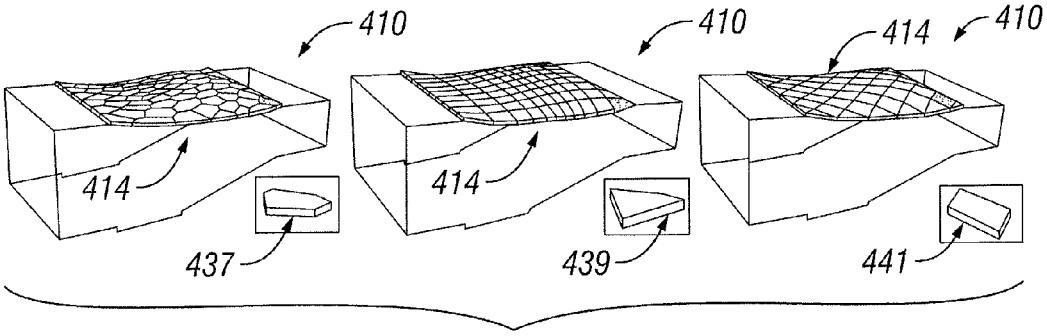

It is appreciated that with the boxes defined, as shown in FIG. 16*e*, each box can be subdivided to form the two box portions (top and bottom in this case). Each of these box portions is then translated into a two-dimensional outline which serves as the cut and score line template used to cut the flat sheet blanks, such as that shown in FIG. 13*c*. Indeed, FIGS. 13*c-a* depict the next step of this process. Once the box portion templates are established and the sheet blank is cut and scored, as shown in FIG. 13*c*, the blank may be folded into box portions, as shown in FIG. 13*b*, according to the process shown in FIGS. 14*a-g*. The box portions may then be connected and assembled with the other box portions, as shown in FIG. 13*a*, to form the structure.

Figures 17A, 17B, 17C:
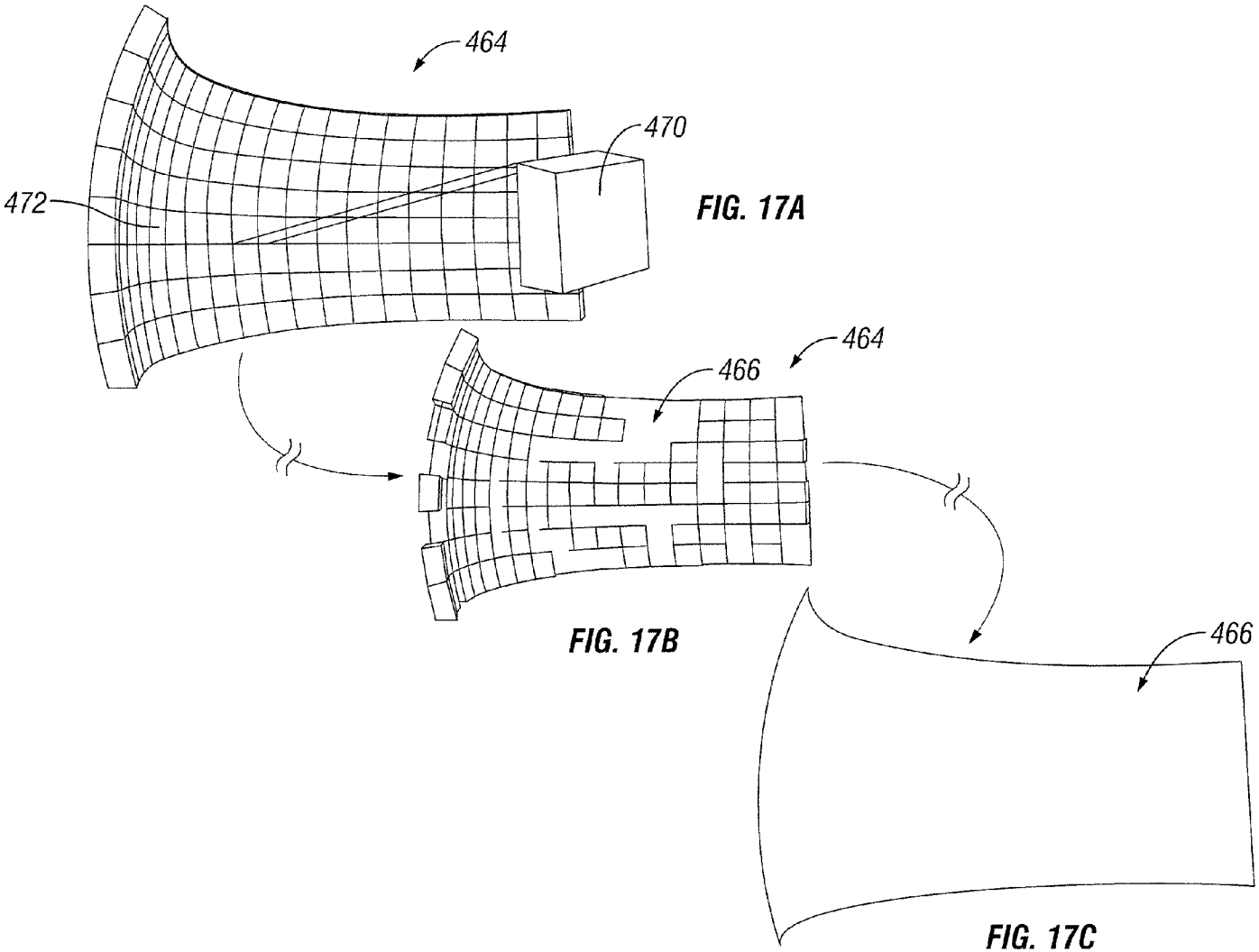
FIGS. 17*a-c* are perspective views of a structure, partially formed structure with base surface and base surface demonstrating how the structure is made.

FIGS. 17*a-c* are perspective views of another illustrative embodiment of a structure 464. FIG. 17*a* shows a complete structure with only one box 470 in exploded view. FIG. 17*b* is a partially formed structure 464 that includes base surface 466. And FIG. 17*c* shows the original base surface 466. As previously discussed, base surface 466 is the starting point for designing 464, and can be modified throughout the design process. To design and make the boxes that comprise 464, a computer program sub-divides the base surface 466 into sub-regions using a chosen tiling strategy, such as quad (illustrated), vari-quad, diamond, voronoi and hexagonal. The resulting surface sub-regions are then converted into individual boxes, each with unique geometry and location that is dependent on the characteristics of the corresponding surface sub-region. Because each box, such as box 470, is unique, as determined by the shape of the base surface, each box is assembled in unique location and orientation to form the structure. It is appreciated that each box is uniquely shaped, such as box 470 as compared to box 472. All the different boxes that make up structure 464 are assembled in the same manner. This is in contrast to using same-shaped boxes. Having all the boxes be the same size does not offer the flexibility to make complex curves with boxes whose front-face edges abut edges of neighboring boxes. This is one of several distinctions between prior art designed in the present disclosure.

Figure 18:
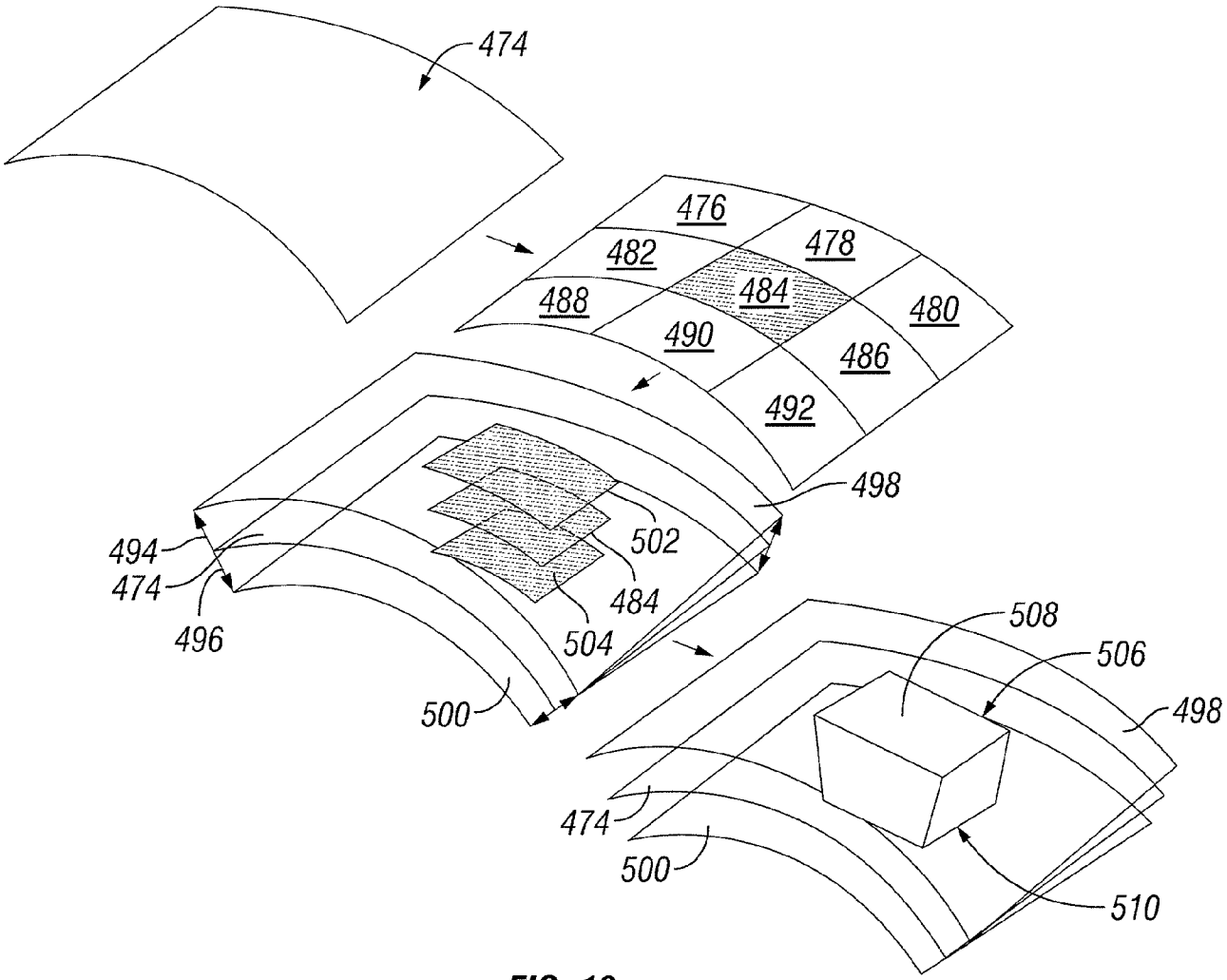
FIG. 18 includes views depicting how a building box is formed from a base surface.

Now the question becomes, if a base surface is to be converted into a grid of boxes and that base surface can be any myriad of bends, curves, shapes, etc., how does that base surface translate into a grid of three-dimensional boxes? To accomplish this, as depicted in FIG. 18, the base surface undergoes an illustrative series of transformations. Once the base surface, such as base surface 474 is created with all the curves and angles, etc., it is divided into discreet tile regions, such as tiles 476, 478, 480, 482, 484, 486, 488, 490, and 492 based on the specific tiling logic chosen by the designer. Again, the tiling logic or strategy means the type of surface shape each box will have, whether it is quad, variable-quad, diamond, voronoi, or hexagonal (and many more). In the case of tiles 476-492, each is generally square or rectangularly-shaped (quad) defining nine discreet regions. This number may be more or less depending on the size and configuration of the base surface and the will of the designer. It is appreciated at this step that both the density and aspect ratio of the tile is adjustable (or other shape characteristics depending on the particular nature of the tiling strategy). The density is the number of tiles in a given space and aspect ratio is the change in length and width of the tile itself. In illustrative embodiments, the density and aspect ratio can be continuously adjusted at any time throughout the design process of the structure prior to cutting the flat sheet material. Once the tiles on base surface 474 are established, it is offset in opposed directions 494 and 496 to form two additional surfaces, each having a unique relationship to the original base surface 474 (parallel offset, variable distance offset, or even different contour) per the specification of designer. In this view, a front surface 498 and rear surface 500 are formed extending parallel to base surface 474. In addition, each tile 476-492 extends to surfaces 498 and 500. As shown in this view, tiles 502 and 504 are located on surfaces 498 and 500, respectively, and are highlighted herein for demonstrative purposes. The offset of surfaces 498 and 500 from base surface 474 also establishes the thickness of the boxes that will be created. In this case, tile 502 represents the front face of a box, while tile 504 represents the rear face. Like density and aspect ratio, this depth or box thickness can be variable and, thus, adjusted throughout the design process. With the front and rear tiles 502 and 504 established, they can be connected by surfaces to create the box that is part of the final structure. As shown herein, a box 506 has a front 508 from tile 502 and rear face 510 from tile 504. The shape of the sidewalls and angle with respect to the front and rear surfaces will be contingent and variably based on the local curvature of the base surface at that particular location. As the curve and location changes, so too will the angle and shape of those surfaces. This process is repeated for every tile created on the base surface until that entire surface has been translated into individual boxes.

Figure 19A:
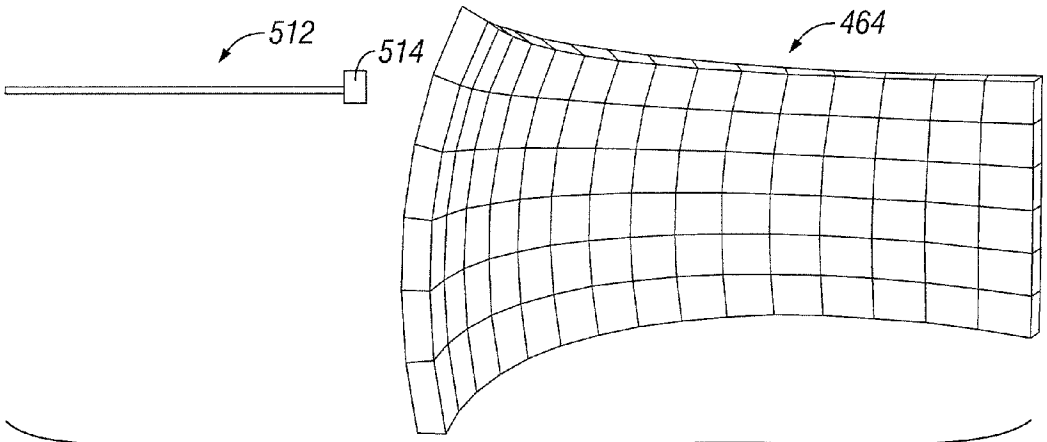
FIGS. 19*a* and *b* depict of how the base surface of a structure can be changed even when defined by individual boxes.
Figure 19B:
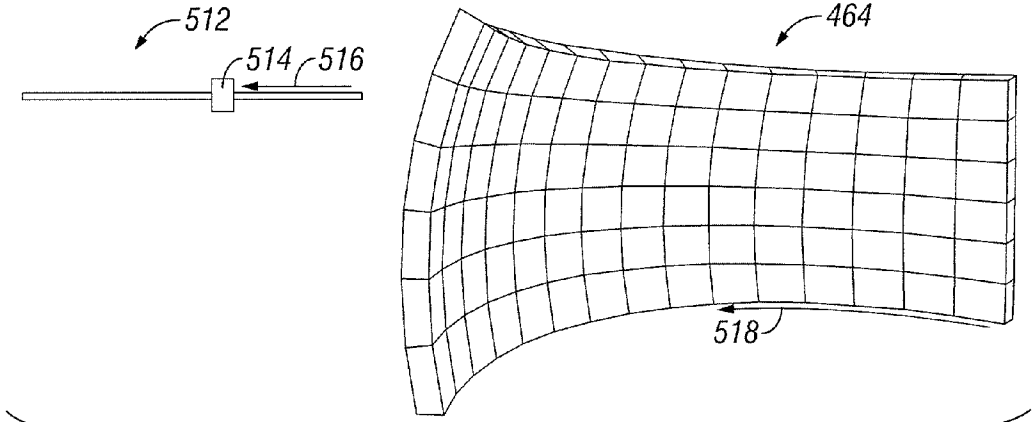

Despite converting surface tiles into three-dimensional boxes, the shape of the structure may still be modified. The perspective views of structure 464 in FIGS. 19*a* and *b* demonstrate how it is modifiable by slider function 512 (alternatively integer input). In the illustrative embodiment, slider 514, shown in a starting position in FIG. 19*a*, can be slid in direction 516 to extend structure 464 in direction 518. It is contemplated that a computer program can generate numeric inputs that drive the definition of the base surface and, thus, proportions of the tiles as established in FIG. 18 to change the shape of the boxes as shown (as well as quantity of boxes if predetermined min-max threshholds are exceeded.

Figure 20A:
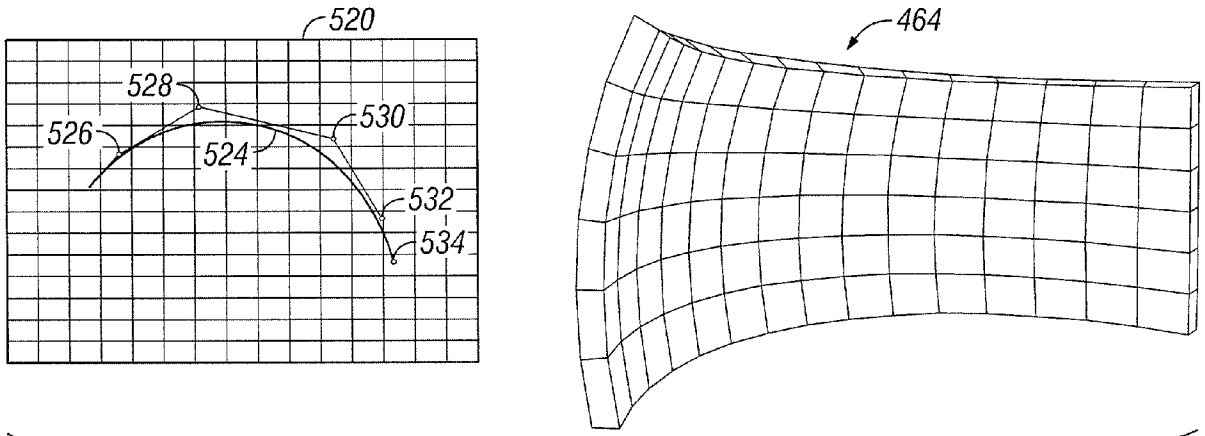
FIGS. 20*a* and *b* are each plan and perspective views of the structure of FIGS. 19*a* and *b* that demonstrate how it can be further modified even while defined by individual boxes.
Figure 20B:
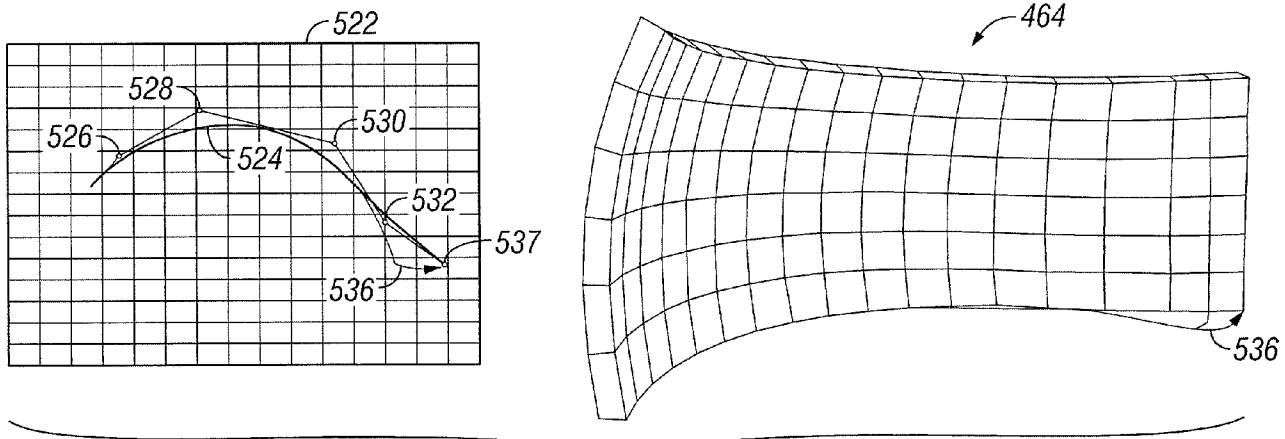

Another way of modifying structure 464 is shown in FIGS. 20*a* and *b*. In this example, plan views 520 and 522 include curve 524 that defines the bottom edge of the base surface 466 in FIG. 17*c* that defines structure 464 located to the right. Control points 526, 528, 530, 532, and 534 are attached to curve 524. Moving the control points will move the shape of the curve surface 524. For example, moving control point 534 from location in FIG. 20*a* in direction 536 to new location 537 in FIG. 20*b* moves curve 524 and ultimately structure 464 as shown. Accordingly, by moving control points 526-534, the user can make precise adjustments to curve 524 in this two-dimensional view. Alternately, the user can make similar adjustments to other two-dimension curves (plan, elevation, and/or section views) in order to change shape of 464.

Figure 21B:
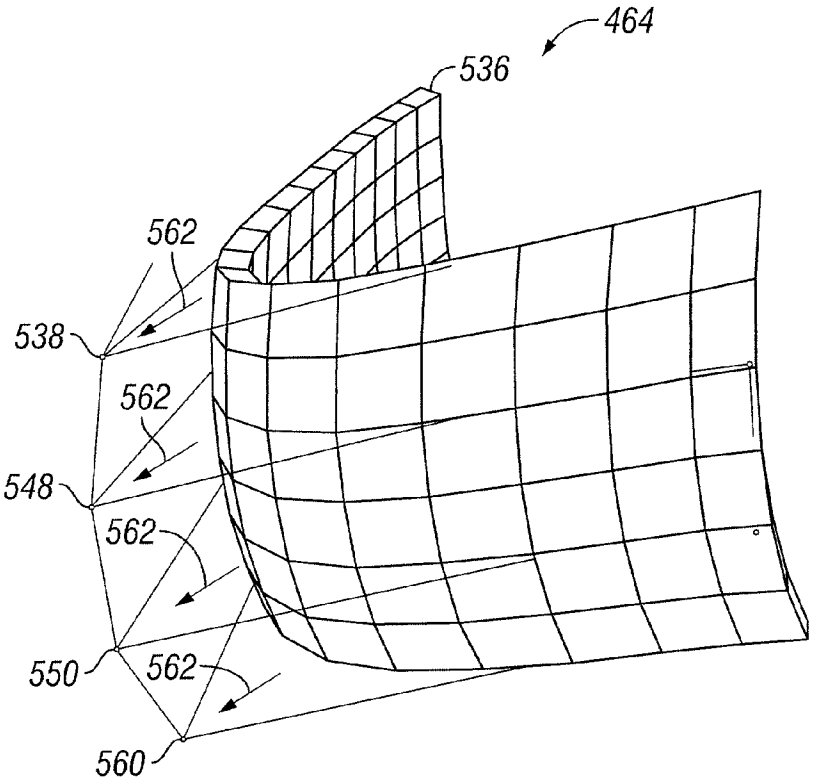
FIGS. 21*a* and *b* are perspective views of the structure from FIGS. 19 and 20 demonstrating how computationally derived control points can further manipulate the base surface to change the size and shape of the structure.
Figure 21A:
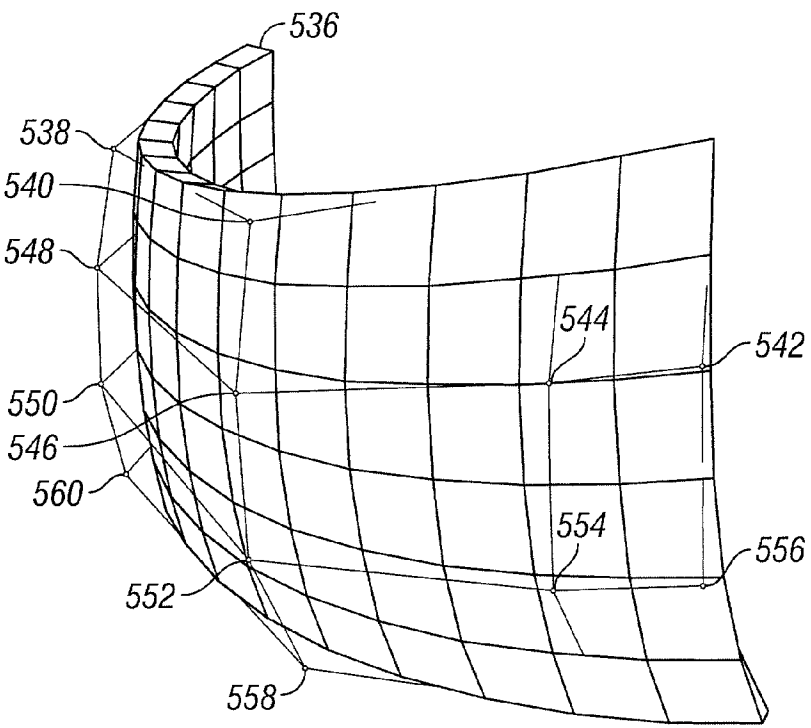

Similar control points may also be used in three-dimensional space to adjust the shape and size of structure 464. As shown in FIGS. 21*a* and *b*, the same base surface, although not shown in this view but represented by reference number 466 in FIGS. 17*a-c*, can be adjusted to change the shape of structure 464. Control points 536, 538, 540, 542, 544, 546, 548, 550, 552, 554, 556, 558, and 560 (additional control points not shown may be employed as well) are each individually movable to move a corresponding portion of structure 464. As demonstratively shown in FIG. 21*b*, control points 540, 546, 552, and 558 are moved in direction 562 to move the shape of 464 in the same direction to create a deeper curve than that shown in FIG. 21*a*.

Figure 22B:
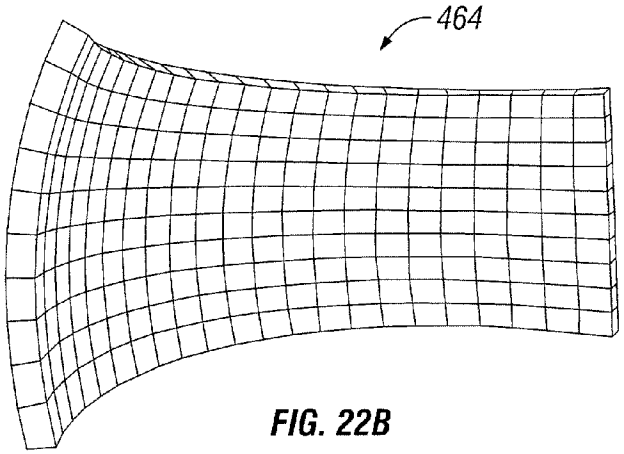
FIGS. 22*a-d* are perspective views of the structure from FIGS. 19*a* and *b* where the structure's density and aspect ratio along with the tiling strategy or configuration may be changed.
Figure 22D:
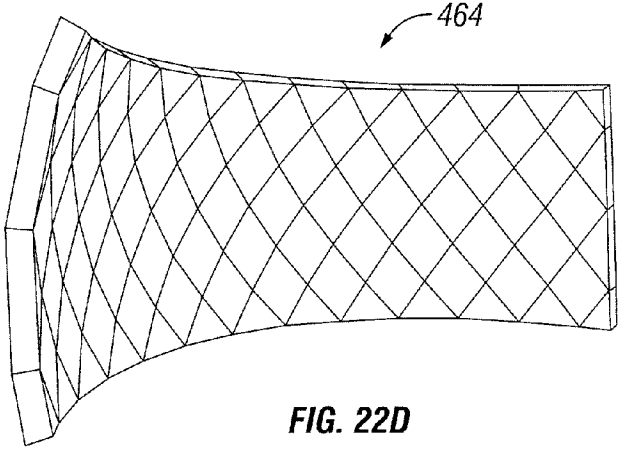
Figure 22A:
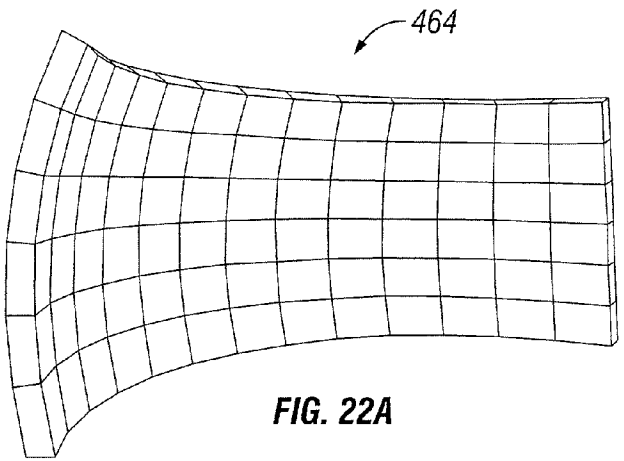
Figure 22C:
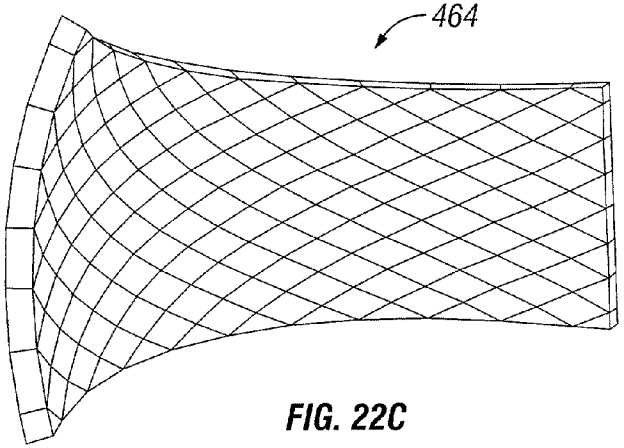

In addition to changing the geometry of surface 466 of structure 464 as previously discussed, a designer can also adjust the tiling solution, density, and aspect ratio. As previously discussed with respect to FIG. 18, by creating a box from surfaces, in this case parallel (non-parallel in other embodiments) to the base surface, all of these parameters are adjustable. It is appreciated in this illustrative embodiment that all of these parameters are independent of each other and, thus, can be independently adjusted at any time during development. As shown in FIGS. 22*a-d*, varying the density and aspect ratio of structure 464 between FIGS. 22*a* and *b* causes a net increase of boxes. By increasing the number of boxes, however, the cost of manufacture may also increase. Nevertheless, the precision of the surface will approximate closer to the original base surface than a surface with a lower density. The views shown in FIGS. 22*a* and *c* also demonstrate how the type of tiling solution may be changed. FIGS. 22*a* and *b* show quad-shaped boxes while FIGS. 22*c* and *d* show diamond shaped boxes. This flexibility allows the designer to have an expanded pallet of design choices for creating these structures.

Figure 23:
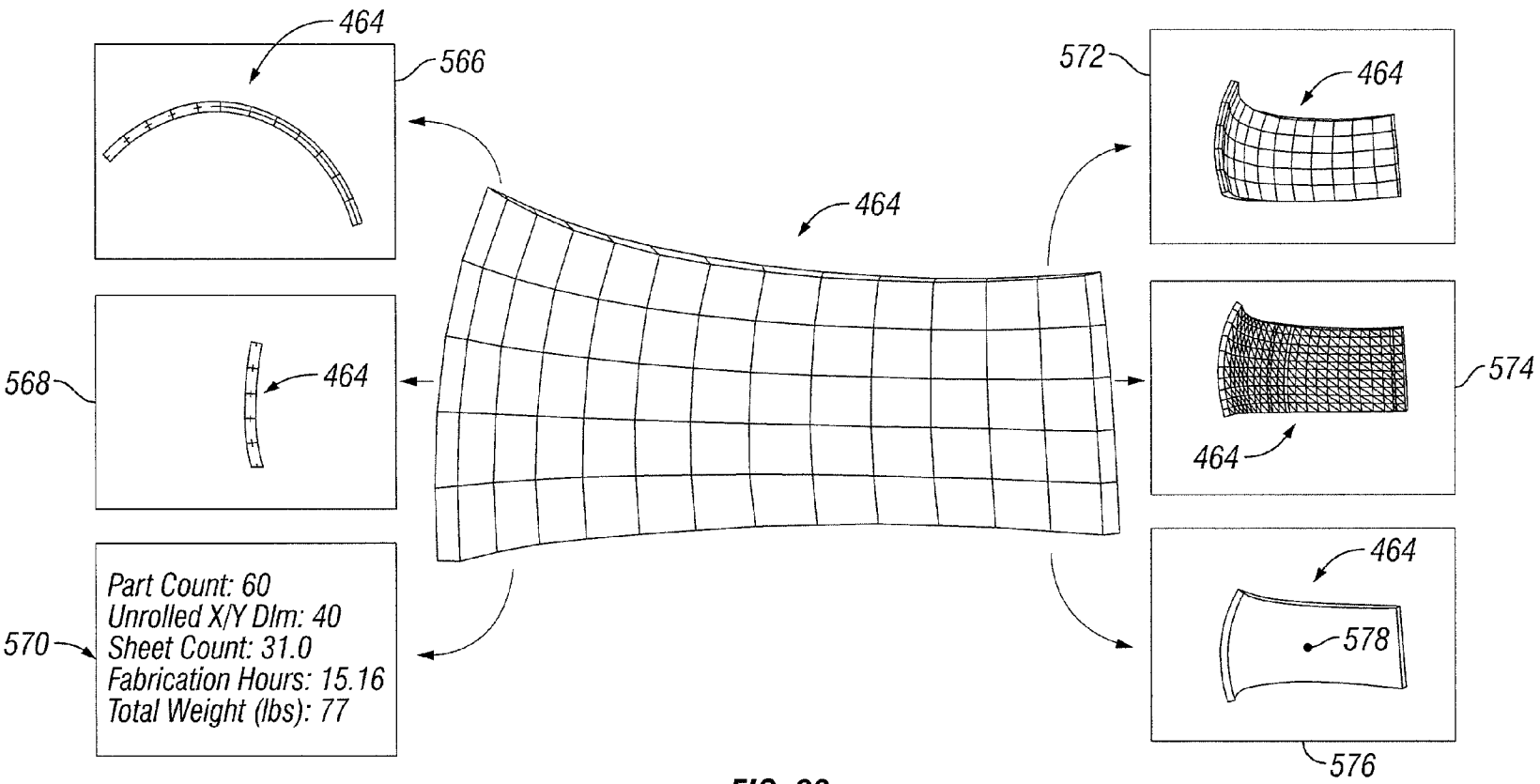
FIG. 23 includes perspective, plan, section detail, project matrix, solid and mesh model, and center of gravity views of the structure of FIGS. 19-22.

Another perspective view of structure 464 along with plan section and detail views of the same, a project matrix analysis, solid and mesh models, and a center of gravity model of structure 464, are shown in FIG. 23. A designer has ability to see these kinds of information in real-time as they modify 464 as previously described. A designer has ability to view structure 464 from different angles, including the plan and section detail views to ensure the structure shape is correct. The project matrix view identified by box 570 calculates useful information, such as part count, unrolled dimensions, sheet count, fabrication hours, and total weight (based on known materials) for use while fabricating structure 464. This information can be used for creating documents, shop drawings, and architectural drawings, for example. Solid model 572 shows the boxed version of structure 464. This solid model can be used to make scaled rapid prototyping models, or be exported for insertion into compatible CAD modeling and information management systems. Mesh model 574 can be exported to a rendering application in order to be rendered to show clients how the final product may look. The center of gravity view 576 which identifies the center of gravity 578 may be useful for structural purposes. It is appreciated that this information may be continually updated as the structure changes.

Figure 24:
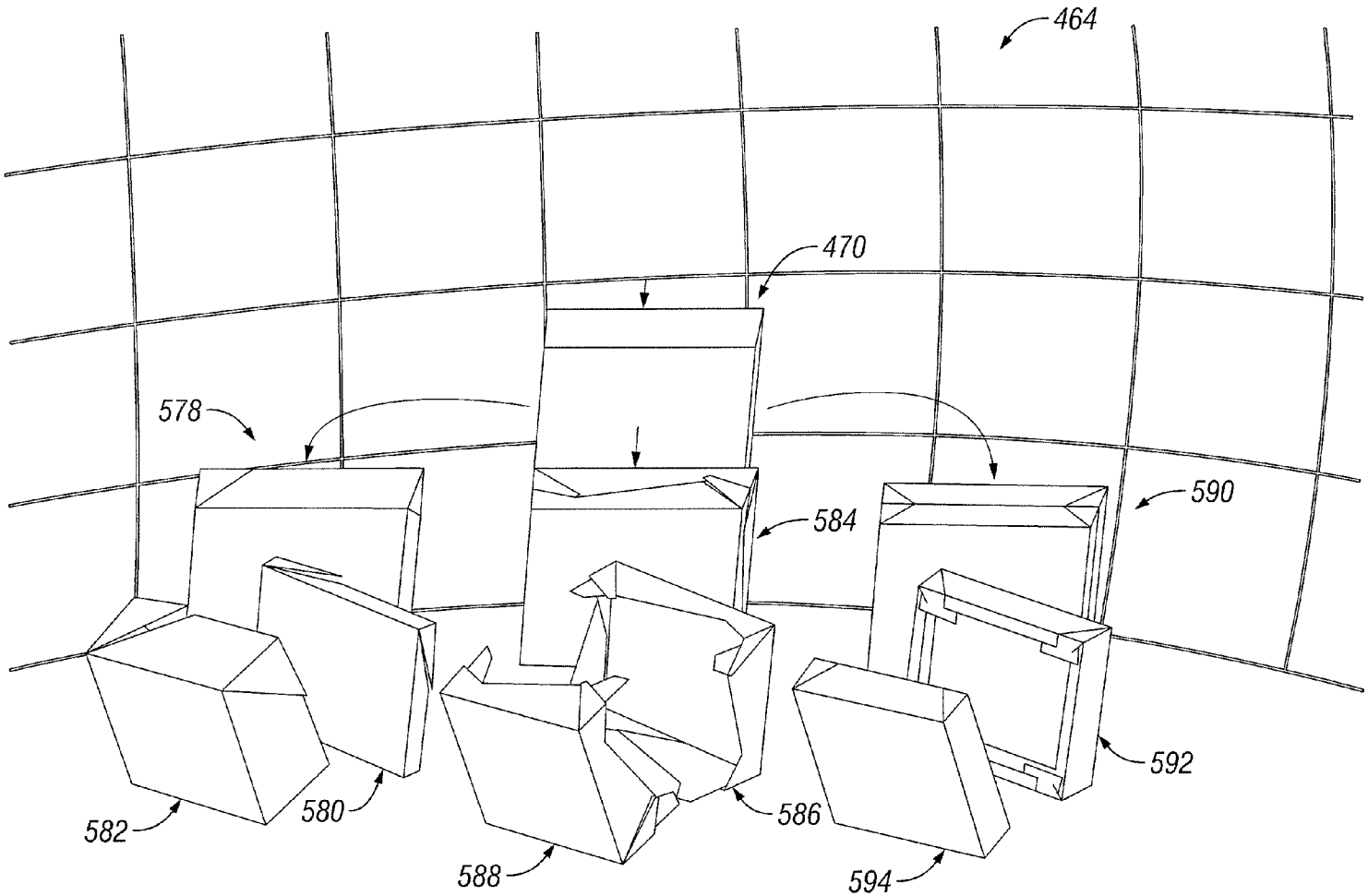
FIG. 24 shows different types of box configurations that can be used on structures such as that of FIGS. 19-23.

FIG. 24 shows box 470 from FIG. 17*a* exploded from structure 464. Additionally, it shows how this box can be specifically constructed in several ways to achieve visual, structural, performance (i.e. internal lighting or acoustical absorption) or other operational goals or specifications. These construction strategies constitute cutting and folding strategies to make three-dimensional boxes from two-dimensional sheet goods. Box 578 is an example of a box construction strategy consisting of front part 582 and rear part 580. The rear part 580 nests inside front part 582 and is connected in several possible ways to create a self-structuring box portion of 464. The resulting rear face of box 578 in recessed (this is unlike box 584 and 590 in this illustration). Box 584 is an example of a box construction strategy comprising front part 588 and rear part 586. The two parts 588 and 685 have "male" tenon members that fit inside the mating box and connect in several possible ways to create a self-structuring box portion of 464. Box 590 is an example of a box construction strategy consisting of front part 594 and rear part 592. The two parts 594 and 592 have "female" flanges that allow the boxes to be connected (in several possible ways such as magnets, glue, etc.) to create a self-structuring portion of structure 464.

Figure 25:
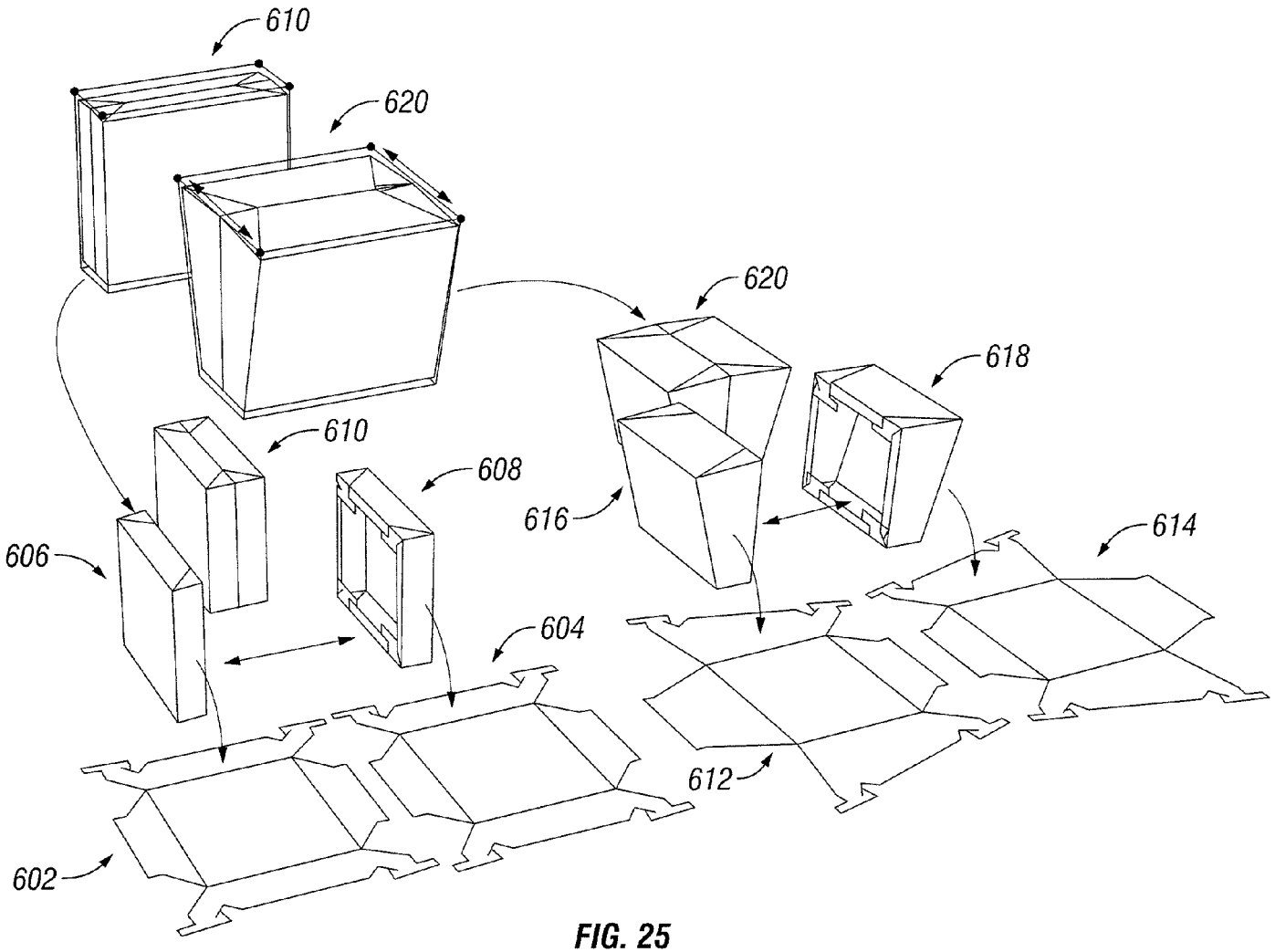
FIG. 25 are various views of folded and unfolded box configurations.

As previously discussed, individual box fold-up strategies are tied proportionally to the box geometry, enabling it to adapt as the boxes' geometries stretch and twist into a particular form, and to adjust for characteristics (including but not limited to thickness) of sheet material the boxes will be made from. Constraints can be applied to the proportions of the geometry to ensure the individual folded boxes will assemble properly and do not exceed either the dimensional yield capacity of the flat sheet goods or the structural (or tailoring) capacity of the folded-up three-dimensional box and overall assembly. FIG. 25 shows wire-frame geometrical extens of two boxes from structure 464. These wire frame geometrical extents represent the outer most boundaries of the boxes, as shown by 506 in FIG. 18. The geometries' of boxes 610 and 620 are derived proportionally smaller from these wire frame extents to account for material characteristics, etc., as described above. In the embodiment shown, unfolded box portions 602 and 604 have been cut and scored so that when folded they form box portions 606 and 608 which are brought together, by means previously discussed, to form box 610. In another example, cut and scored box flats 612 and 614 are folded into box portions identified as 616 and 618. Those portions are then brought together to create box 620. The boxes (like 610 and 620 in structure 464) have geometrical constraints (upper and lower limits for lengths and included angles for example) that govern the allowable final size and shape of the boxes. These constraints are calculated to ensure that what the user is designing can be made to meet minimum acceptable tailoring and structural tolerances. The user may not, for instance, specify a box that is too small to be adequately fabricated to pre-determined quality specifications from the desired flat sheet material.

Figure 26B:
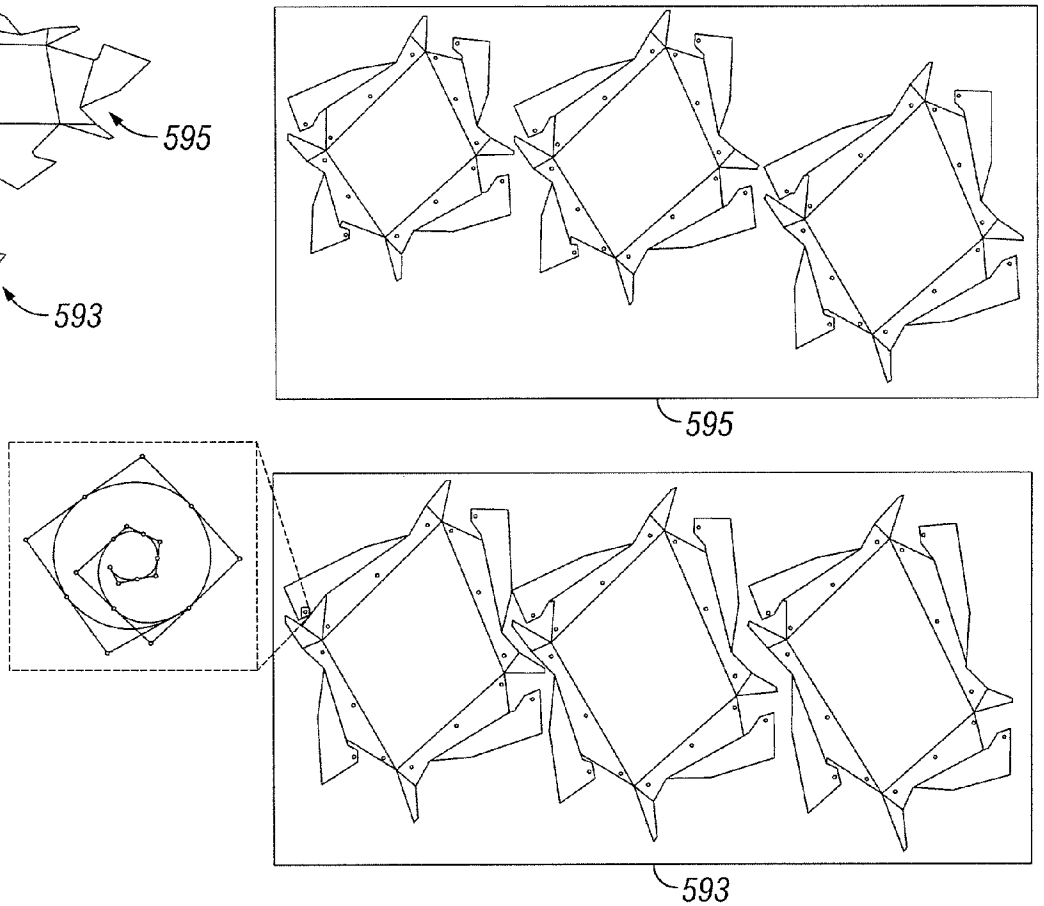
FIG. 26 shows an unfolded box surface pattern that is translated into line work to be cut into a blank and folded into a box.
Figure 26A:
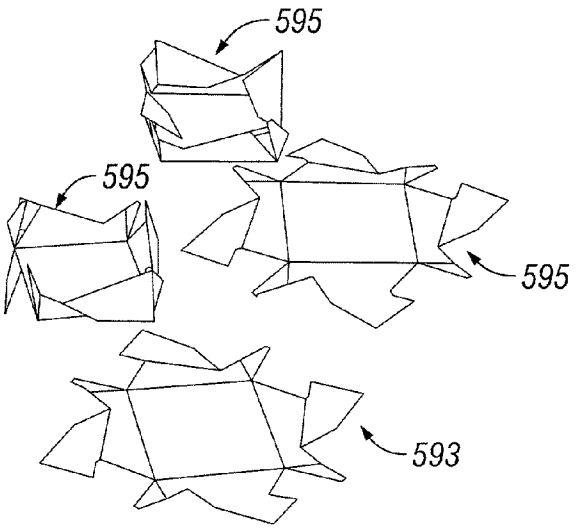

With any box construction fold-up strategy, each box starts as a flat two-dimensional set of line-work that describe all of the outer profile cutting geometries, fold type (by scoring, machining, bending, etc.) and location geometries, as well as connection and alignment geometries (through holes, blind holes, slots, tabs, etc.) that are necessary to manufacture and assemble the unfolded box part from a specified flat sheet material into the final self-structuring box. FIG. 26 shows two box parts unfolded 593 and 595 and their resulting sets of line-work nested onto a flat sheet good that describe the required motions for a fabricating tool. This line-work is converted to machine code and transmitted to a robot (CNC for example) for fabrication.

Figures 27A, 27B, 27C, 27D, 27E, 27F, 27G, 27H, 27I:
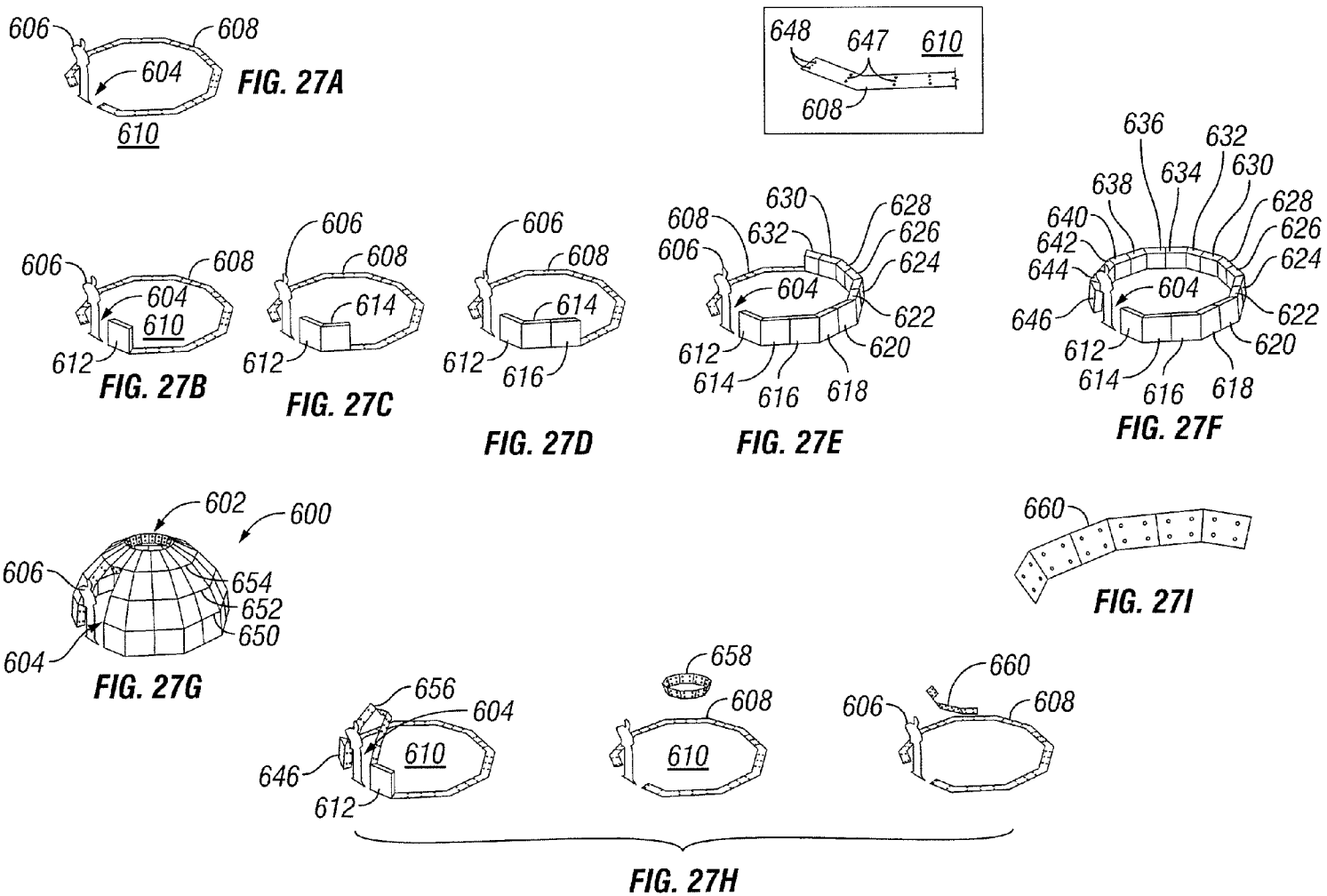
FIGS. 27*a-i* are various views demonstrating how to construct a partially spherical enclosure.

FIGS. 27*a-i* are perspective progression views showing the assembly of a domed structure made according to the techniques discussed herein. A completed dome 600 shown in FIG. 27*g* includes a top opening 602 and entryway 604. An outline of an illustrative person 606 is included to demonstrate scale. For this illustrative embodiment, a base plate 608 is affixed to a ground or floor surface 610 via fasteners as shown in FIG. 27*a*. Base plate 608 may be attached to ground surface 610 via bolts or other fasteners suitable to attach such structures to a ground surface. It is appreciated that base plate 608 can be generated while creating the structure itself using techniques previously discussed. As discussed previously, the exact geometry of the location and orientation of the bottom-most sides of the boxes that comprise the first row of boxes 612-644 is known. In this case, that geometry is used to define the geometry for the profile and corresponding box connection points on base plate 608. The base plate may be fabricated using this geometry in a material and process appropriate for the specific application (i.e., sheet metal, plywood, etc.). It is further appreciated that the materials used to make the base plate can be the same plastic, metal, or paper used for the structure. Once base plate 608 is fixed to ground surface 610, it may serve as a template to begin assembling structure 600. As shown in FIG. 27*b*, first box 612 starts the process by being placed onto plate 608 adjacent entryway 604. A second box 614 is placed on base plate 608 adjacent first box 612. As this view demonstrates, the face plate serves as a sufficient guide, so this first row of boxes is set properly, FIG. 27*d* continues the process by placing box 616 onto base plate 608 adjacent box 614. FIG. 27*e* continues this process by placing boxes 618, 620, 622, 624, 626, 628, 630, and 632 next to each other on base plate 608. Lastly, boxes 632-646 are placed on base plate 608 to complete the bottom row of structure 600. Also shown in this view is a detailed view of base plate 608 that includes affixment 647 to the floor such as bolts or screws. A plurality of magnets 648 attract corresponding magnets on boxes 612-646 connecting the boxes to the base plate just as the boxes having magnets thereon connect to each other, as previously discussed. Repeating this process by stacking additional rows of boxes on top of this first row, as indicated by reference numerals 650, 652, 654, the dome structure 600 is assembled.

Trim may be attached to the periphery or openings (fenestrations) in structure 600 such as a jam 656 located around entryway 604 as shown. Jam 656 may include magnets of the same type as used on the boxes and face plate 608 so that jam 656 couples securely to the boxes. Shown in FIG. 27*h* is a center retaining ring that trims out opening 602 of structure 600. Ring 658, jam 656 and the boxes that form structure 600, may be made of the same plastic, metal, paper, or combination of each and have the same magnets, or other attachment means, as also previously discussed. A header 660 shown in FIG. 27*i* may be used to add additional structure in locations where either tension stresses are calculated to exceed the structural capabilities of the boxes and their connection strategy, and/or in the case of an opening like 604, functions as a header across the top of the opening to support an open span. Either way, the geometry to fabricate and install the additional structural members is drawn from appropriate box geometries. It is appreciated this header may also be made of the same (or different) material and connection means as the boxes and other trim pieces, as well as have the same magnets to attach itself to the boxes.

Another illustrative embodiment of the present disclosure includes a suspended wall divider structure 670, as specifically shown in FIGS. 28*b, e*, and *g*. The view shown in FIG. 28*a* discloses the means to suspend structure 670 off of ground surface 672. An outline of a person 674 is included to show scale. In this view, tension rods 676 extend downward from top mount 678 to a bottom plate 680 which is attached to floor 682. It is appreciated that tension rod 676 may be a rigid metal rod or cable. A base member 682 attaches to each of tension rod 678 illustratively above ground surface 672 and bottom plate 680. Base member 682 is the surface structure 670 sits on to be suspended above ground surface 672. As shown in this view, a box 684 is placed on top of base member 682 to begin assembling structure 670. The view shown in FIG. 28*c* demonstrates how box portions 686 and 688 straddle tension rod 676 and join together to form box 684. The view in FIG. 28*d* shows top side 690 of box portion 688 that includes an illustrative cutout 692 for receiving a portion of tension rod 676. Also shown in this view is magnet 694 that may be used to attach box portions to each other. By assembling the several boxes in a manner similar to that previously discussed, structure 670 can be created as shown in FIG. 28*e*. In that additional embodiment, as indicated in FIG. 28*f*, a top tension plate 696 fits on top surface 698 of structure 670 (see FIG. 28*e*) to compress the boxes which maximizes their strength and resists lateral and compressive loading as an individual unit. To complete this illustrative embodiment, trim panels 700 and 702 are attached to the end of structure 670, as shown. It is appreciated that this attachment may be made by means previously discussed, including magnets.

Figure 29A:
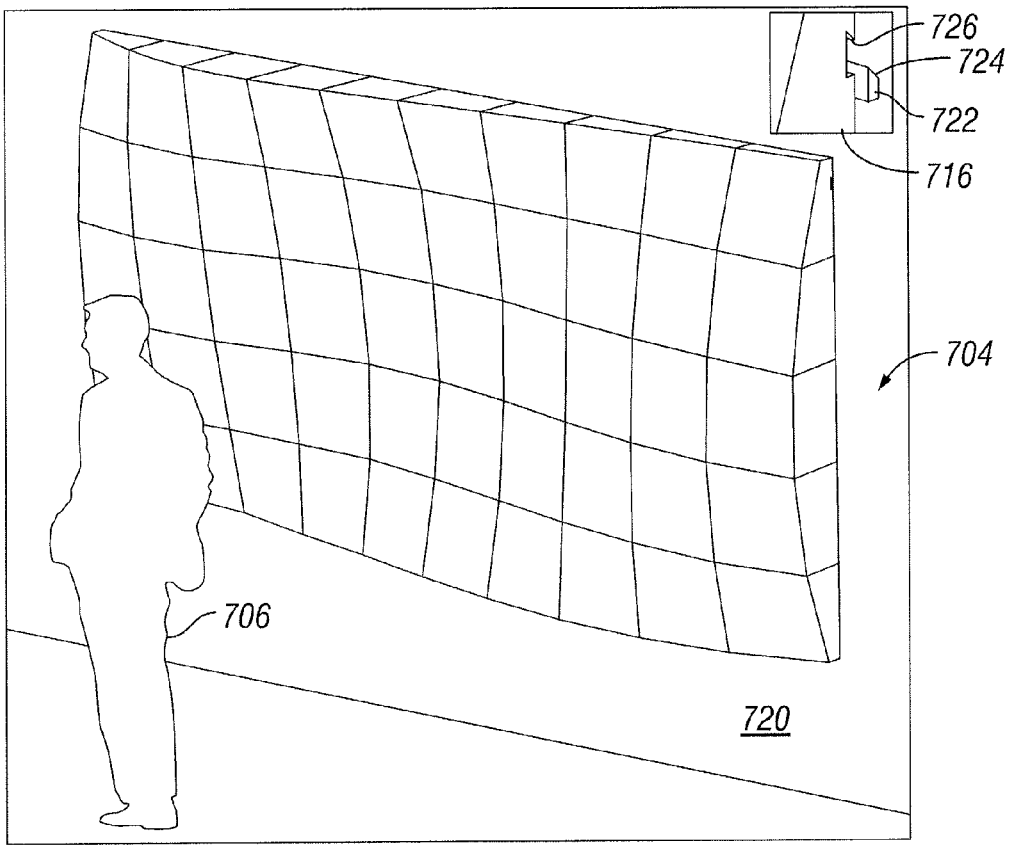
FIGS. 29*a-g* show another illustrative embodiment of a structure attached to a wall.
Figure 29D:
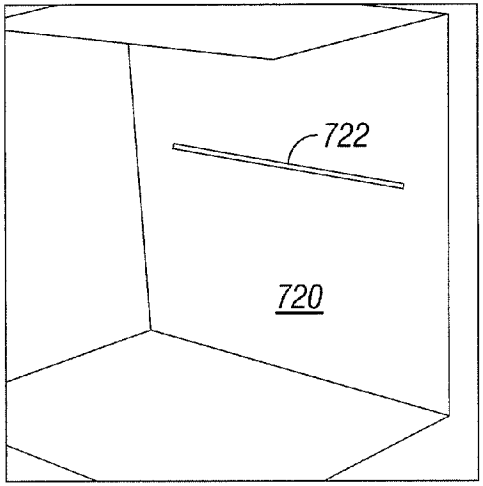
Figure 29C:
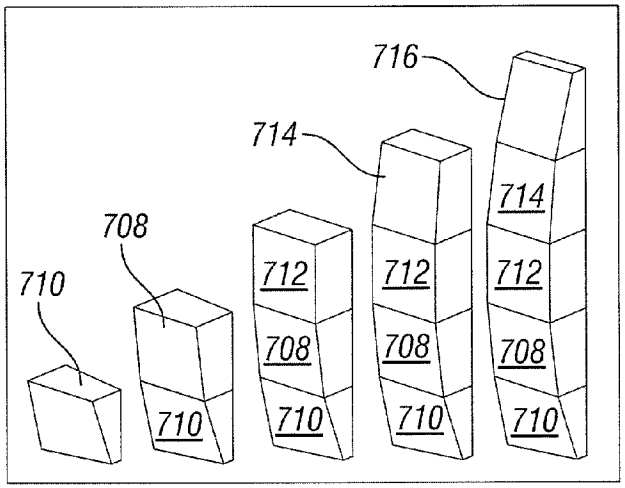
Figure 29B:
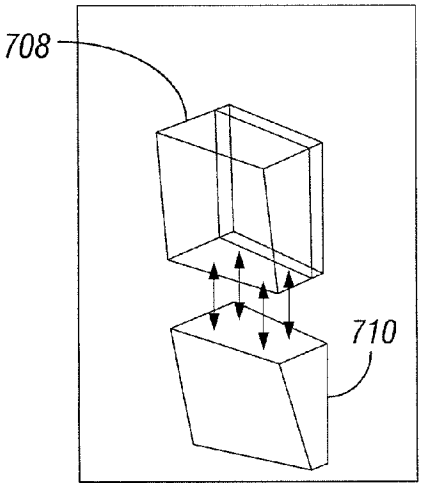
Figure 29G:
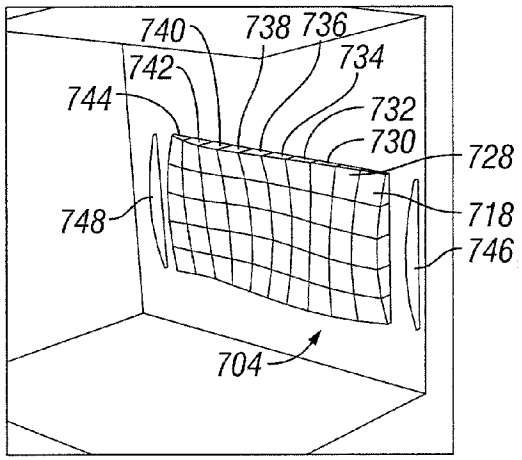
Figure 29F:
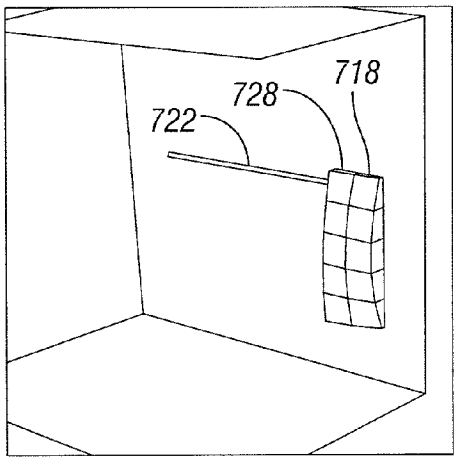
Figure 29E:
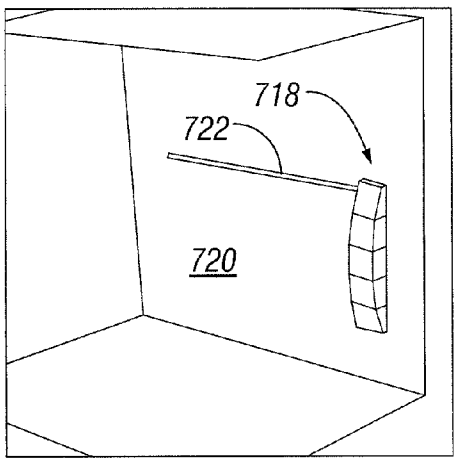

An illustrative embodiment of structure 704 is shown in FIG. 29*a-g*. These views demonstrate how wall mounted structure 704 may be assembled and attached, as shown in FIG. 29*a*. An outline of an illustrative person 706 is included to show scale. As shown in FIG. 29*b*, illustrative boxes 708 and 710 are attached together via magnets or rivets. The progression view in FIG. 29*c* demonstrates how stacking one box on top of another, such as adding boxes 712, 714, and 716 forms a complete column of boxes as indicated by reference numeral 718. This process is repeated until all of the columns are assembled. The view shown in FIG. 29*d* includes wall surface 720 having batten strip 722 attached thereto via an anchor or other fastener, or screw. The detail view in FIG. 29*a* shows the profile of batten strip 722 attached to wall 720. It has an angled face 724 to catch a corresponding notch portion 726 formed illustratively in the top box, such as box 716, of at least a portion of if not all of the columns. Column 718 may also be hung onto batten strip 722, as shown in FIG. 29*e*. Another column 728 is hung onto batten 722 and placed adjacent column 716, as shown in FIG. 29*f*. This process continues with the additional columns 729-744 of structure 704 as shown in FIG. 29*g*. Trim pieces 746 and 748 may be attached to the end of structure 704 by means previously discussed to finish the look of structure 704.

Figure 30A:
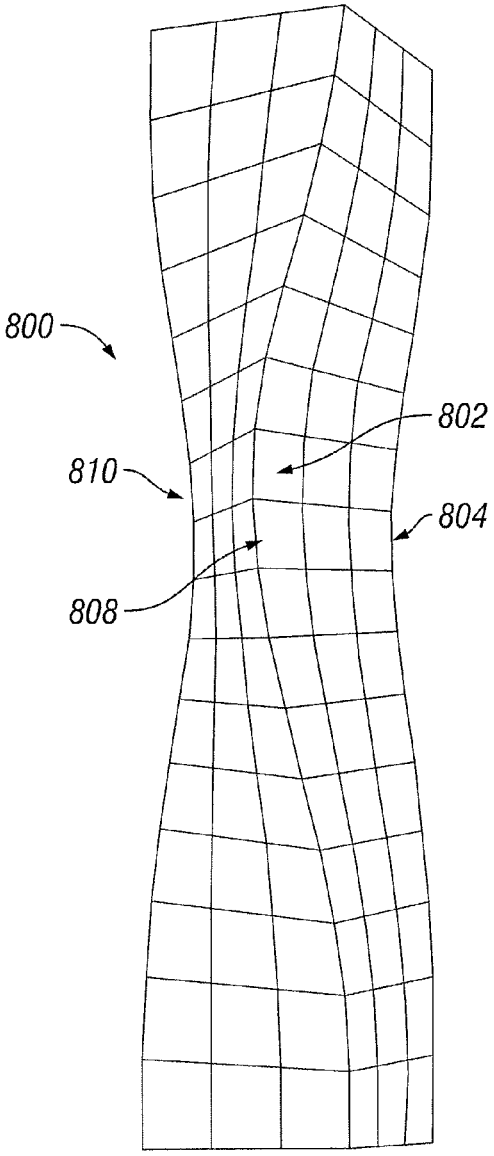
FIGS. 30*a-c* are front, perspective, and top views of a freestanding column structure.
Figure 30B:
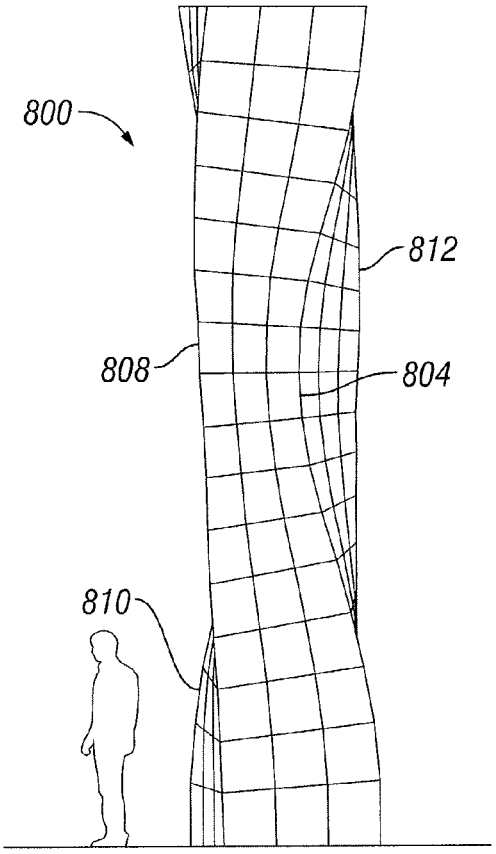
Figure 30C:
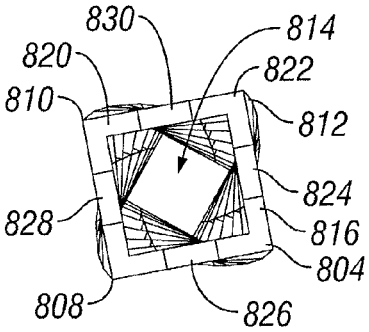

Perspective, front, and top views of freestanding column 800 are shown in the FIGS. 30*a-c*. Column 800 is another complex-curved structure that can be assembled via uniquely sized and shaped boxes by means previously discussed. It is appreciated from these views how column 800 is made from a plurality of different sized boxes, such as box 802, in order to create the multi-curved surfaces 804, 808, 810, and 812. This illustrative embodiment of column 800 is configured to include a center opening 814, as shown in FIG. 18*c*. It is possible that opening 814 may receive a structural beam to support a roof structure or the like. Such beam, however, is not needed to necessarily support column 800. The view of 18*c* also shows an illustrative profile of the box shapes which include a plurality of L-shaped boxes 816, 818, 820, 822, and quad boxes 824, 826, 828, and 830, respectively.

Figure 31A:
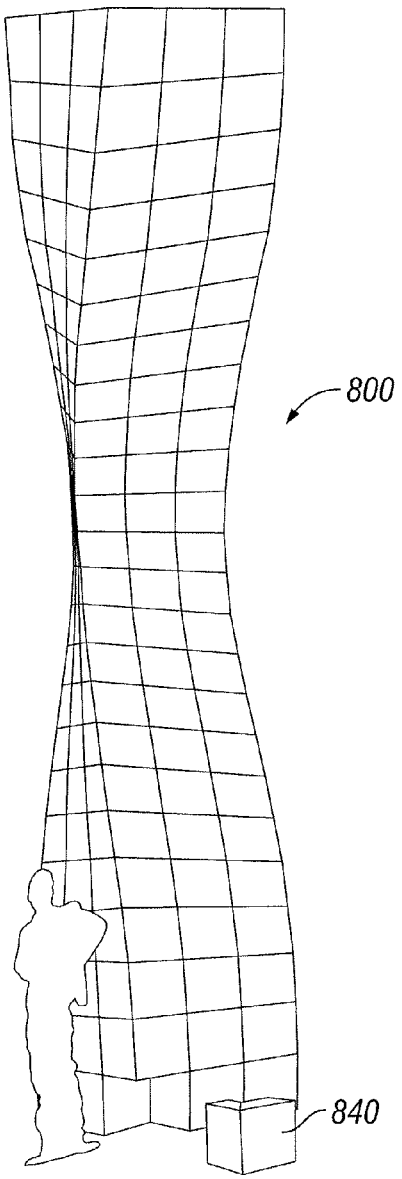
FIGS. 31*a-e* are various views of the column of FIG. 30 along with individual box components in folded and unfolded form.
Figure 31B:
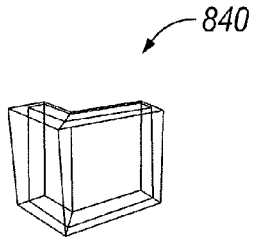
Figure 31C:
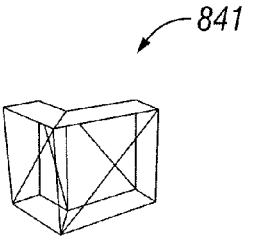
Figure 31D:
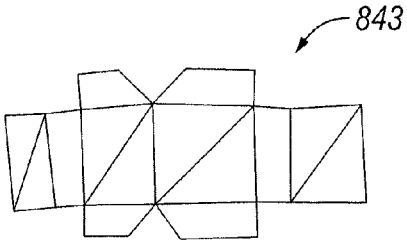
Figure 31E:
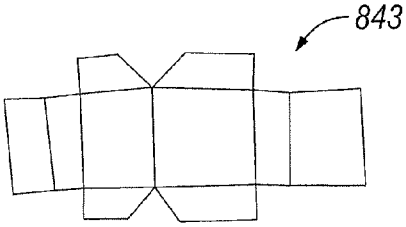

Additional views of column 800 are shown in FIGS. 31*a-e*. FIG. 31*a* shows a single corner box 840 removed from column 800. A perspective view of box 840 is shown in FIG. 31*b*. The L-shaped corner box has two front faces one on each side of the corner. The triangulated panels that make up the digital surface approximation 841 shown in FIG. 31*c* and the digital unfold pattern 843 shown in FIG. 31*d* are a result of the surface approximation method illustrated in FIG. 41. FIG. 31*e* shows the unroll pattern 843 with the soft folds, also described in FIG. 41, removed.

Figure 32B:
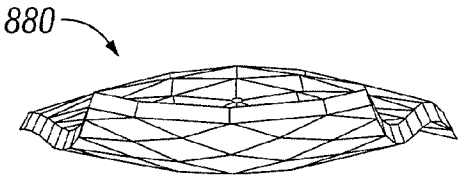
FIGS. 32*a-d* are perspective, front, side, and top views of a diamond ceiling structure.
Figure 32D:
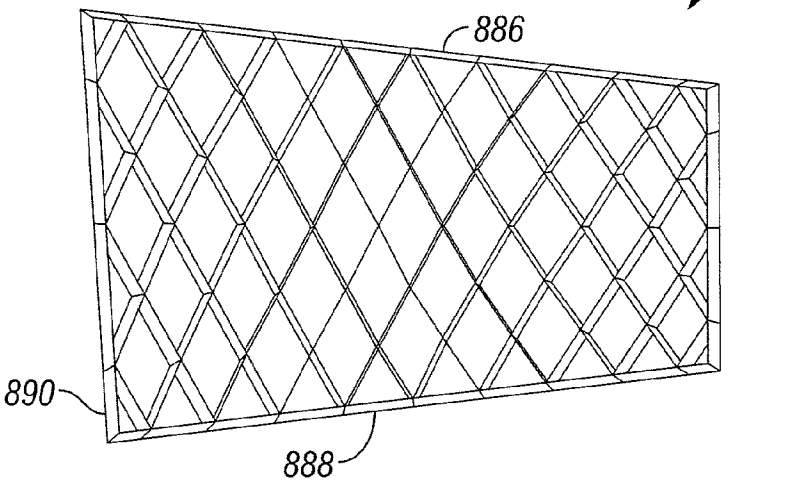
Figure 32A:
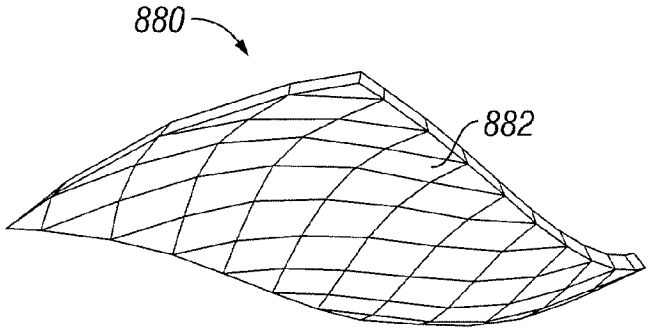
Figure 32C:
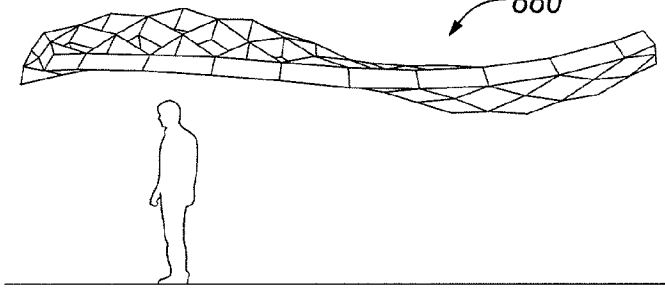
Figure 33A:
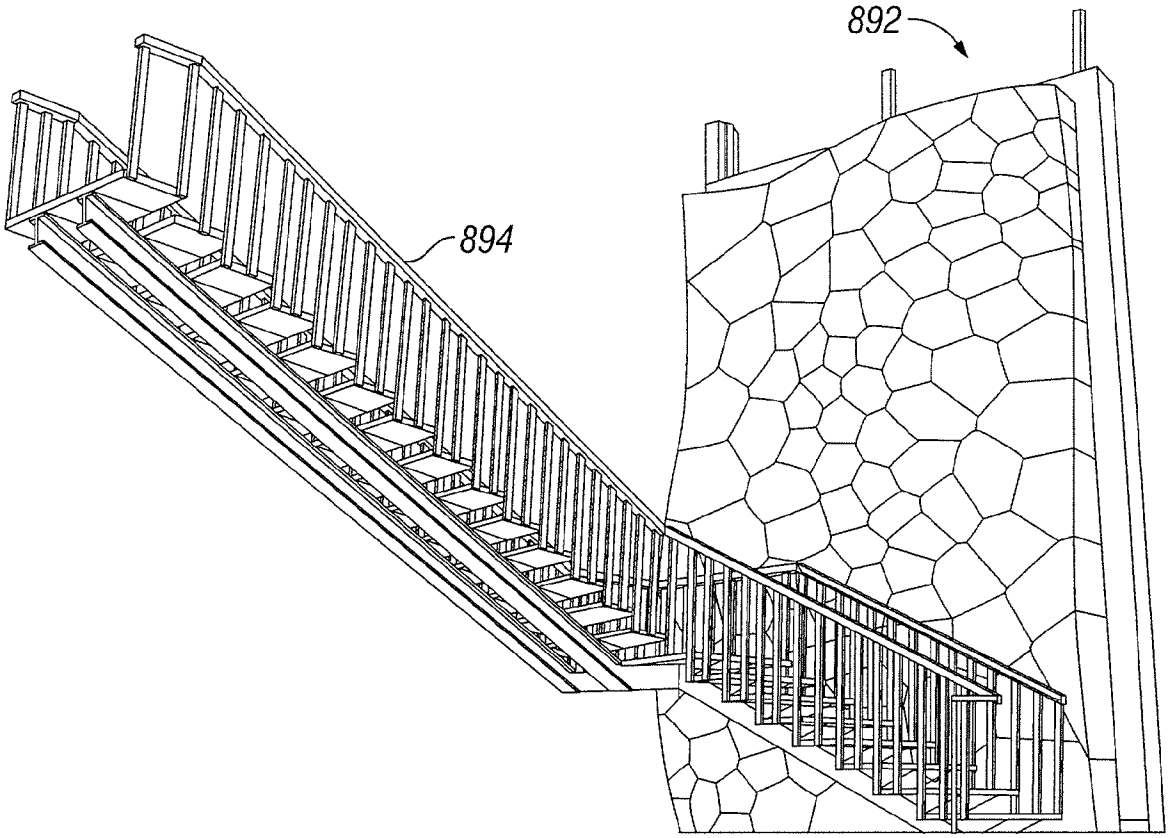
FIGS. 33*a-d* are perspective, front, side, and top views of a voronoi wall fixed to a wall surface.
Figure 33C:
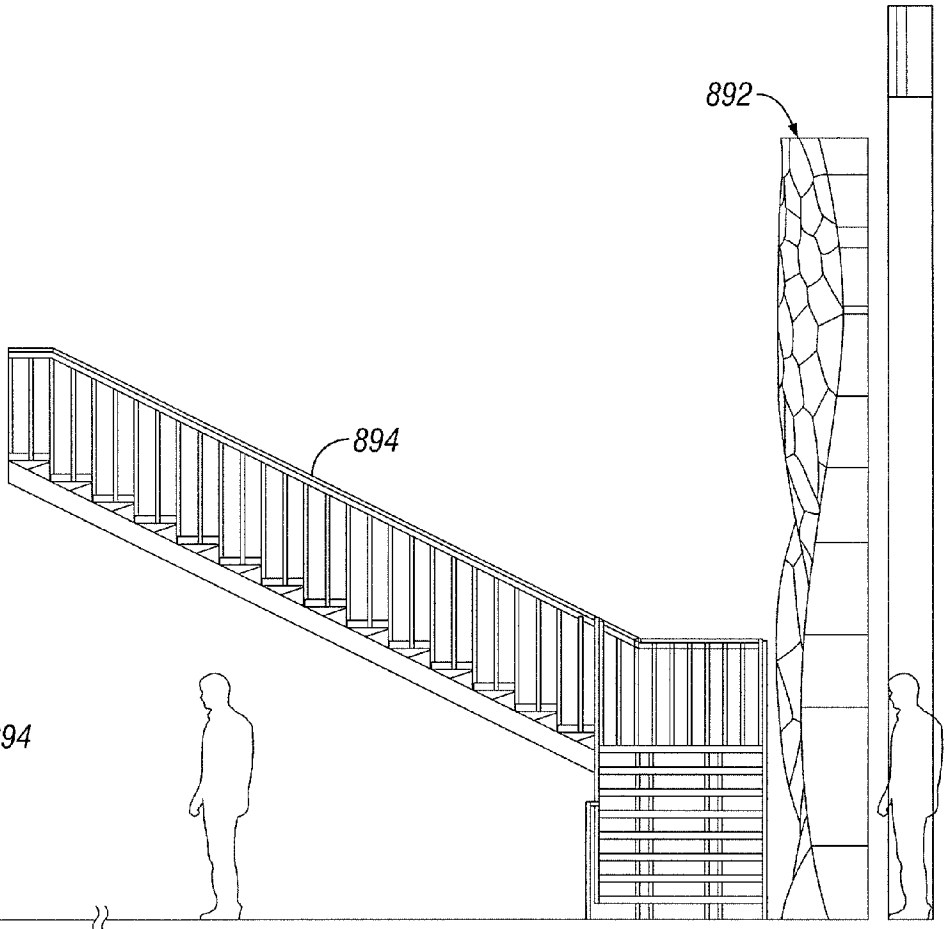
Figure 33B:
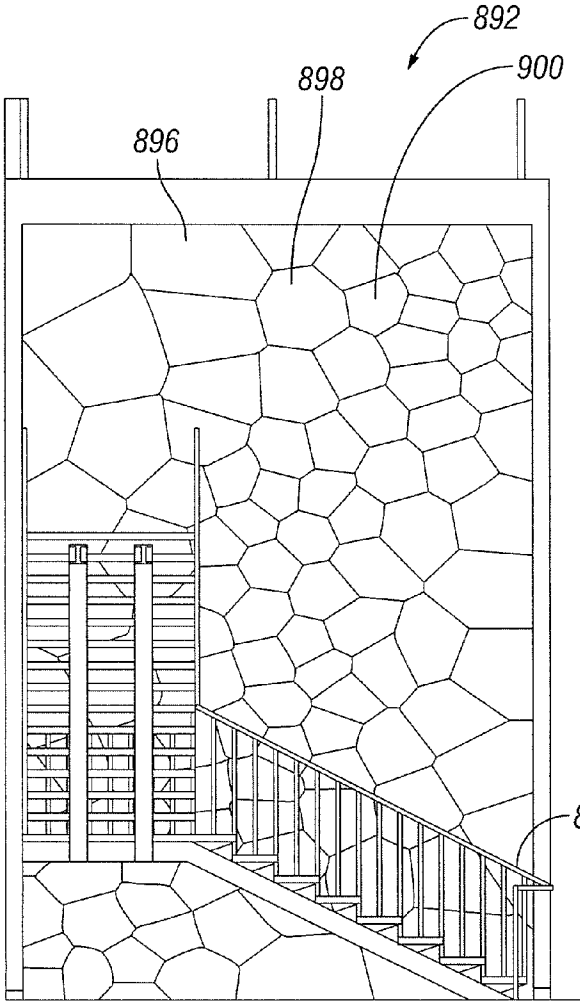
Figure 33D:
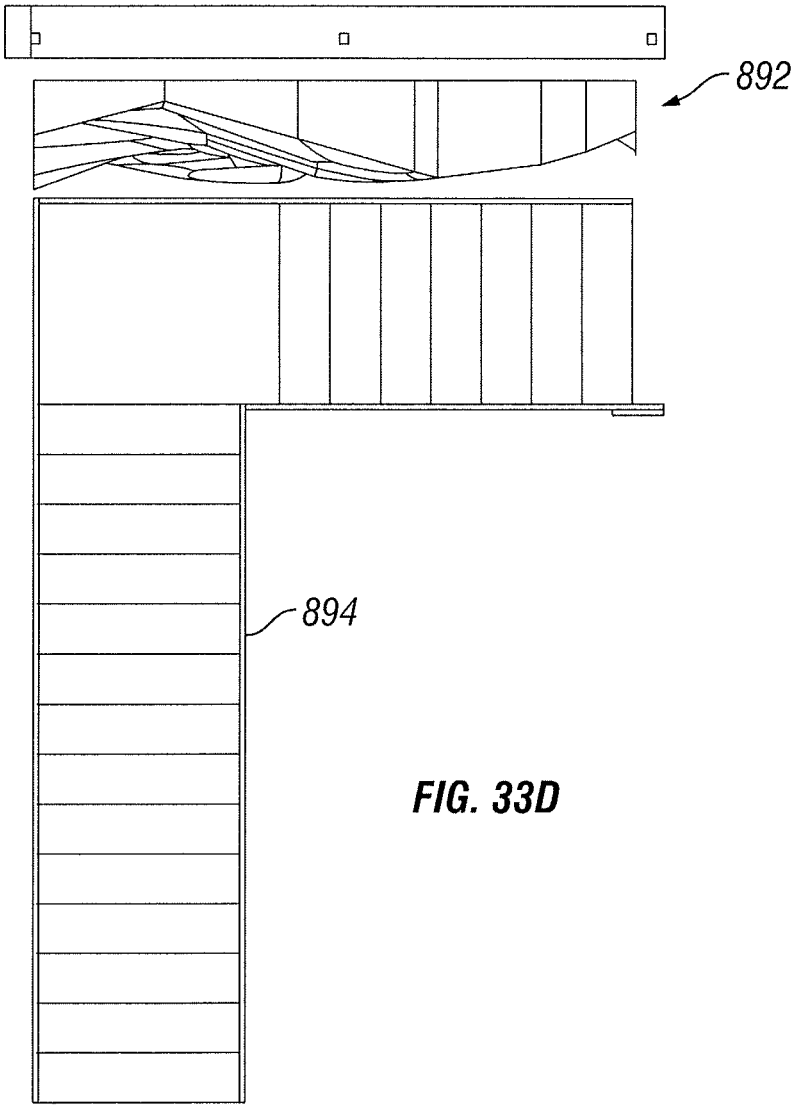
Figure 34B:
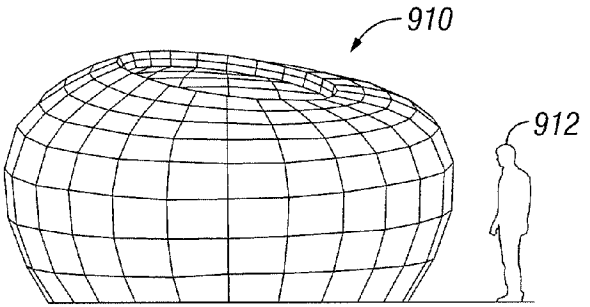
FIGS. 34*a-d* are perspective, front, side, and top views of a freestanding dome structure.
Figure 34D:
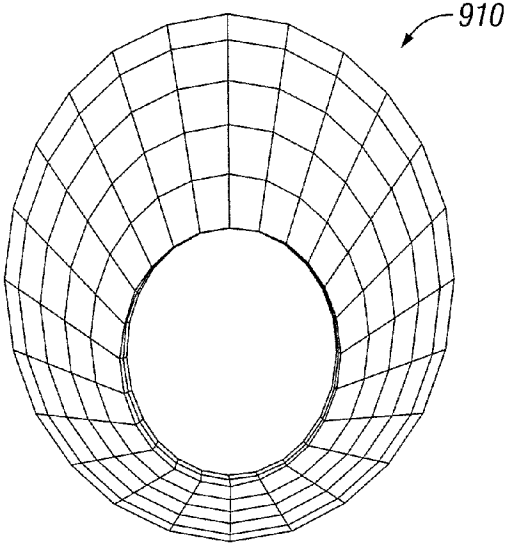
Figure 34A:
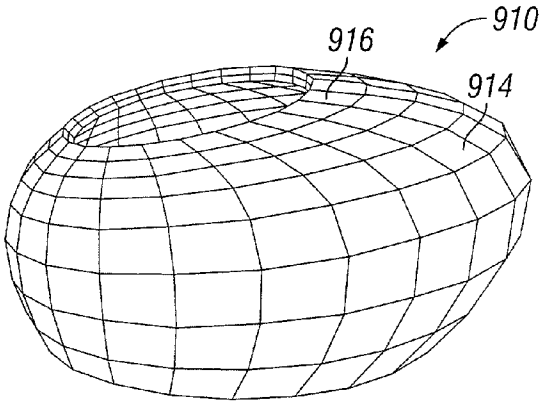
Figure 34C:
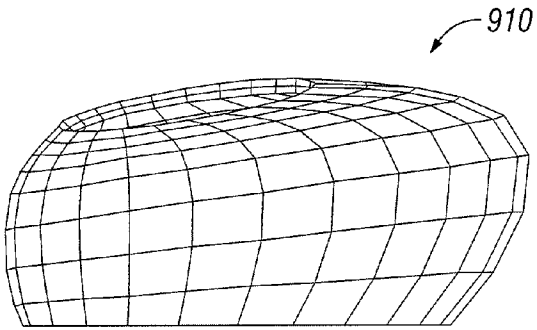
Figure 35B:
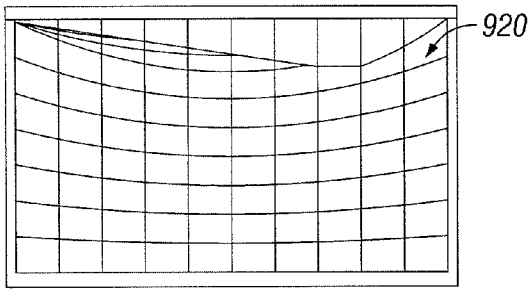
FIGS. 35*a-d* are perspective, front, side, and top views of a framed wall to ceiling transition structure.
Figure 35D:
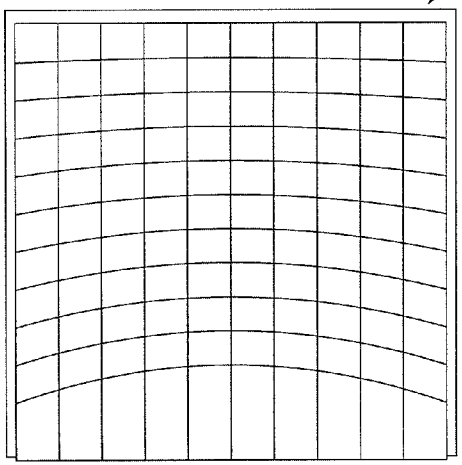
Figure 35A:
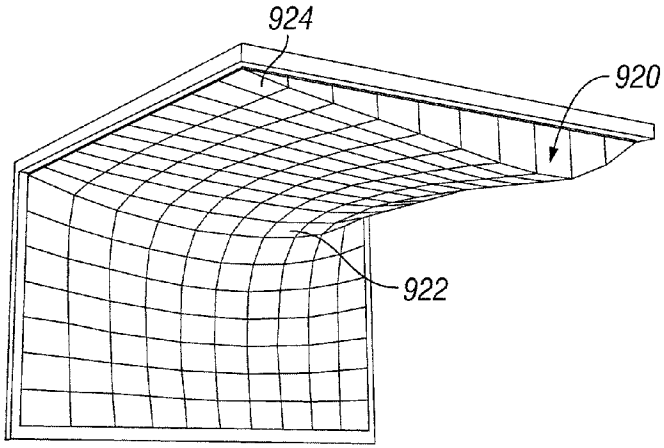
Figure 35C:
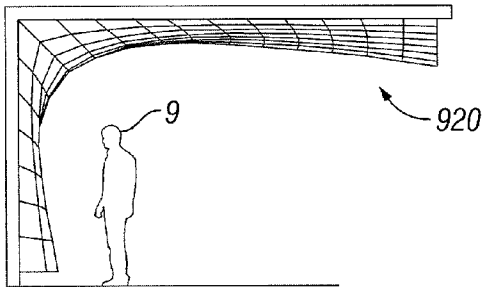

Another illustrative embodiment of the present disclosure includes a diamond ceiling structure 880 as shown in FIGS. 32*a-d*. The perspective view shown in FIG. 32*a* depicts a plurality of open-backed boxes that form the multi-curved structure. Boxes, such as box 882, are generally diamond shaped, include a face and four sides, but as shown in FIGS. 32*b-d*, does not include a back panel. This can make the overall structure lighter while still offering the flexibility in complex curve design, like other structures discussed herein. And just like the other embodiments, these diamond shaped open back boxes are individually sized in order to create the complex curves. It is further appreciated that some of the boxes may have three sides, such as those on the end, like boxes 884, 886, 888, and 890, for example. This is a result of the box orientation particular to the diamond pattern applied to the base surface. Illustratively, the box construction is similar to that of the prior embodiments and the structure assembled in a similar way.

Various views of an illustrative embodiment of a voronoi wall adjacent a standard wall is shown in FIGS. 33*a-d*. The voronoi wall 892 shown in FIG. 33*a* may serve as a decorative architectural feature, in this case located adjacent a stairway. The characteristics of this wall include the irregular shapes of the boxes. Despite their irregular shape, they can be constructed by means further disclosed herein (see, e.g., FIG. 60). It is appreciated from the views particularly seen in FIGS. 33*c* and *d* that it is not only the multiple curves that can add uniqueness to the structure but the varied box shapes as well. In this case, box 896 for example, is shaped substantially different than adjacent box 898 or even box 900.

Perspective, front, side, and top views of a freestanding dome structure 910 are shown in FIGS. 34*a-d*. An outline of an illustrative person 912 is located adjacent the views of dome 910 in FIGS. 34*b* and *c* to show scale. These views demonstrate another structure that can be made from uniquely sized boxes, such as box 914 and 916. Because the boxes are configured to match a particular contour, rather than the contour being limited by single-sized box construction, such complex structures as shown herein, can be assembled. It is appreciated that the boxes that make up structure 910 are stacked and attached to each other via magnets or other fasteners such as those discussed herein.

A wall to ceiling transition structure 920 is shown in FIGS. 35*a-d*. Structure 920 demonstrates yet another illustrative embodiment of the present disclosure that can be made from uniquely sized boxes, such as box 922 and 924 positioned in a predetermined order to form the structure shown herein. The outline of an illustrative person 926 is included in FIG. 35*c* to show illustrative scale.

Figure 36B:
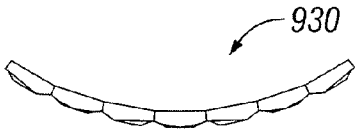
FIGS. 36*a-d* are perspective, front, side, and top views of a suspended cuspy ceiling.
Figure 36D:
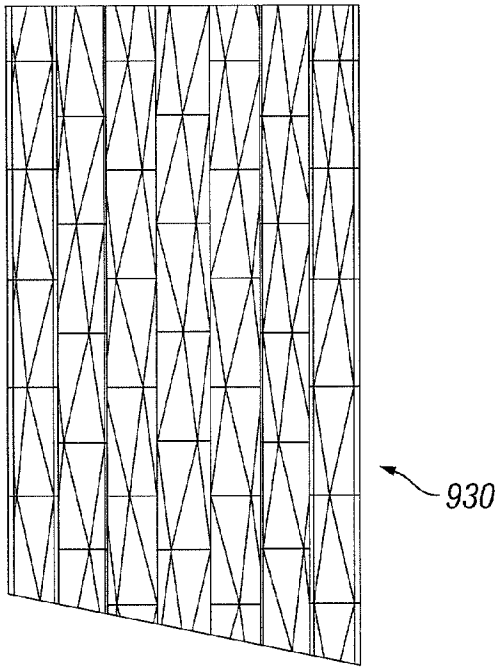
Figure 36A:
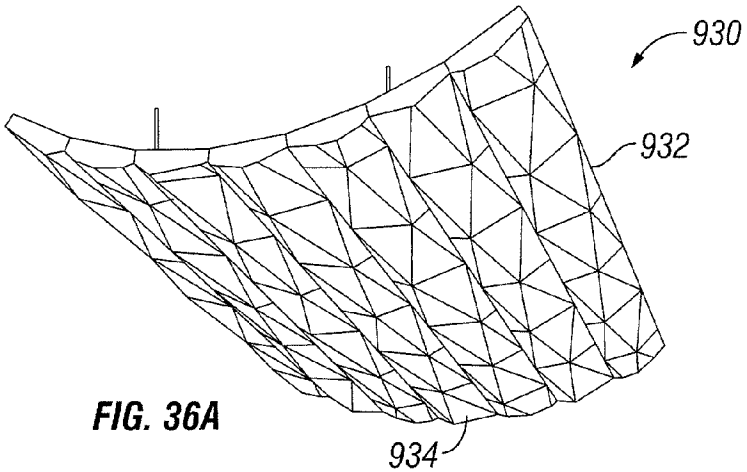
Figure 36C:
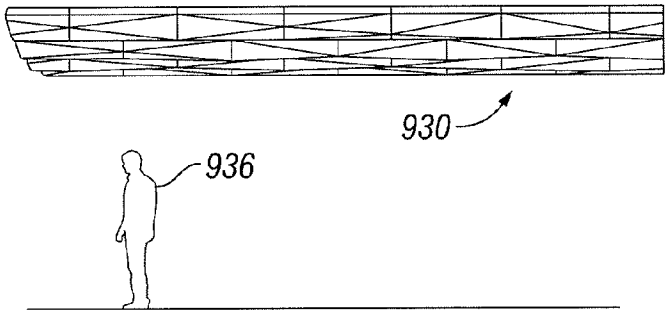
Figure 37C:
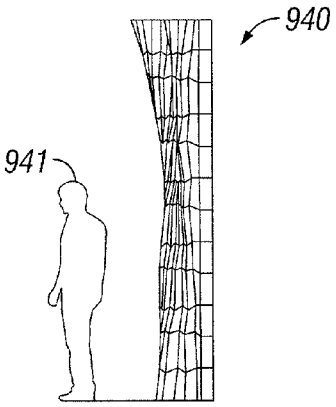
FIGS. 37*a-d* are perspective, front, side, and top views of a variable quad wall affixed to a conventional wall.
Figure 37A:
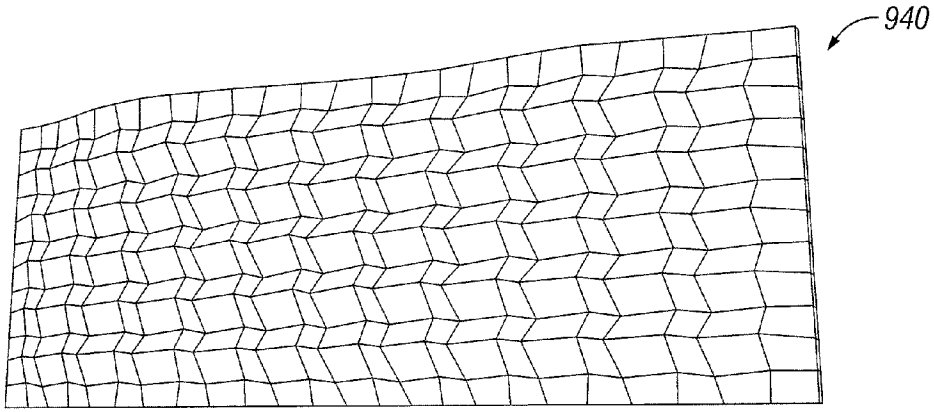
Figure 37D:
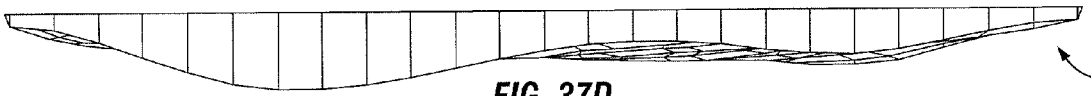
Figure 37B:
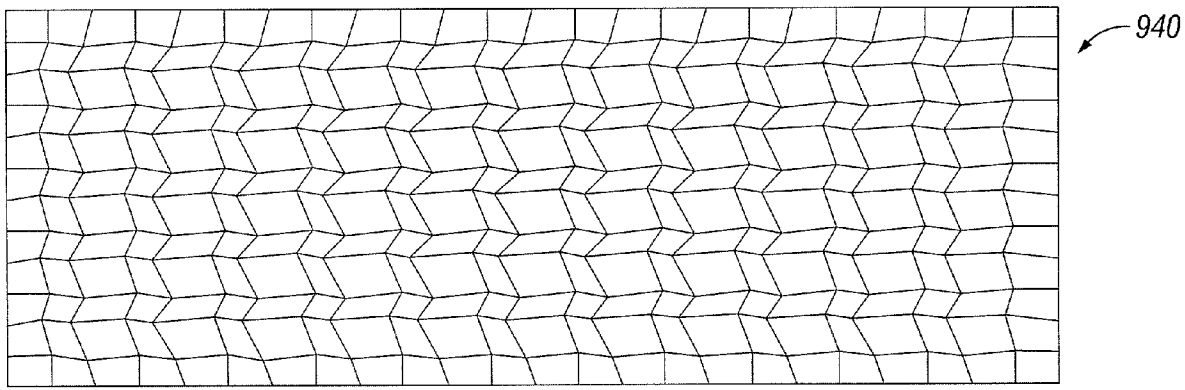
Figure 38B:
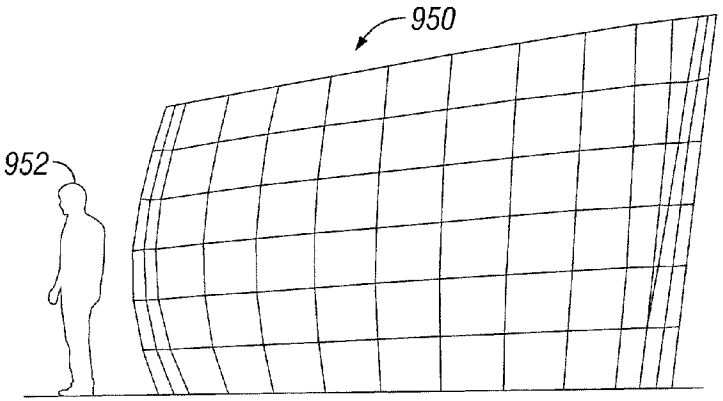
FIGS. 38*a-d* are perspective, front, side, and top views of a freestanding multi-curved wall.
Figure 38D:
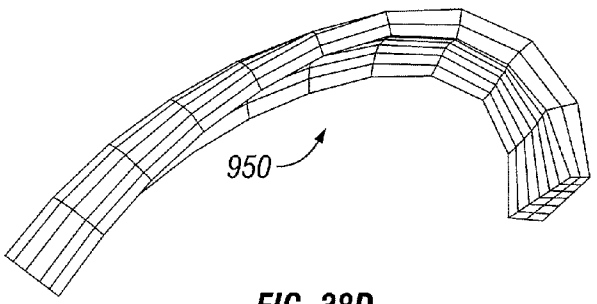
Figure 38A:
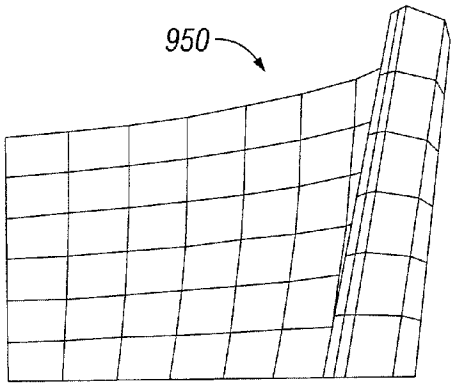
Figure 38C:
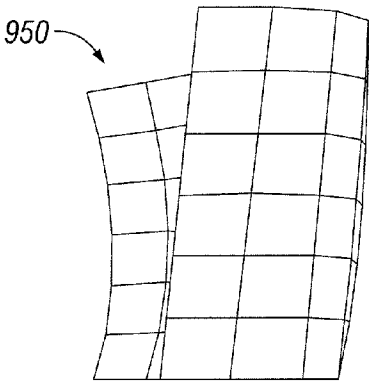
Figure 39B:
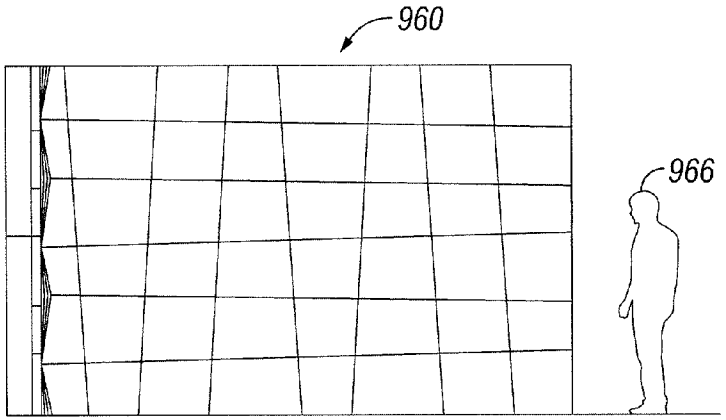
FIGS. 39*a-d* are perspective, front, side, and top views of a pleated freestanding wall.
Figure 39D:
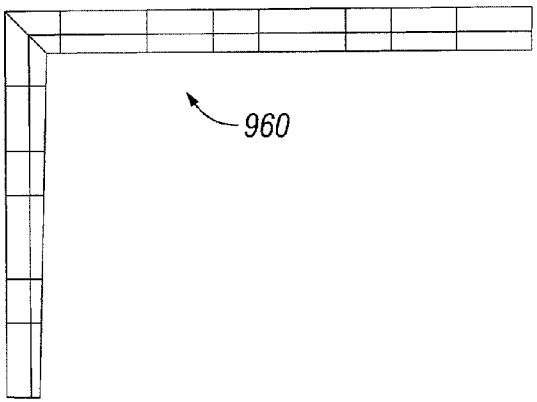
Figure 39A:
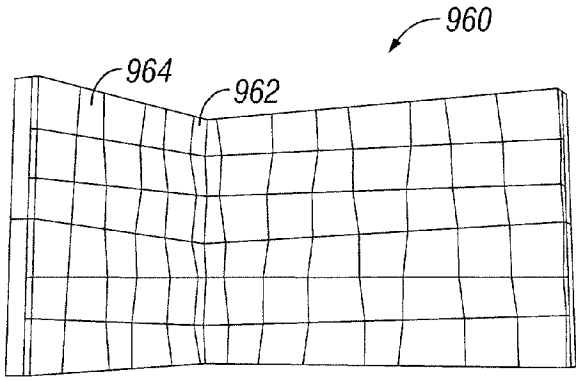
Figure 39C:
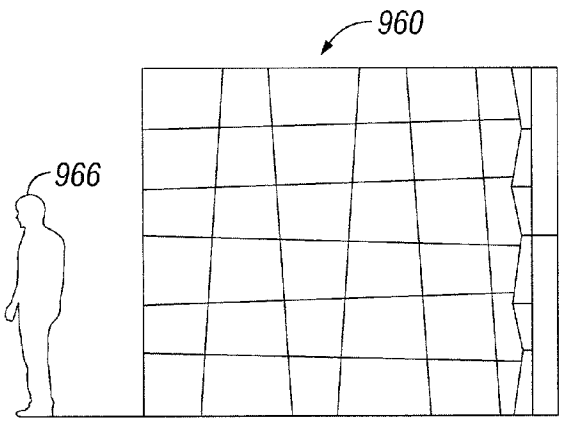
Figure 40A:
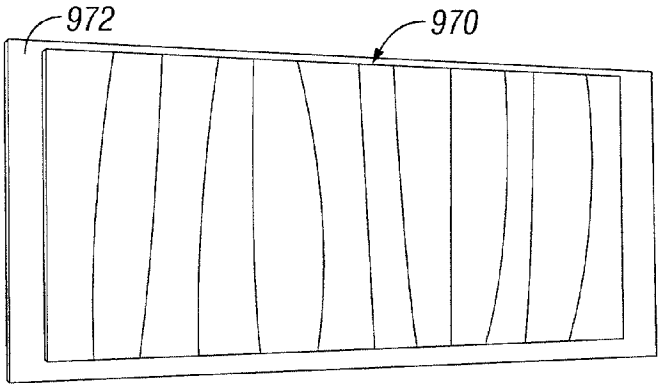
FIGS. 40*a-d* are perspective, front, side, and top views of a rolled box wall fastened to another wall.
Figure 40B:
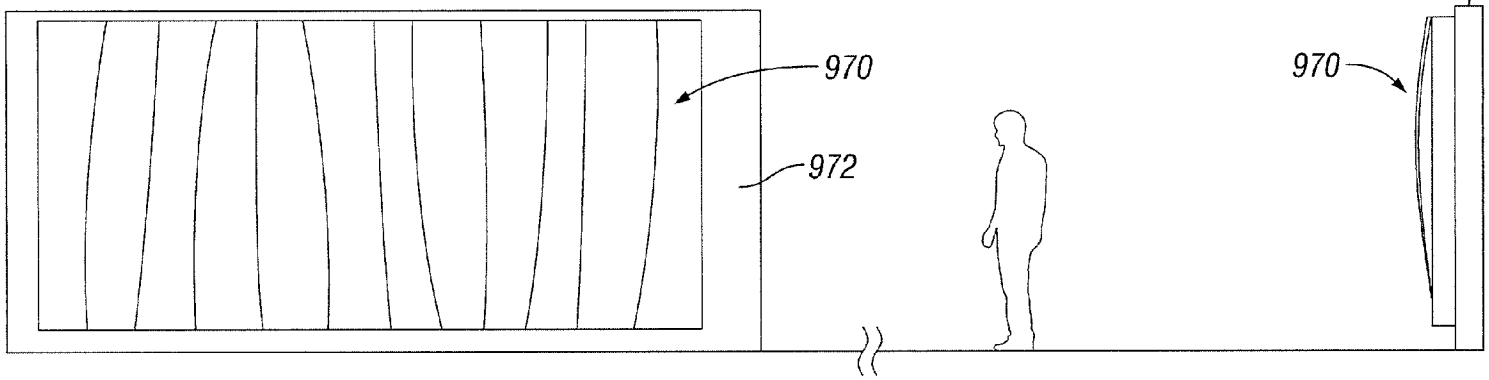
Figure 40C:
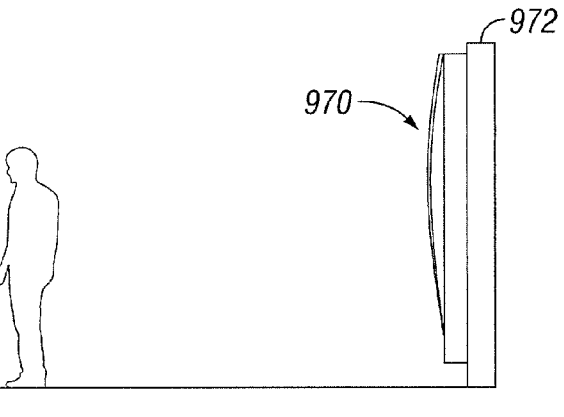
Figure 40D:
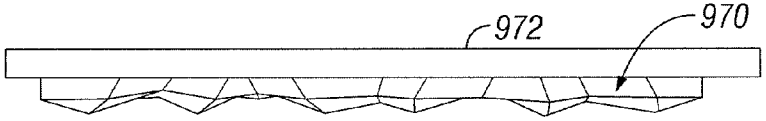

Perspective, front, side, and top views of a suspended ceiling with cuspy shaped boxes 930 are shown in FIGS. 36*a-c*. In this illustrative embodiment, these boxes have a generally rectangular footprint, but their faces have multi-paneled facets, such as is the case with boxes 932 and 934. The sides of the boxes that connect one another via magnets, bullets, etc., are uniquely sized and abut each other edge-to-edge the same as prior embodiments, but the face of each box from this embodiment has a plurality of facets to add additional dimension and uniqueness to surface of structure 930. An outline of an illustrative person 936 is shown for scale.

Another illustrative embodiment includes perspective front, side, and top views of a variable quad wall, as shown in FIGS. 37*a-d*. An outline of an illustrative person 941 is located adjacent wall 940 in FIG. 37*c* to show scale. Quad wall 940, like the other embodiments, includes connectable sides that are assembled in particular order. In this case, however, the faces have continuously variable skewed four-sided geometry to create the pattern as shown. In addition, side walls of the boxes are variably angled to further assist in creating the multiple curves as shown. Edge-to-edge alignment of the boxes is still achieved, however.

Perspective, front, side, and top views of structure 950 are shown in FIGS. 38*a-d*. This structure can serve well as a partition or a product display. The outline of an illustrative person 952 is added to show scale. Curve wall 950 is similar to embodiments previously discussed.

Another illustrative embodiment of the present disclosure includes a pleated freestanding side wall 960 as shown in FIGS. 39*a-d*. This design, like the others, may employ the concept of the uniquely shaped boxes, such as boxes 962 and 964 to make the pleated pattern surface. The outline of a person 966 is shown for scale. This installation illustrates an inside corner condition within an installation and subtly skewed seams between boxes for aesthetics.

Another illustrative embodiment of the present disclosure includes a ruled box wall 970 attached to a standard wall 972, as shown in the perspective, front, side, and top views of FIGS. 40*a-d*. In this illustrative embodiment, the boxes run like columns the entire width of the structure to give a particular architectural affect which is appreciated by comparing FIG. 40*b* with FIG. 40*d*. Again, because each box is individually shaped, the structure surface can be almost anything to create a unique design or surface pattern. The technique used to build the ruled boxes used in this example is illustrated in FIG. 51.

One of the mechanisms employed to better approximate these uniquely shaped boxes to the particular curved base surface is to have the face of the box twist to some degree. The views shown in FIGS. 41*a-k* demonstrate how this may be done. Illustratively, base surface 1000 is translated into structure 1002, both shown in FIG. 41*a*. Each box, such as box 1004 is uniquely shaped to best approximate base surface 1000 using techniques previously discussed. In doing so, instead of every box having a flat face when assembled, some boxes will be calculated to have a twisted face, as also shown in FIGS. 41*b* and *c*. As demonstrated in FIG. 41*b*, box 1004 has one of its four corners raised a distance. The same is the case with respect to box 1004 in FIG. 41*c*, as indicated by distance 1006. It is appreciated that these boxes may be fabricated from materials that can be twisted without permanently affecting their resiliency or memory. The twist for a particular face is digitally approximated by breaking the twisted surface down into triangular facets that are inherently flat, shown in FIG. 41*d-g*. These triangular flat faces are digitally unrolled into a blank (see FIG. 41*f*). The diagonal edges triangulating each face are eliminated in the blank before cutting, as illustrated in FIG. 41*g*. The resulting blank's boundary is cut out of a flexible flat material and the remaining interior edges are bent, scored, heat formed or partially routed, removing the material memory and enabling it to bend sharply as a living hinge. The resulting blank may be twisted precisely into the original box shape, with sharp creases along the relieved edges and soft twisted along the removed diagonal edges. The orientation of the diagonal edges that are digitally added for surface approximation affect the accuracy of the approximation. FIG. 41*i* illustrates how the triangular panels approximate the twisted face by highlighting sections planes along each diagonal. At the center of the face the triangulated panels will be slightly higher or lower than the twisted face. FIGS. 41*j* and *k* illustrate how the distance between the twisted face and the triangular panel approximation can vary dramatically depending on which direction the surface is triangulated. The triangular panels in FIG. j are much closer to the initial twisted surface resulting in a more accurate approximation. This difference can also be a manipulated visual effect if primarily convex or concave boxes are desirable. The view of the blank version of box 1004 shown in FIG. 41*f* also shows the hard fold lines to create the box. If blank 1004 is made of a relatively soft material, like cellular plastic, hard fold lines are routed, v-cut, creased, etc., as described above. In contrast, if these boxes are made of sheet metal, a folding tool is used to form the hard edge folds, as shown in FIG. 41*g*. It is appreciated that when using a cellular plastic the box can be unfolded and laid flat while the hard fold lines 1020 cannot be unfolded.

Figure 42:
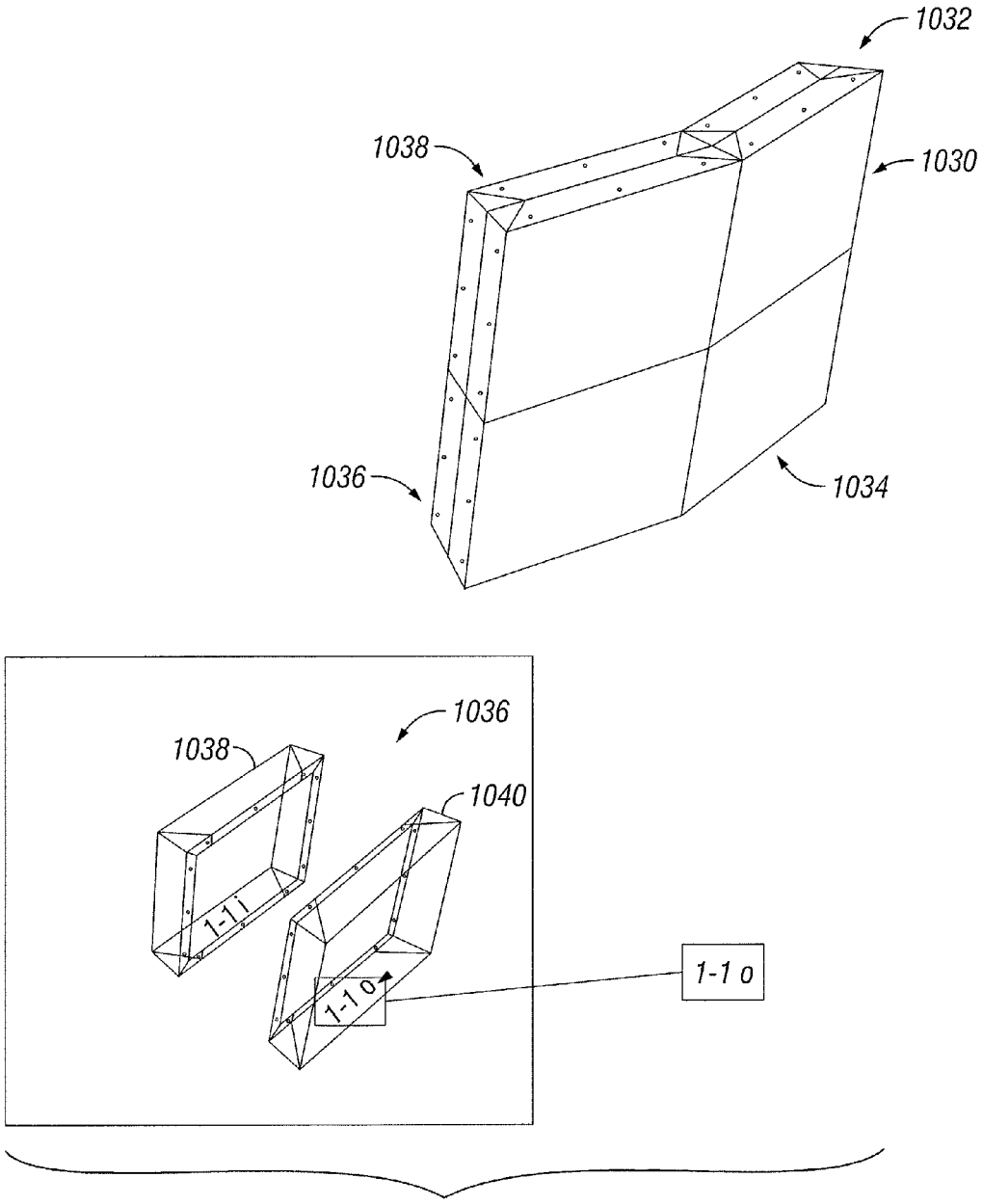
FIG. 42 includes views of a portion of a structure and individual box portions to demonstrate a method of labeling the box portions to indicate number, orientation, and location of that box with respect to other boxes.

FIG. 42 shows a structure 1030 that is made up of boxes 1032, 1034, 1036, and 1038. As previously discussed, it is necessary to know where each box portion and ultimately each box is positioned in relation to the other boxes in order to assemble the structure. In this example, box 1036 is shown split up into separate box portions 1038 and 1040. Each box has indicia on it to identify its location vis-á-vis the entire structure. For example, box 1038 includes the indicia "1-1*i*." This means this box is to be positioned in row 1, column 1, and is part of the inner hemisphere. In contrast, box portion 1040 includes the indicia "1-1*o*" which indicates row 1, column 1, but part of the outer hemisphere. Therefore, box portions that form a box will have the same column and row numbers, but one will have an "i" or an "o." This convention works for the other boxes as well. For example, box 1034 will have indicia "1-2" with each box portion having either an "i" or "o." Box 1038 will be labeled "2-1" with either an "i" or "o" on either box portion. Box 1032 will be labeled "2-2" again with the "i" or "o" depending on the box portion.

Figure 43B:
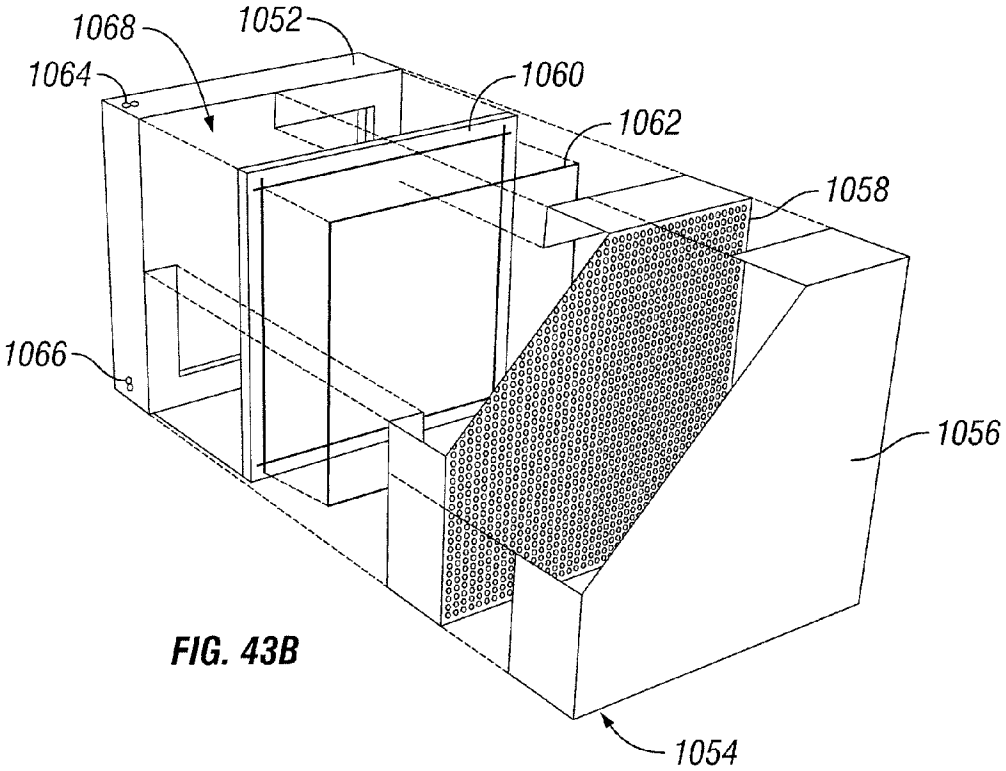
FIGS. 43*a* and *b* are perspective partical cutaway and exploded views of box portions that demonstrate how acoustics and lighting can be incorporated therein.
Figure 43A:
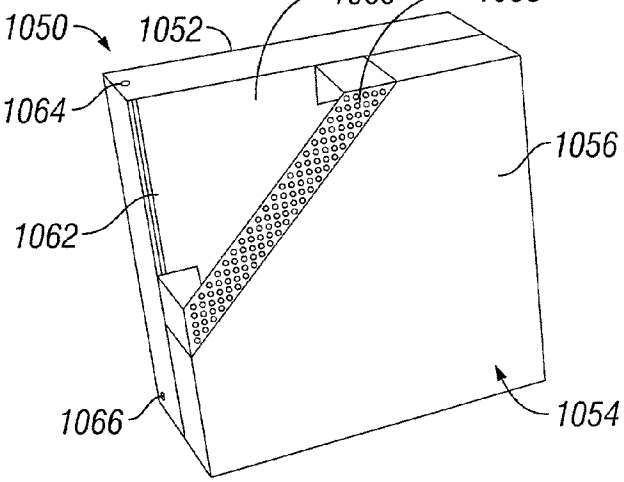

Partial cutaway-perspective and exploded perspective views of box 1050 are shown in FIGS. 43*a* and *b*. Box 1050 is made up of box portions 1052 and 1054. These views demonstrate how the empty space inside each of the boxes can be used for a myriad of functions, in addition to being components of a structure. In this case, the boxes are designed to have integrated, acoustical, and lighting properties. It is appreciated that such boxes may have either acoustical or lighting properties, in an alternative to having both. As shown in FIG. 43*a*, the exterior of box 1050 can be of a design similar to conventional boxes already discussed herein. Box portion 1054 may include a fabric-wrapped skin 1056 over a perforated rigid housing 1058. An acoustic panel 1060 may be positioned between the two box portions 1052 and 1054 and may include integrated lighting 1062 on the periphery of acoustic panel 1060. Openings 1064 and 1066 are available to run wires to power the lighting, speakers, or any other similar device that requires wiring.

An exploded view of box 1050 shown in FIG. 43*b* further depicts how acoustic and lighting boxes are constructed. In this case, acoustic fabric 1056 is fitted over top of the perforated box face. It is appreciated that the holes in the panel can vary depending on the particular acoustical need. These holes allow sound waves to pass through and absorb in acoustic panel 1060. In this illustrative embodiment, an integrated lighting strip, such as a LED lighting strip 1062 is positioned adjacent the periphery of acoustic panel 1060. It is appreciated that this type of light as well as its positioning is illustrative only. Upon examining this disclosure, one skilled in the art will understand that other lighting configurations may be employed with these boxes. The acoustic panel is illustratively fastened to box portion 1052 to receive and absorb the sound waves. Box portion 1052 also includes a hollow cavity 1068 configured to receive wires or other components that are to be hidden behind acoustic panel 1060. The openings 1064 and 1066 are available to run wires into cavity 1068.

Figure 44B:
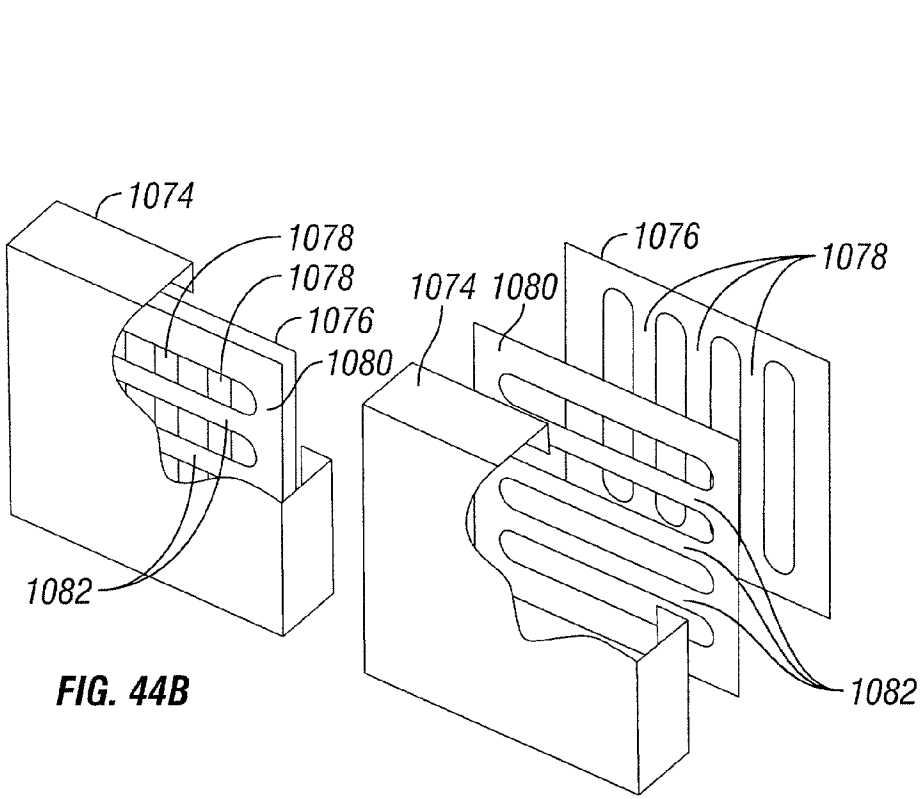
FIG. 44 includes perspective and partial cutaway views of a box portion with lens layers inserted therein for visual lensing affect.
Figure 44A:
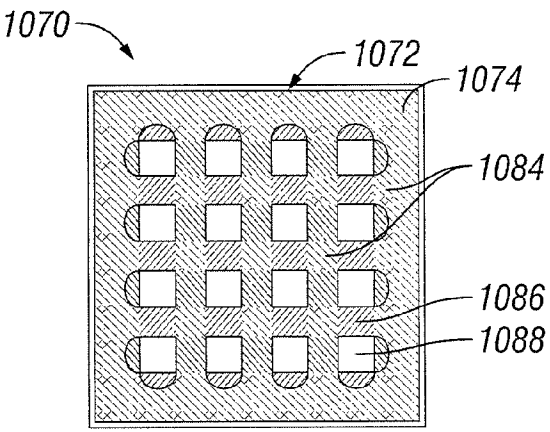

Front and perspective partial-cutaway views of another illustrative embodiment of a box 1070 are shown in FIGS. 44*a* and *d*. Box 1070 demonstrates how the boxes can be used to create a variety of shadow patterns. In this case, box 1070 includes an outer box 1072 which is illustratively a translucent plastic, at least on its front face 1074. A plurality of darker translucent layers can be placed inside so that when light from a fixture or ambient light passes through the box, a particular shadow affect is created. As shown in the perspective views of FIG. 44*b*, box 1070 has a translucent or transparent face 1074. A first panel 1076 having styles 1078 can be placed adjacent a second panel 1080 having rails 1082. This creates a weave-like effect with dark regions 1084 at locations where styles 1078 and rails 1082 overlap. Shadow areas 1086 are located where portions of either panel 1076 or 1080 do not overlap. And then light regions 1088 are located where neither panel 1076 or 1080 are located.

Figure 45:
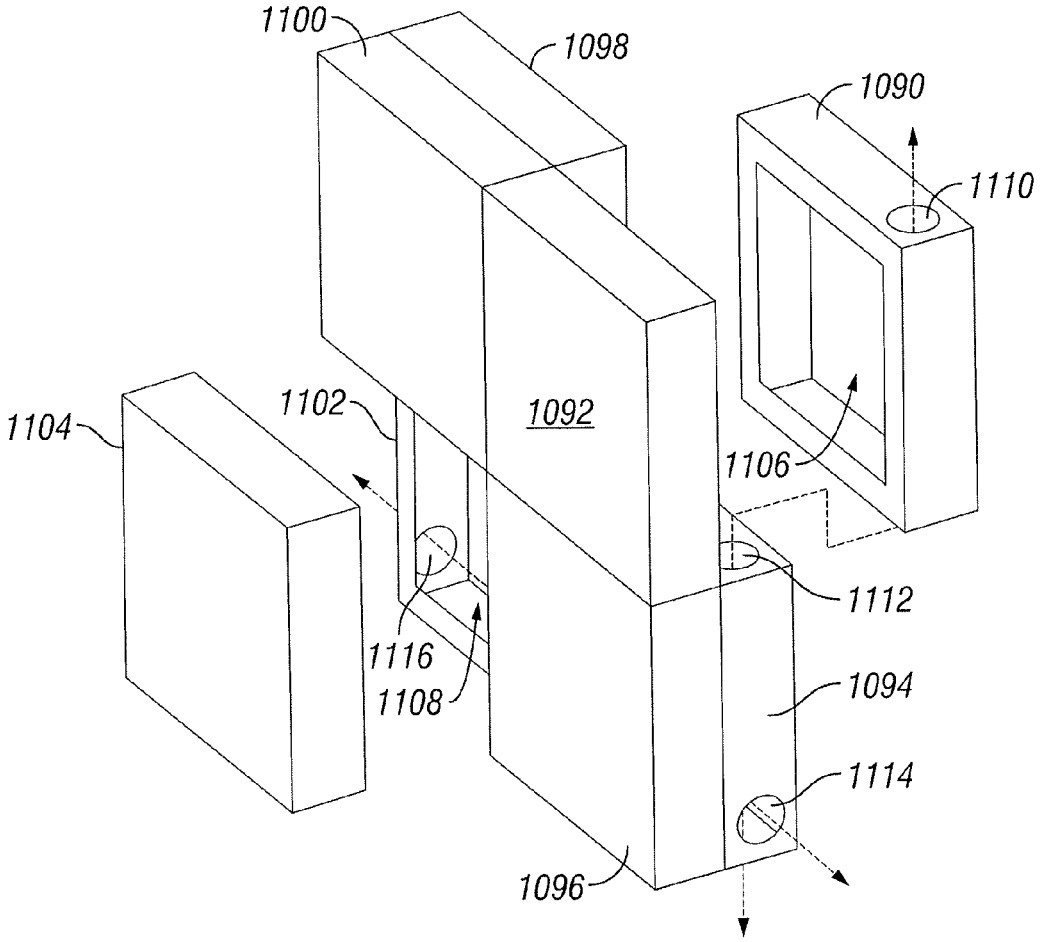
FIG. 45 is a partially exploded view of stacked box portions to demonstrate raceways for lights, power, data wiring, and ventilation.

A partially exploded view of stacked portions 1090, 1092, 1094, 1096, 1098, 1100, 1102, and 1104 are shown in FIG. 45. These boxes include cavities 1106 and 1108 and box portions 1090 and 1102, respectively. Openings 1110, 1112, 1114, and 1116 run light, power/data cabling, air ventilation, or other kind of in-wall type services. This configuration provides the opportunity and flexibility of running utilities behind the wall surface, just like those available to conventional studded drywall walls.

Figure 46B:
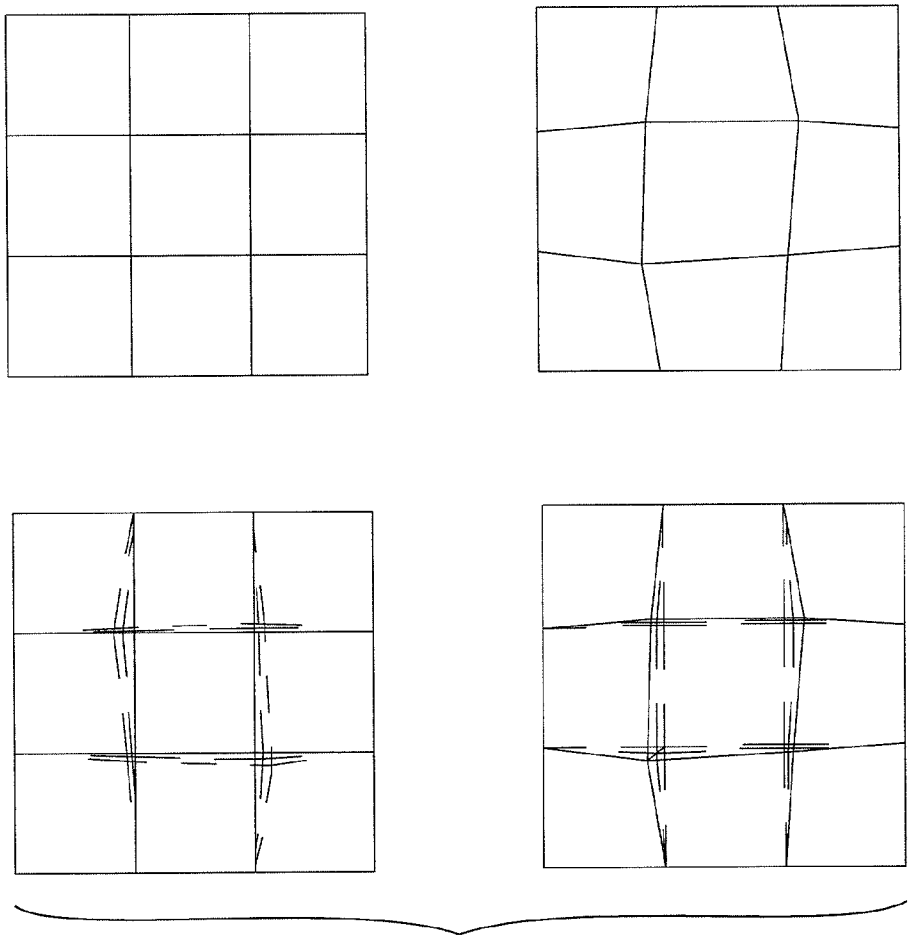
FIG. 46 includes perspective and various front views of a surface comprised of boxes that create an optical affect of relief and depth.
Figure 46A:
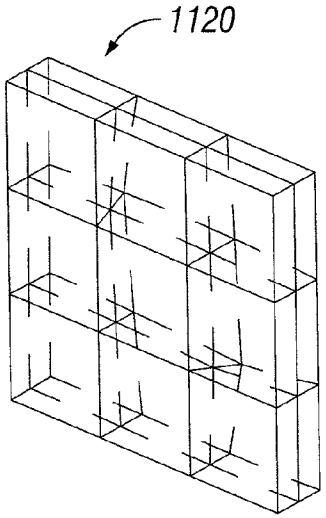

FIGS. 46*a* and *b* are perspective and front views of another illustrative embodiment of a box 1120. Box 1120 is designed to create the illusion of relief and depth when illuminated from behind. Though the front faces of the boxes remain flat, the side walls of the boxes are twisted or sloped making it appear as though the front surface created by the boxes is curvy or twisted. In the example illustrated, the entire box appears to bulge towards the viewer, an effect that is dramatically enhanced by the translucency of the boxes allowing the view to see shadowing from the twisted sidewalls.

Figure 47B:
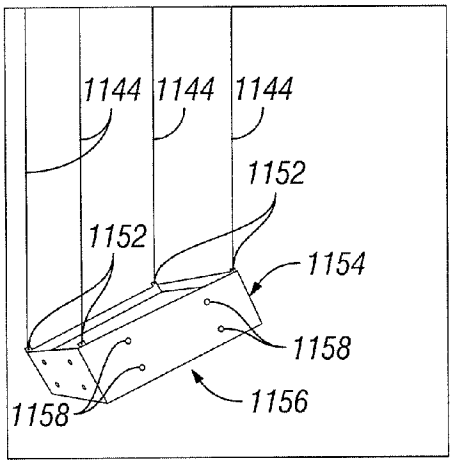
FIGS. 47*a-d* demonstrate another illustrative embodiment of a suspension system for a ceiling-mounted structure.
Figure 47D:
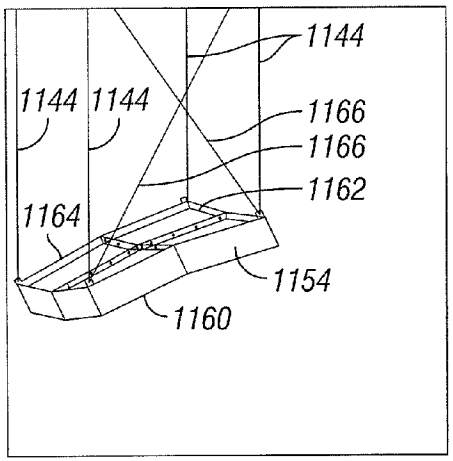
Figure 47A:
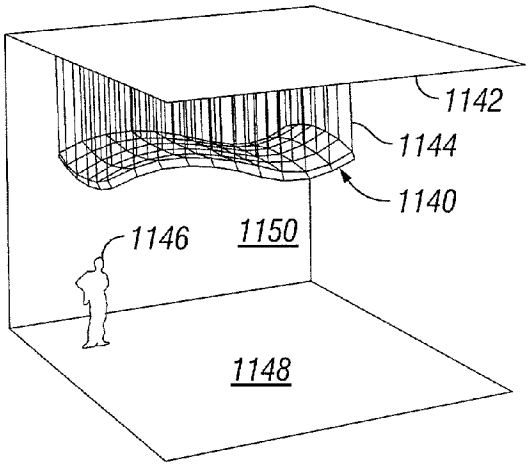
Figure 47C:
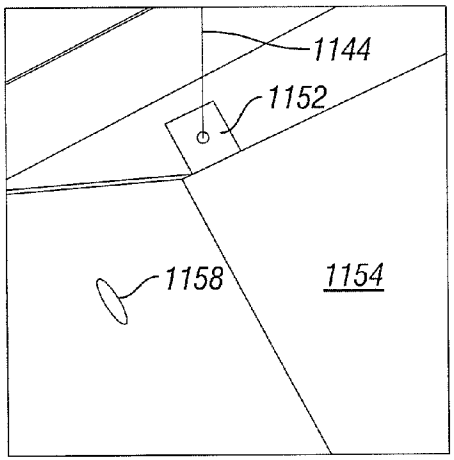

Another illustrative embodiment of a suspended structure 1140 is shown in FIGS. 47*a-d*. As shown in FIG. 47*a*, structure 1140 is suspended from ceiling 1142 via a plurality of wires 1144. An outline of an illustrative person 1146 standing on ground surface 1148 and adjacent to sidewall 1150 is shown for scale. It is appreciated that this view differs from the view of structure 80 in FIGS. 4-6 in that more lines 82 are used with structure 1140 than used with structure 80. This is because the suspension system shown in structure 80 is diagrammatic and included only for context. The suspension system shown in FIG. 47*a* specifically demonstrates how utilizing many attachment points relieves the rotational "moment" stresses at inter-box connections and allows for light weight connections and reduced sidewall depth. As shown in FIG. 47*b*, suspension lines 1144 run from ceiling 1142 to a tab 1152 that is part of sidewall 1154 of individual box 1156. It is appreciated that magnet 1158 can be used on sidewall 1154, as well as all the other sides, to connect adjacent boxes, as previously discussed. The view in FIG. 47*c* shows suspension line 1144 attached to the holding tab 1152, as well as showing magnet 1158. The view in FIG. 47*d* shows how a cluster of boxes 1154, 1160, 1162, and 1164, being held together by suspension lines 1144. In addition, angled bracing wires 1166 may be used to further support the boxes. This may be useful in earthquake-prone areas, for example.

Figure 48A:
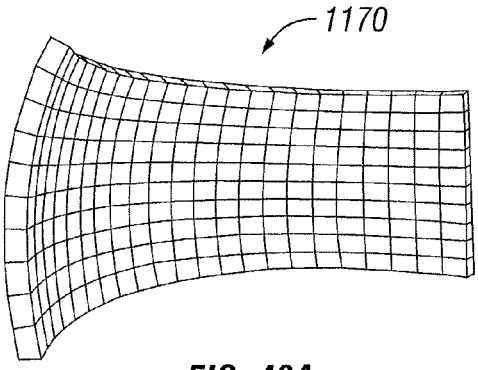
FIGS. 48*a-e* show a variety of design strategies for the boxes used on a particular structure.
Figure 48B:
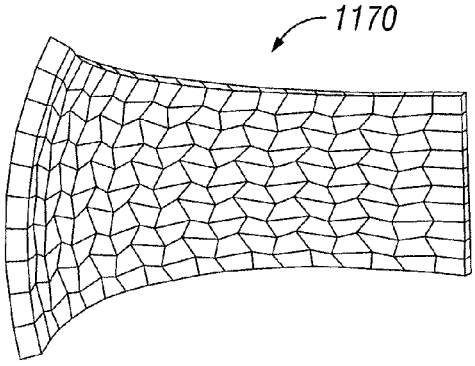
Figure 48C:
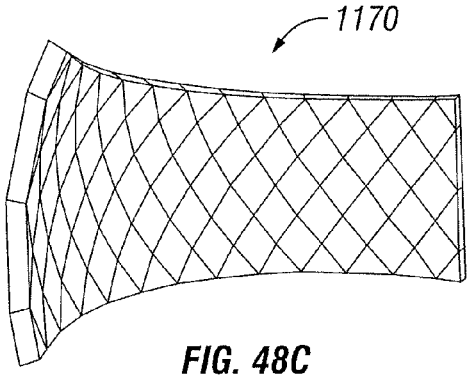
Figure 48D:
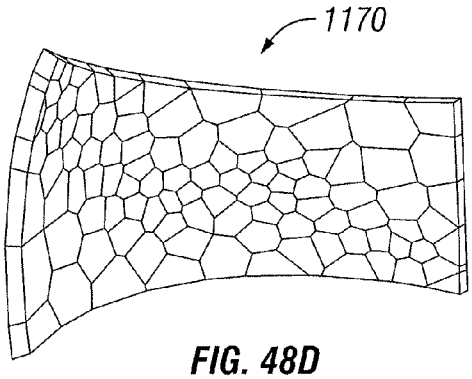
Figure 48E:
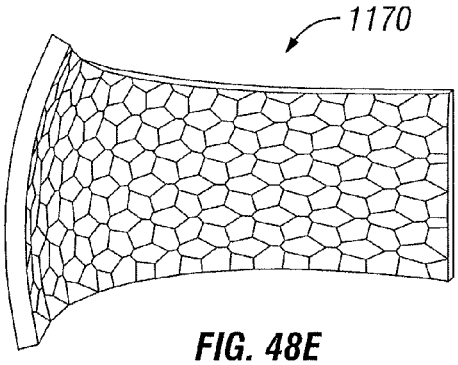

As discussed with respect to the development of the tiling strategies in FIGS. 16 and 22, it is appreciated that the same base surface can be formed into a structure having boxes of a variety of shapes. FIGS. 48*a-e* show the same self-supporting structure 1170, but assembled using different box configurations. As shown in FIG. 48*a*, for example, quad tiling or more conventional box-looking boxes are used to assemble structure 1170. In FIG. 48*b*, the same structure 1170 is made from varied-quad tiling boxes. During the development of the structure itself on computer, different tile shapes for the surfaces can be calculated and chosen. (See also FIG. 18.) As previously discussed, and as shown in FIG. 48*c*, a diamond pattern can be another choice for structure 1170. Similarly, voronoi tiling may alternatively be chosen for structure 1170. Lastly, and as shown in FIG. 48*e*, a hexagonal tiling can be employed. This demonstrates how not only the shape of the structure can be varied to create particular shapes, but also the box configuration to give those shapes a particular surface look. It is, in other words, an added design characteristic for such structures.

Figure 49A:
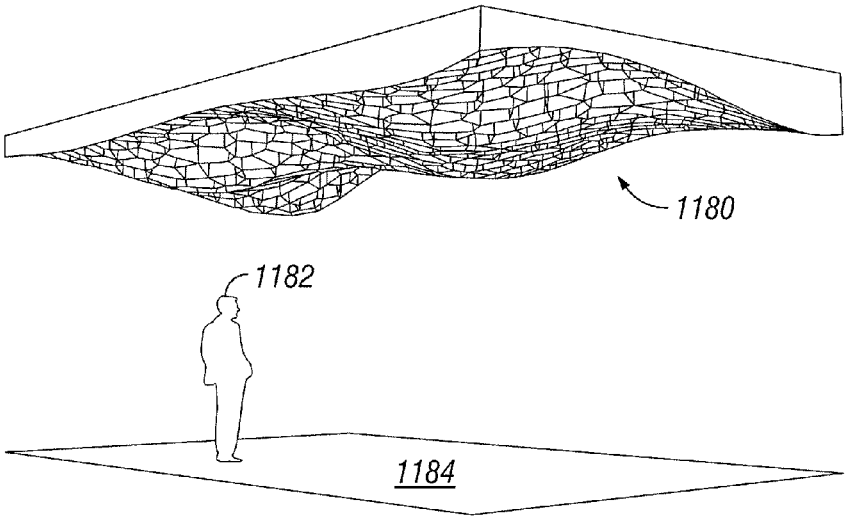
FIGS. 49*a-d* show another illustrative embodiment of a structure.
Figure 49C:
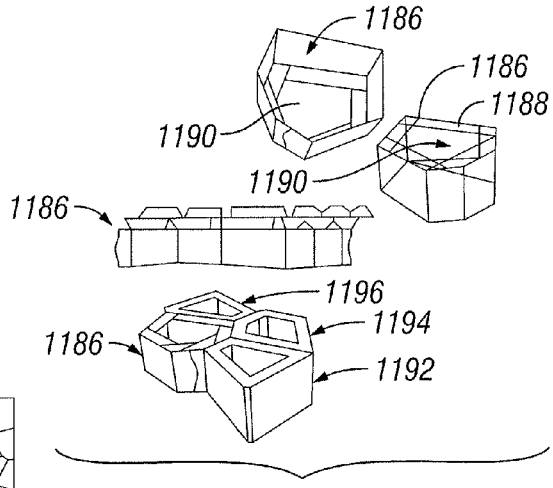
Figure 49B:
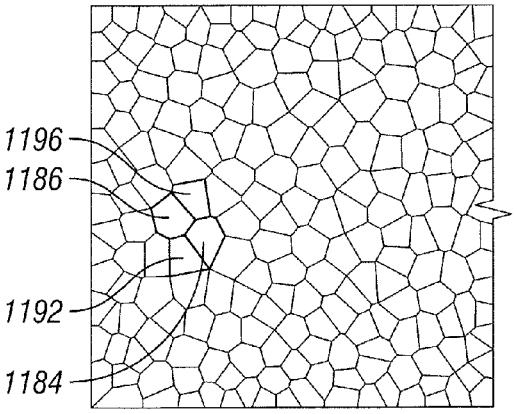
Figure 49D:
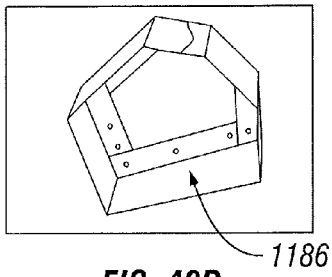

Another illustrative embodiment of the present disclosure shown in FIGS. 49*a-d* includes a structure 1180 that is constructed from a plurality of open surface box frames. In this illustrative embodiment shown in FIG. 49*a* structure 1180 is a ceiling structure. This view includes the outline of a person 1182 standing on a ground surface 1184 for scale purposes. As shown in the plan view of FIG. 49*b*, it is appreciated that the illustrative tiling structure in this case is hexagonal or voronoi (see, also, FIGS. 48*d* and *e*). These boxes are different, however, in that shown in FIGS. 49*c* and *d* they have the look of an open-faced frame. In FIG. 49*c*, in particular, a flat blank of box 1186 shows how such a box is formed. This view also shows that when folded, box 1186 includes a frame surface 1188 around its periphery and an opening 1190. It is appreciated that all of the boxes in this pattern can be made in similar manner as box cluster 1186, 1192, 1194, and 1196, also shown in FIG. 49*c*. FIG. 49*d* is a perspective view of box 1186 further showing how it is folded into three-dimensions. By assembling these boxes in the method previously discussed, structure 1180 can be formed.

Figure 50A:
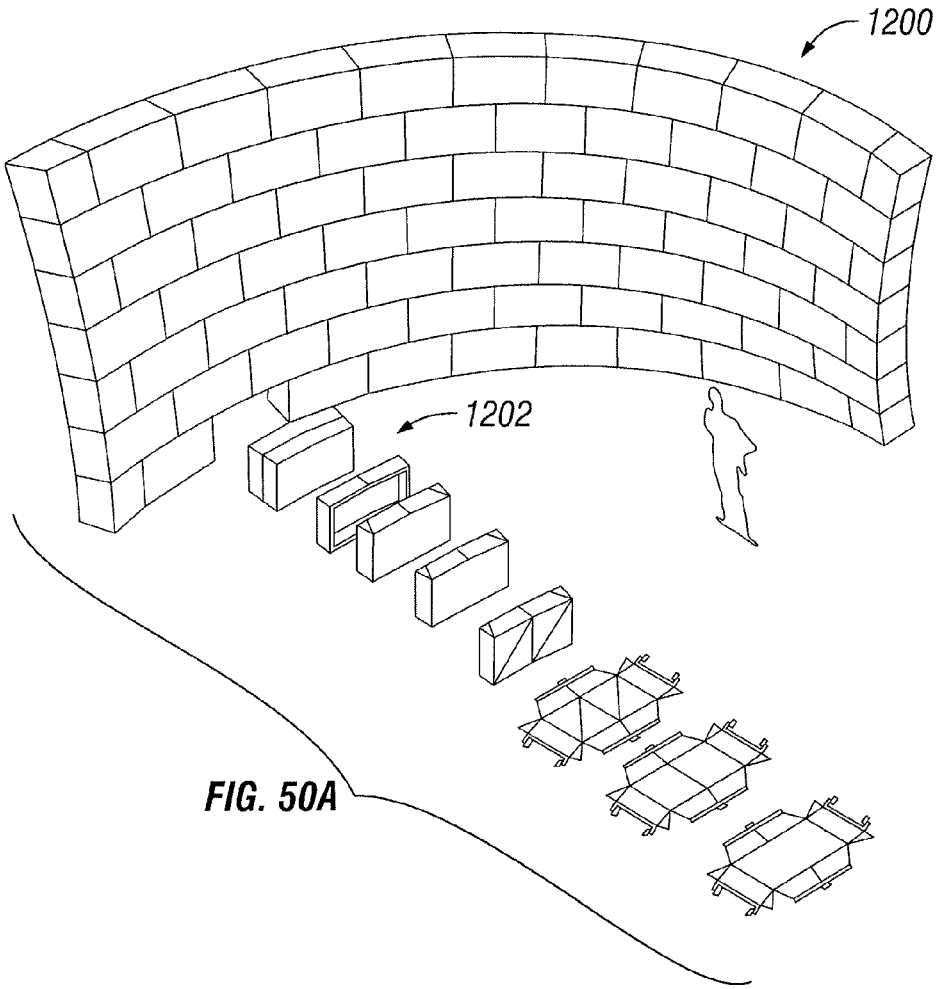
FIGS. 50*a-b* show another illustrative embodiment of a structure and boxes that are able to connect to one another without requiring accessory hardware.
Figure 50B:
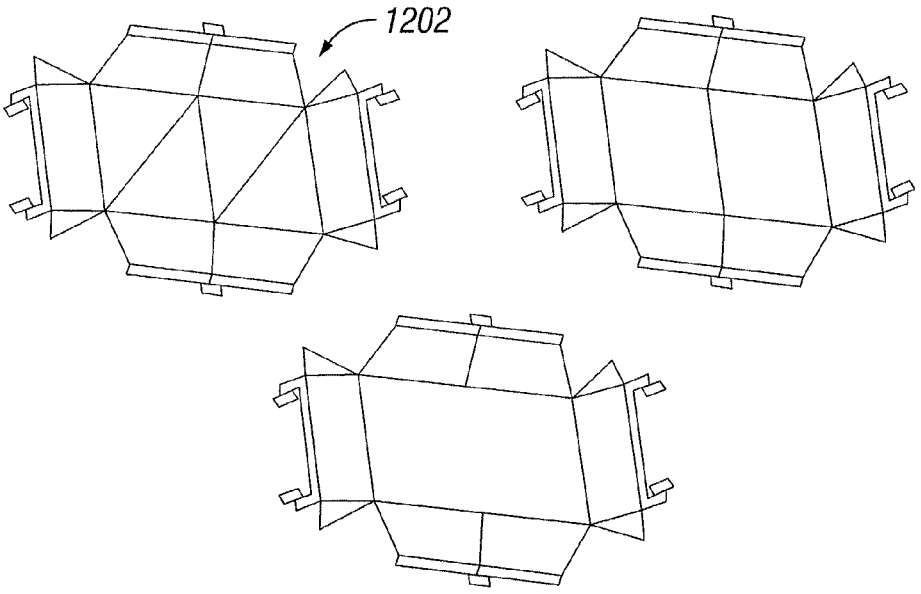

Perspective views of a structure 1200 and multiple plan views of box 1202 in flat blank form, are shown in FIGS. 50*a* and *b*. In this illustrative embodiment, the boxes that make up structure 1200 are "staggered" similar to a common bond with brick building. When building a curved form with staggered course boxes, each box must have a bend to match the profiles of the boxes above and below it. This bend is modeled in the digital representation of the part and shown in the unfolding sequence in FIG. 50*a* and in the unfolded mesh in part 1202. FIG. 50*b* shows how this bend and the triangular faceting that make up the digital model of the boxes are removed before fabrication resulting in material twisting to create the required curvature.

Figure 51A:
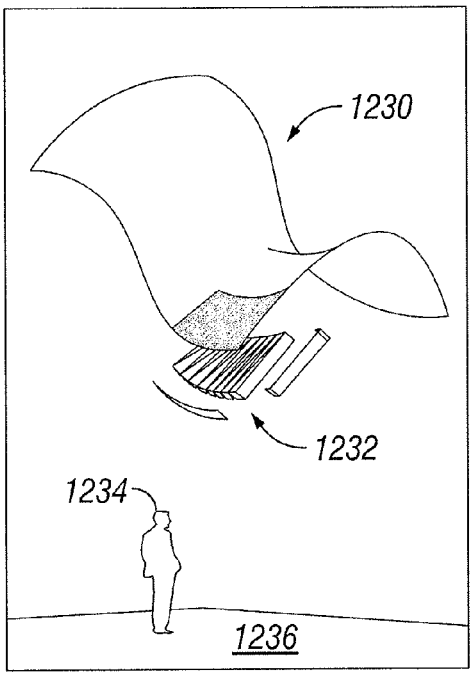
FIGS. 51*a-h* show another illustrative embodiment of a structure, as well as how the box component is formed.
Figure 51B:
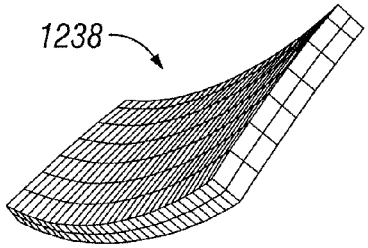
Figure 51C:
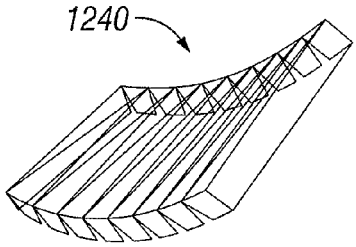
Figure 51D:
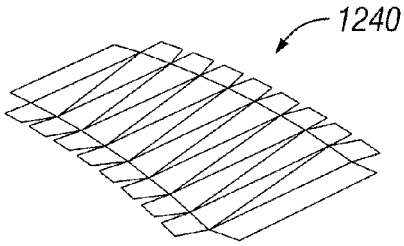
Figure 51E:
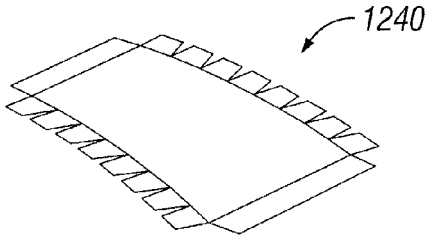
Figure 51F:
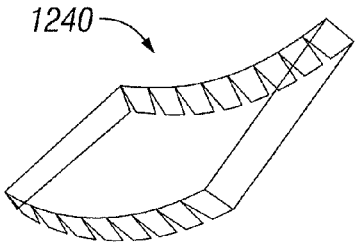
Figure 51G:
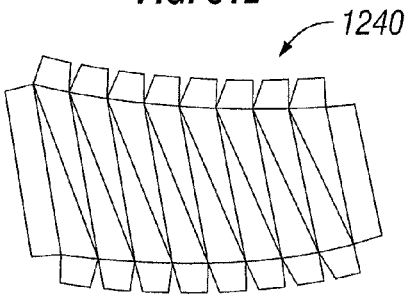
Figure 51H:
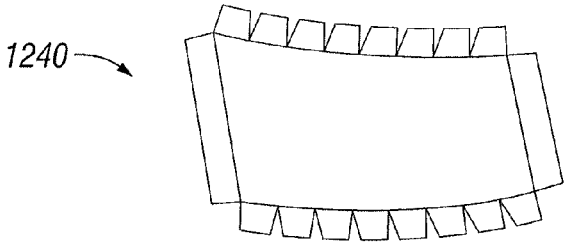

FIGS. 51*a-h* show another illustrative embodiment of a base surface design 1230 that includes a subdivided structure portion 1232 and the method of making the same. As shown in FIG. 51*a*, base surface 1230 is a complex curve shape serving as an illustrative ceiling. An outline of a person 1234 on floor surface 1236 is added for scale. These views demonstrate how the curved surface structure is created from base surface 1230. As shown in FIG. 51*b*, the curvature of the subdivided portion 1238 of the base surface can be seen clearly. This subsurface is itself further subdivided into triangular panels approximating the curvature of the original surface 1240, as shown in FIG. 51*c*. The subdivided surface 1240 is then unfolded flat into a single panel shown in FIGS. 51*d* and *g* and reduced to its edges and hard folds for fabrication shown in FIGS. 51*e* and *h*. FIG. 51*f* illustrates how the fabricated part will appear when folded into position for the installation.

Figure 52:
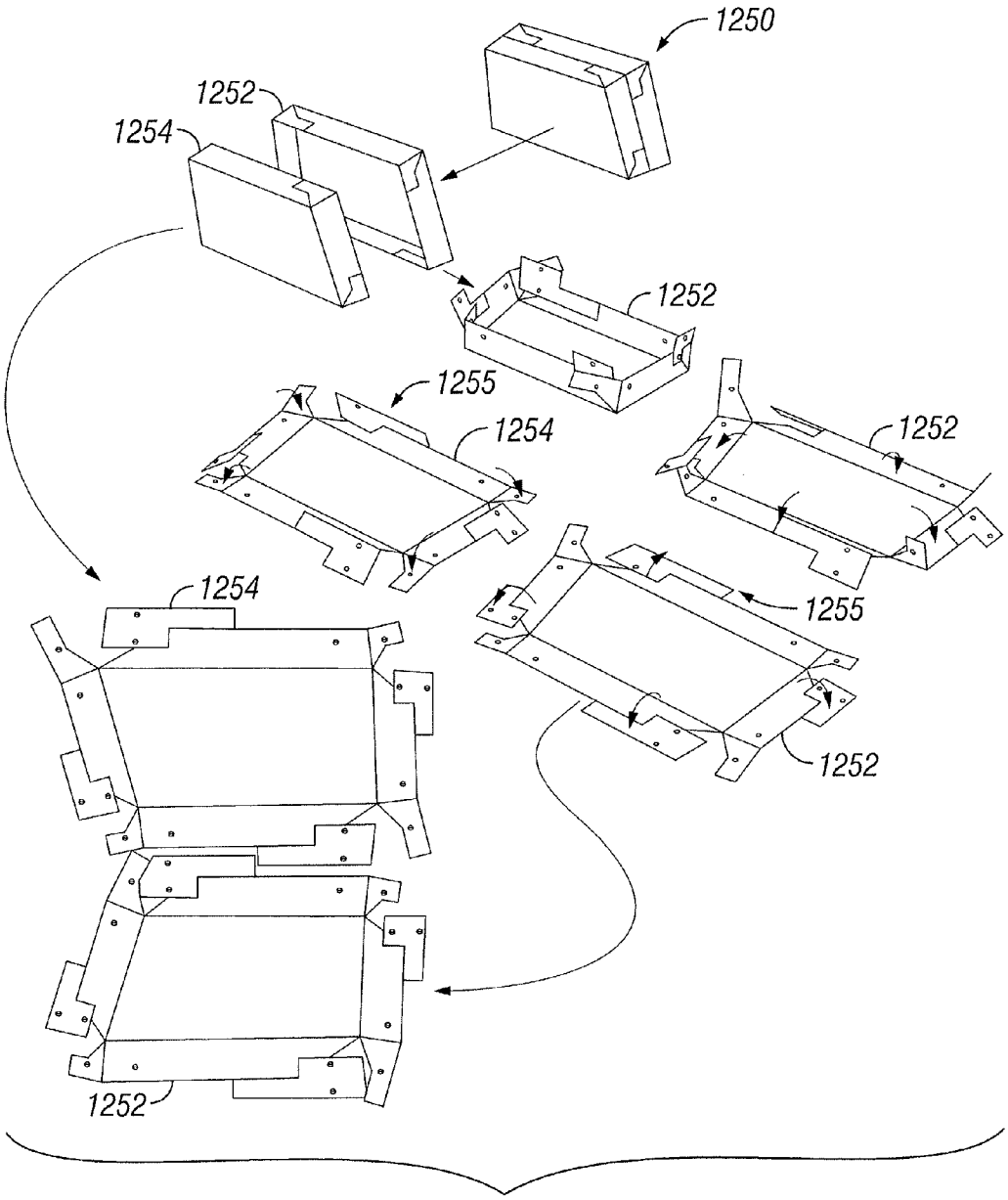
FIG. 52 shows a progression view of roll fold quick box portions from flat blank to final assembled box form.

FIG. 52 is a progression view of a roll-fold quick box 1250 comprising box portions 1252 and 1254 from a flat blank sheet condition to a final folded box. This foldup strategy enables two matching box hemispheres to fold up and connect back to back only using the magnets required for interbox connection to connect the two hemispheres. Each side has a foldover flap 1255 shown in folded and unfolded conditions. When folded over, these flaps 1255 slide into the facing box hemisphere and match magnet locations creating a positive connection. This foldup strategy enables parts to be shipped flat and quickly assembled and installed on location and requires no additional structure or connectors.

Figure 53:
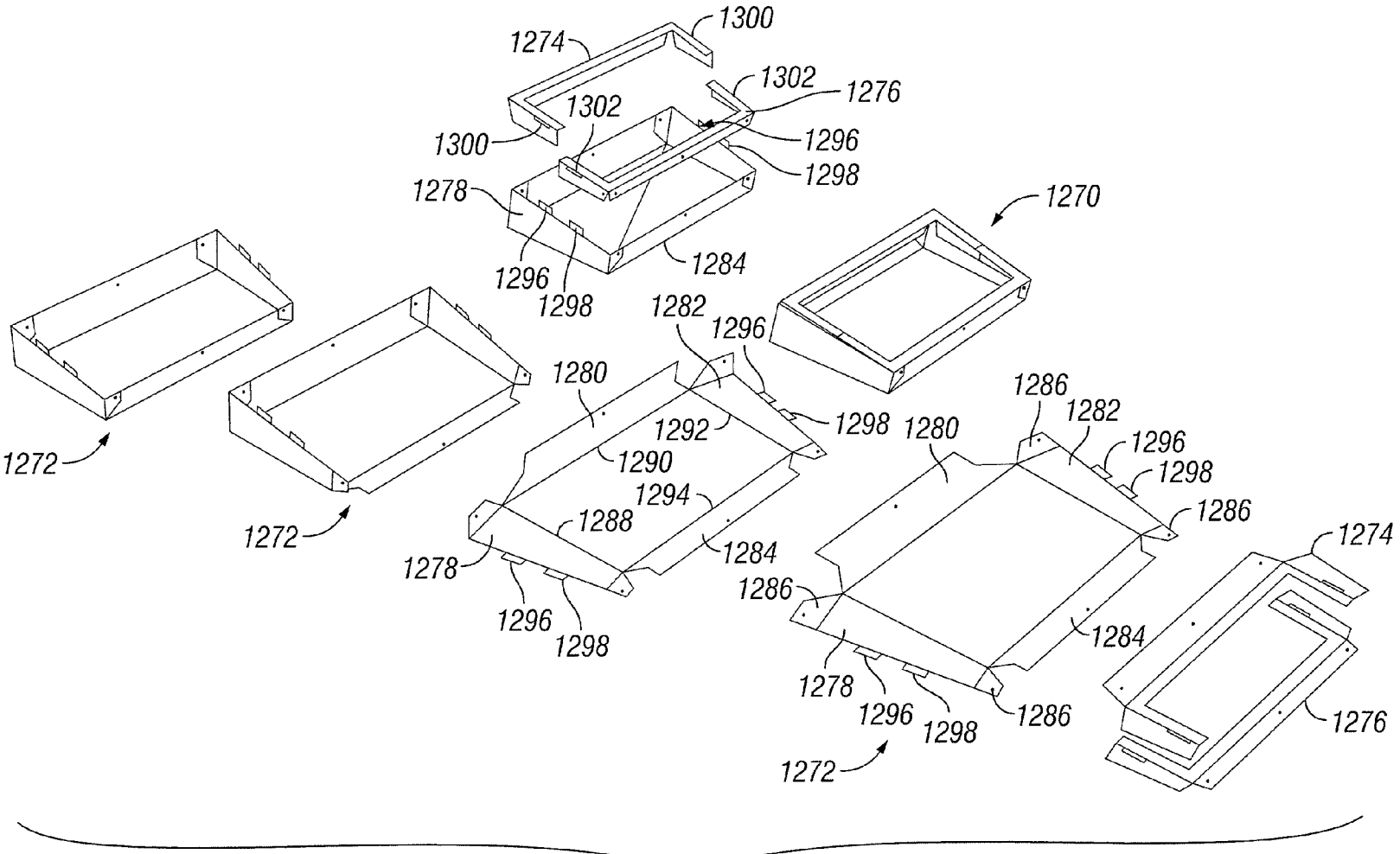
FIG. 53 shows progression views of a box portion from blank to folded configuration that employ a back frame for inside the box portion.

A perspective progression view of a back frame flange box 1270 is shown in FIG. 53. This box configuration will use a frame, but inside the box not an outer frame or skeletal structure as previously discussed. In this illustrative embodiment, when in flat sheet blank form, box 1270 includes two components—the outer box portion 1272 and box flange frame portions 1274 and 1276. Box portion 1272 includes sides 1278, 1280, 1282, and 1284 with mating tab 1286 illustratively extending from sides 1278-1282. With score line 1288, 1290, 1292, and 1294, sides 1278, 1280, 1282, and 1284 may be folded to begin forming the three-dimensional box. Rivets, adhesives, or other fastener can be used to secure box 1272 in box form, as shown. Connection tabs 1296 and 1298 each extend from sides 1278 and 1282, respectively. Flange portions 1274 and 1276 each include slots 1300 and 1302, respectively, which engage tabs 1296 and 1298, respectively, to fit and secure flanges 1274 and 1276 to box portion 1272.

Figures 54A, 54B, 54C, 54D, 54E:
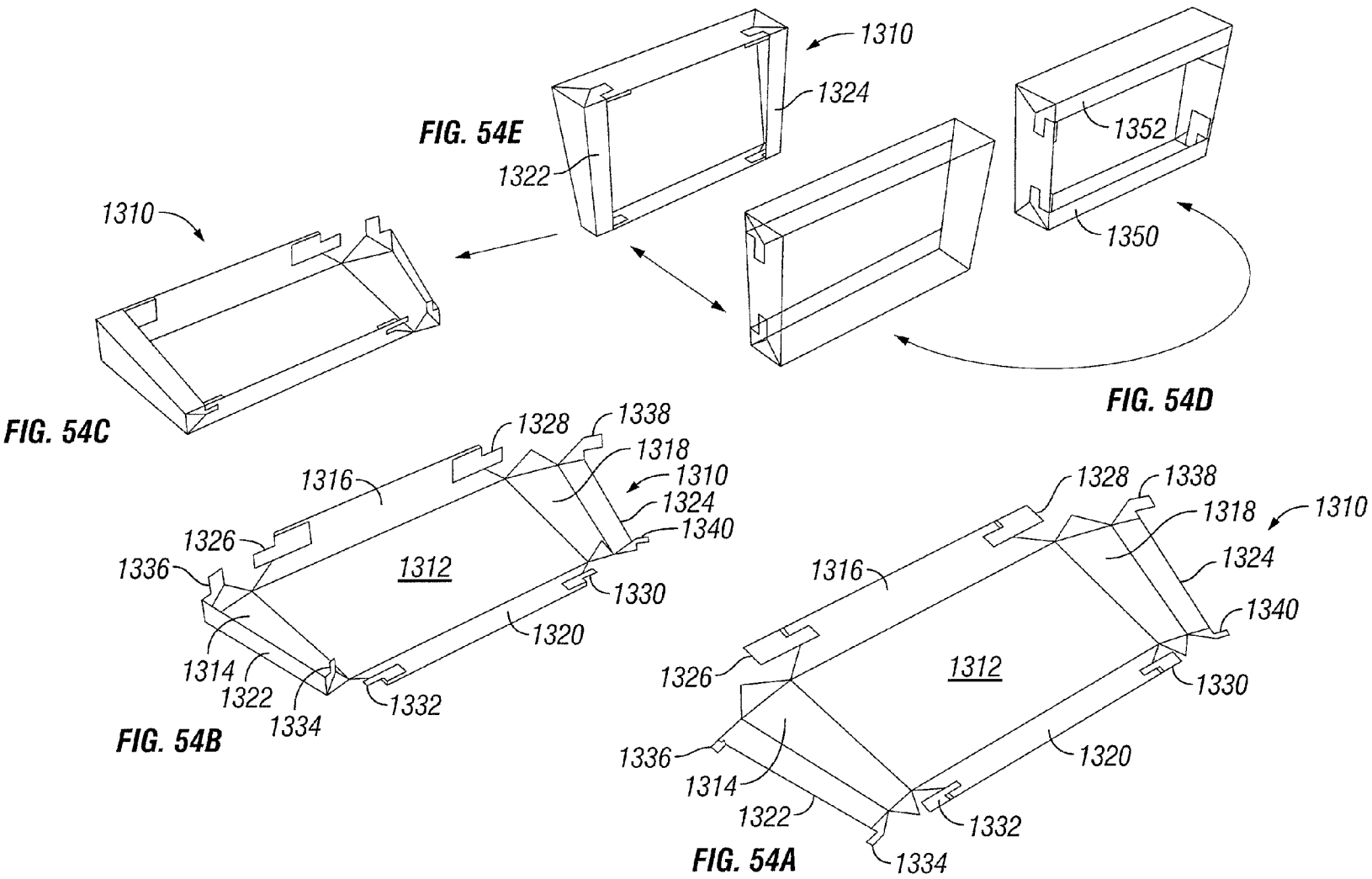
FIG. 54 includes progression views of an integral double-back flange box from flat blank form to final box portion form.

FIGS. 54*a-e* are progression views showing the assembly of an integral double-back flange box 1310. Similar to prior embodiments, box 1310 includes a face 1312, sides 1314, 1316, 1318, 1320, and flanges 1322 and 1324. Lap joint tabs 1326, 1328, 1330, and 1332 extend from sides 1316 and 1320, as shown in FIG. 54*a*. Tabs 1330, 1334, 1336, 1338, and 1340 extend from flanges 1322 and 1324, as shown as well. When box 1310 is folded, as shown in FIG. 54*b*, lap joint 1326 can be connected to tab 1336; joint 1328 attached to tab 1338; joint 1330 to 1340; and joint 1332 to tab 1334. Securement may be made mechanically, magnetically, or chemically. The view in FIG. 54*c* further shows how box 1310 is assembled. It is appreciated, as shown in FIGS. 54*d* and *e*, that different back flange configurations can be used. For example, as shown in FIGS. 54*a-d*, side flanges 1322 and 1324 are employed. Conversely, as shown in FIG. 54*d*, top and bottom flanges 1350 and 1352 are horizontally oriented. By changing the flange orientation, the boxes are stiffened in both directions.

Figures 55A, 55B, 55C, 55D, 55E, 55F, 55G:
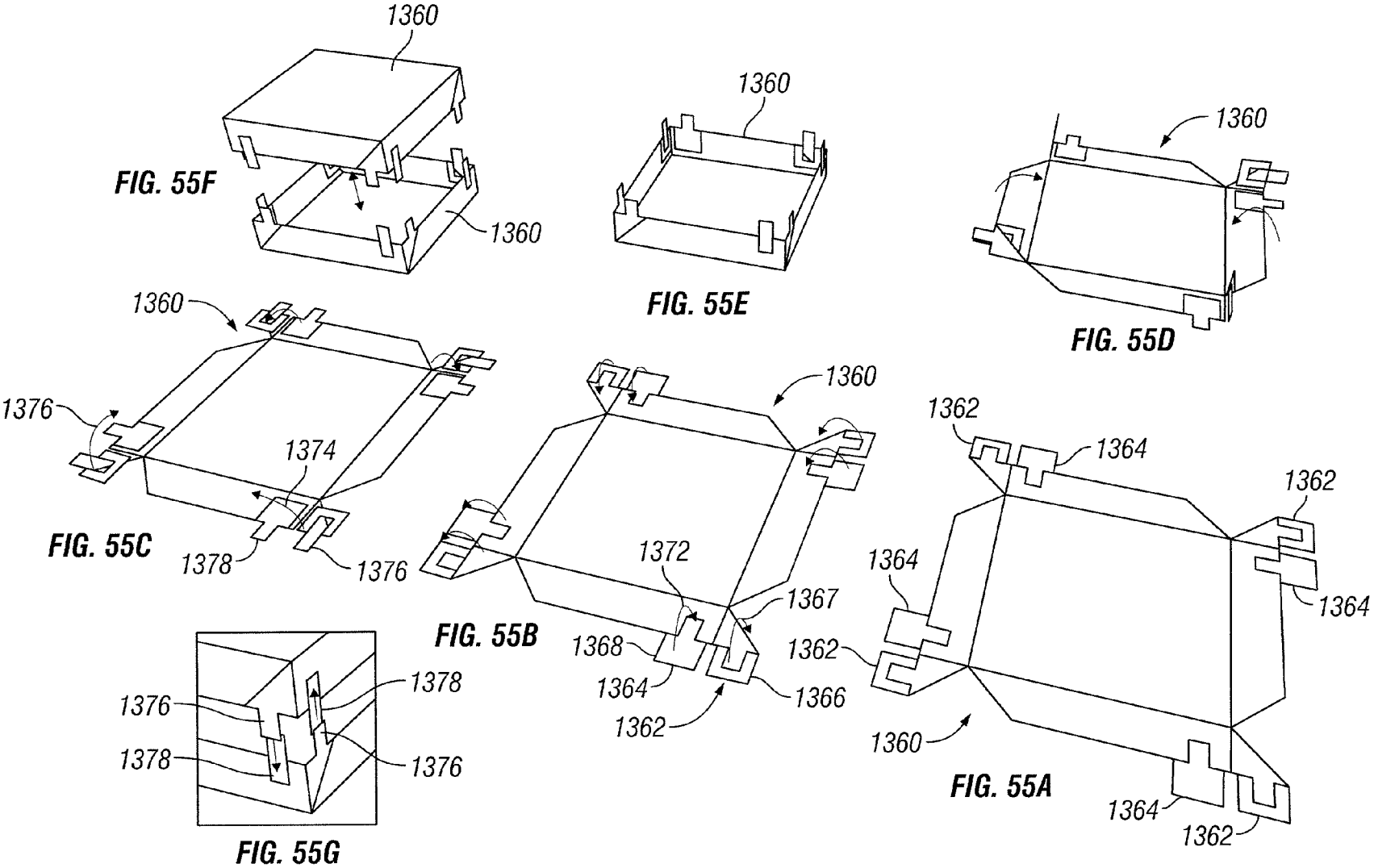
FIGS. 55*a-g* are progression and detail views of an offset box tab assembly system for use on a box from the flat blank condition to folded box portion condition.

Several perspective views of an offset box tab assembly system are shown in FIGS. 55*a-g*. Box portions 1360 are shown in flat blank condition in FIG. 55*a*. The side walls are bent upward, as previously discussed with respect to other embodiments. This embodiment, however, includes fold over offset tabs 1362 and 1364. Illustratively, each corner includes such tabs 1362 and 1364 as shown. Each tab portion 1362 and 1364, as shown in FIGS. 55*b* show e, includes a fold over portion 1366 and 1368, respectively. Portions 1366 and 1368 are folded as indicated by directional arrows 6, 13, 70, 1372, 1374, as shown in FIGS. 55*b* and *c*. This forms tab guides 1376 and 1378. The box sides are then folded over, as shown in FIGS. 55*d* and *e*, so that duplicate box portions 1360 can be attached together, as shown in FIGS. 55*f* and *g*. As shown in the detail view of FIG. 55*g*, tab guides 1376 and 1378 engage corresponding guides 1376 and 1378 of another identical box.

Figure 56A:
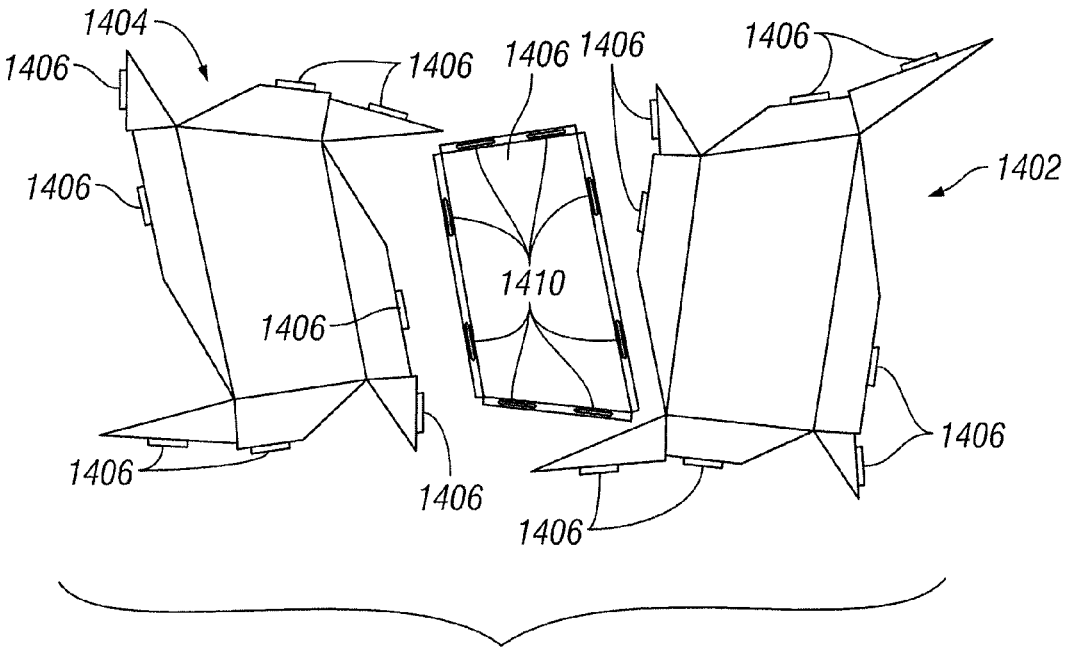
FIGS. 56*a-f* are progression and detail perspective views of a mushroom tab box system from flat blank condition to assembled box condition.
Figure 56B:
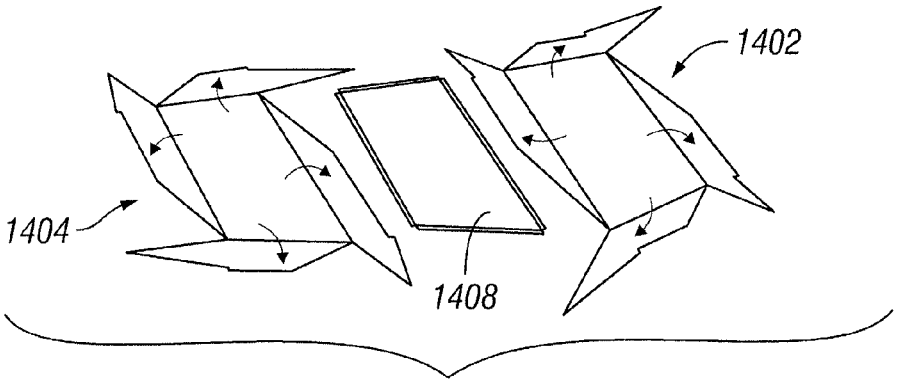
Figure 56C:
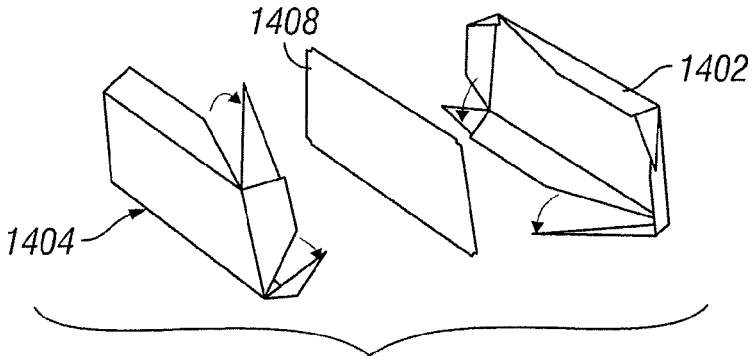
Figure 56D:
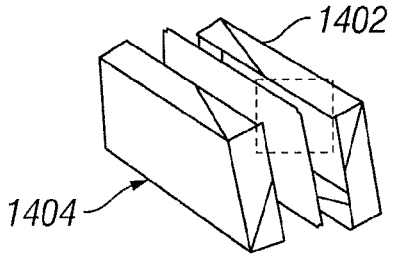
Figure 56E:
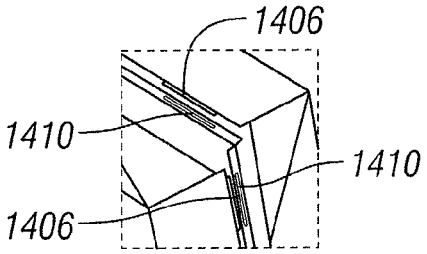
Figure 56F:
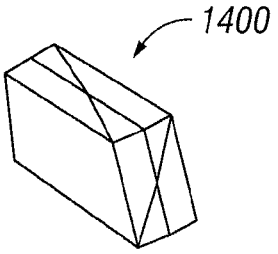

An illustrative embodiment of a mushroom tab box 1400 is shown in FIG. 56*a-f*. As shown in FIG. 56*a*, box portions 1402 and 1404 include box face and sides like prior embodiments. In addition, each box portion includes tabs 1406 extending from the sides. A panel 1408 includes slots 1410 that coincide with tabs 1406. As shown in FIGS. 56*b* and *c*, box portions 1402 and 1404 are folded into box portions. As shown in FIGS. 56*d* and *e*, tabs 1406 are inserted into slot 1410, thereby attaching both box portions 1402 and 1404 together to form box 1400 which is shown in FIG. 56*f*.

Another illustrative embodiment of a box assembly system is shown in FIGS. 57*a-e*. In this illustrative embodiment, a mechanical fastener is used to attach box walls together to form a finished box portion. As shown in the progression view of FIG. 57*a*, a conventional box portion 1420, including a face 1422 and sides 1424 and 1426 are folded in directions 1428 and 1430 as shown. When folded, through holes 1432 form a pattern and a cavity or moat 1434 that can be filled with a casting compound to form a joining tenon, as shown in FIGS. 57*a* and *b*. Mechanical clamp portions 1436 and 1438 straddle each side of wall 1426 of box 1420, as shown in FIGS. 57*c* and *d*. Posts 1440 of portion 1436 are configured to extend through openings 1442 and portion 1438. It is appreciated that epoxy (or other castable material) can fill moat 1434 so that when tenon is assembled (cast), a solid securement is formed. FIG. 57*d* shows illustrative fold configurations and channels that receive the epoxy. As shown in this view, holes 1432 are the same as the prior embodiment, but channels 1444 can be any variety of configurations to receive the epoxy for structural, assemblage, or aesthetic considerations.

Figures 58A, 58B, 58C, 58D, 58E, 58F:
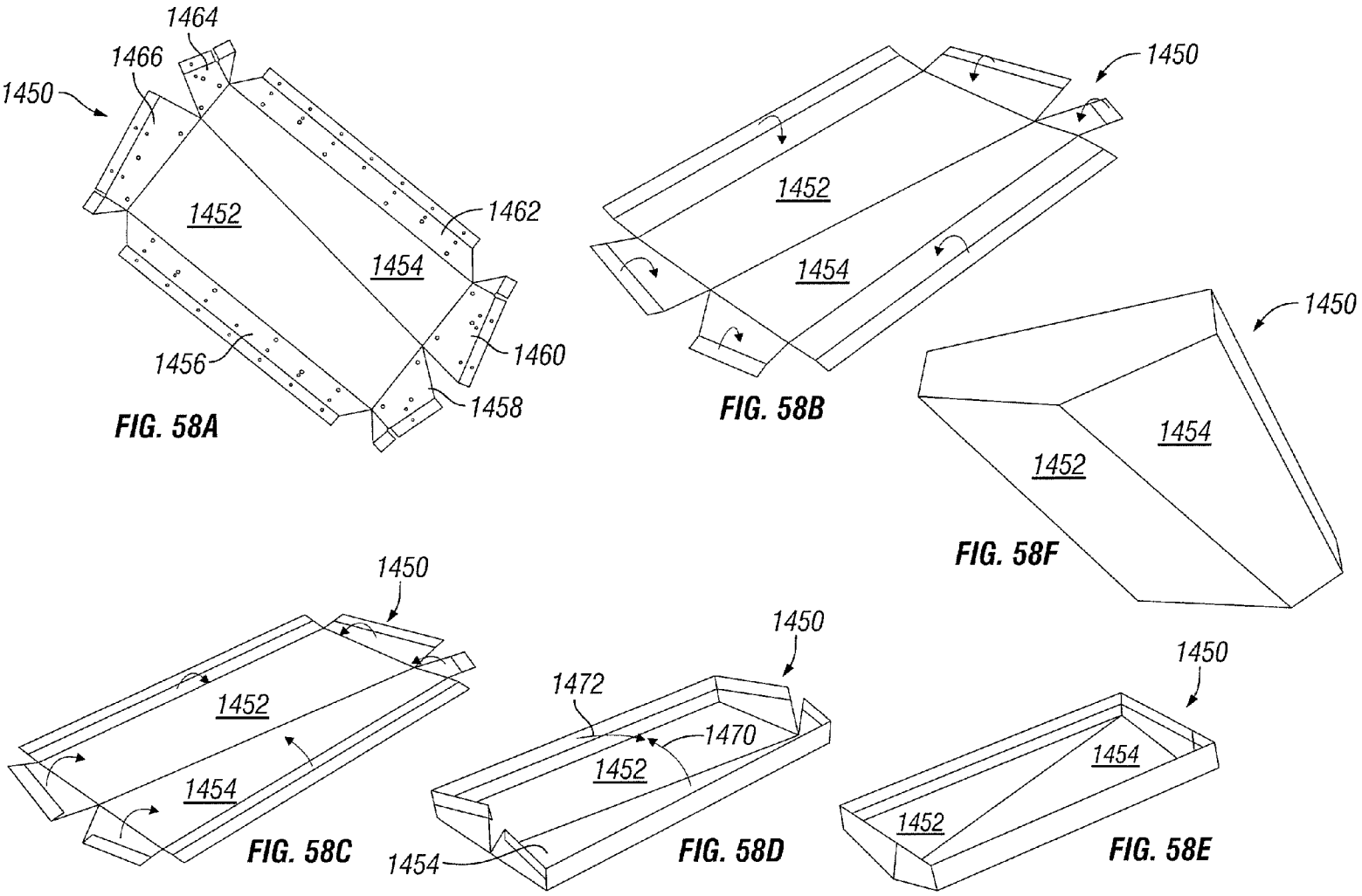
FIGS. 58*a-f* are perspective progression views of folding a cuspy box from the flat blank condition to assembled box condition.

As discussed with respect to structure 930 of FIGS. 19*a-d*, a design element of such a structure is the facing of the boxes themselves. In structure 930 a cuspy box is created. The progression views of FIGS. 58*a-f* demonstrate how such a cuspy box 1450 is made. As shown in FIG. 58*a*, cuspy box 1450 is in unfolded flat blank form. This blank may be cut and scored to create face portions 1452, 1454, along with sides 1456, 1458, 1460, 1462, 1464, and 1466. As shown in FIGS. 58*b* and *c*, the sides 1458 through 1466 can be folded to draw them upward. Each of the sides 1458-1466 includes a cuff that is folded over to add strength. As shown in FIG. 58*d*, both sides of box 1450 are pulled upward in directions 1470 and 1472 to create the multi-angled top surface, as shown in FIGS. 58*e* and *f* to create cuspy box 1450.

Figure 59A:
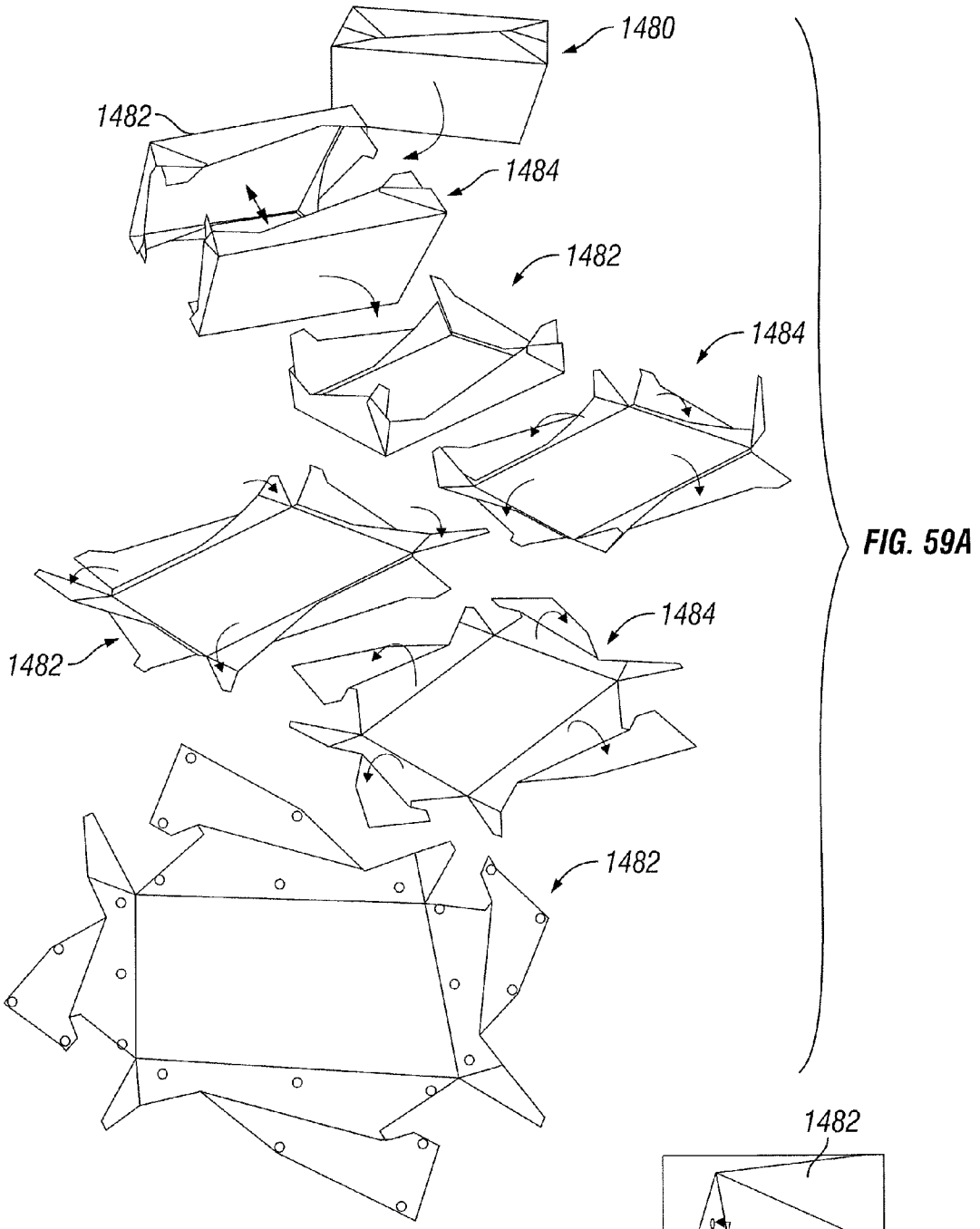
FIGS. 59*a* and *b* are progression perspective views of a zigzag box from flat blank condition to folded box condition.
Figure 59B:
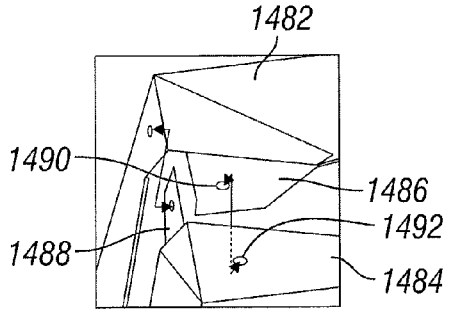

Another illustrative embodiment of a box is box 1480 made up of box portions 1482 and 1484, is shown in FIGS. 59*a* and *b*. In this illustrative embodiment, box portions 1482 and 1484 are identical in design making them mirror images that may be coupled together to form single box 1480. As shown in FIG. 59*b*, tabs 1486 and 1488 extend from box portions 1482 and 1484, respectively, to assist attaching box portions 1482 and 1484 together. Holes 1490 and 1492, for example, align when box portions 1482 and 1484 are joined together and configured to receive a mechanical fastener, adhesive, or other attaching structure to fasten box portions 1482 and 1484 together. As shown in this view, box portions 1482 (and 1484 for that matter) fold open as shown to form an unfolded blank version of box portion 1482 (and 1484).

Figure 60:
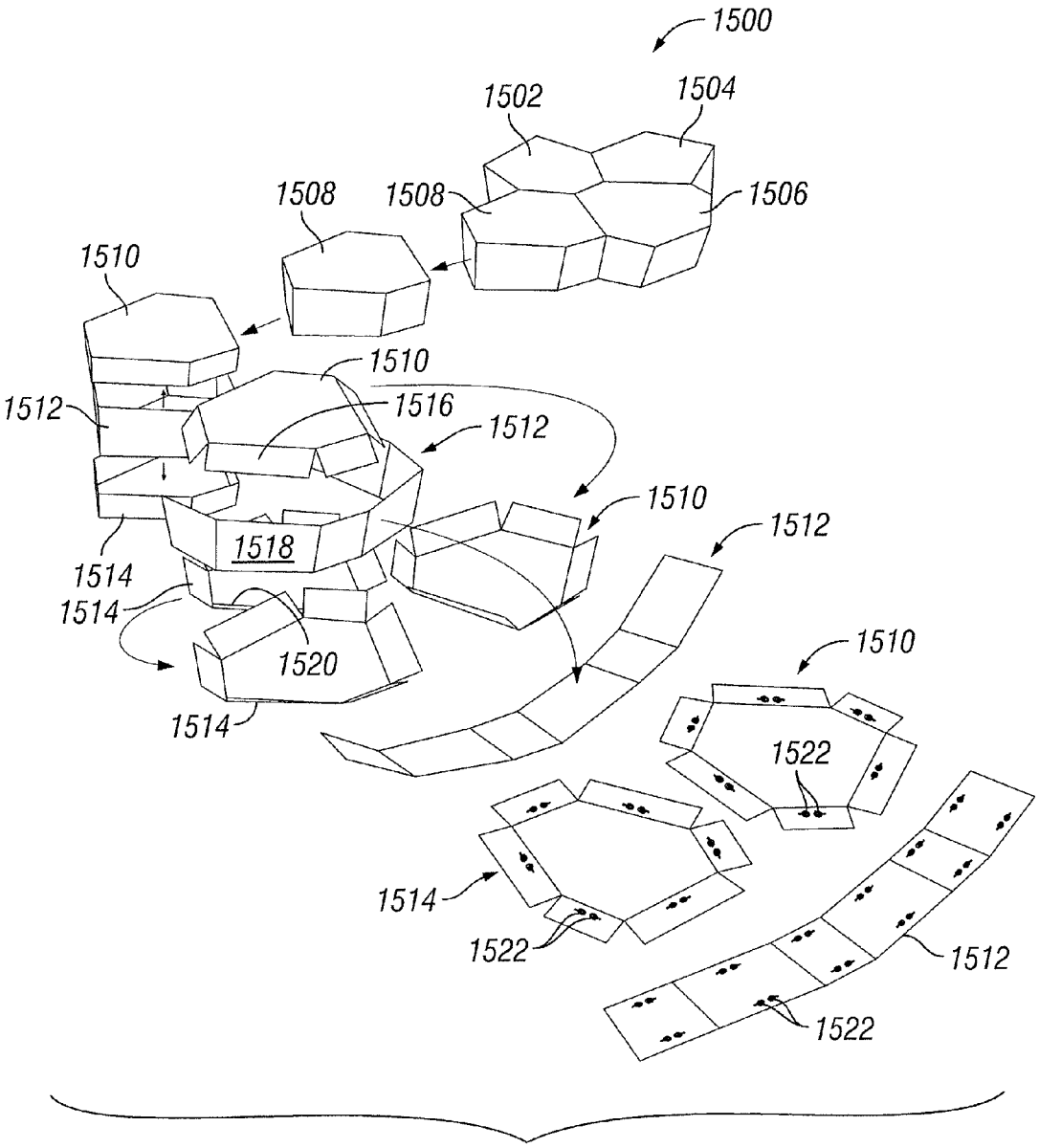
FIG. 60 is perspective progression views of a voronoi sleeve box from flat blank condition to folded box condition.

A perspective view of a cluster of voronoi sleeve boxes 1500 is shown in FIG. 60. Cluster 1500 is made up of boxes 1502, 1504, 1506, and 1508. Box 1508 (as well as boxes 1502-1506 for that matter) is an illustrative hexagonally-shaped box made from a top 1510, side panel 1512 and bottom 1514. In this illustrative embodiment, top 1510 includes tabs, such as tab 1516 configured to engage a side 1518 of side panel 1512. Tab 1516 can be mechanically or adhesively attached to side 1518 for securing the two together. Likewise, bottom 1514 includes tabs such as 1520 that likewise is attachable to side 1518 attaching the two together, as well. It is appreciated that each tab on top 1510 can attach to a corresponding side on side panel 1512 thereby attaching top 1510 and side panel 1512 together. Likewise, tabs extending from each edge of bottom 1514 extend upward to attach to side panel 1512 as well. This view also shows portions 1510, 1512, and 1514 as flat unfolded sheets. Illustrative magnet locations and alignment holes 1522 on each of the different portions provide means for securing the portions together to for the box.

Figure 61:
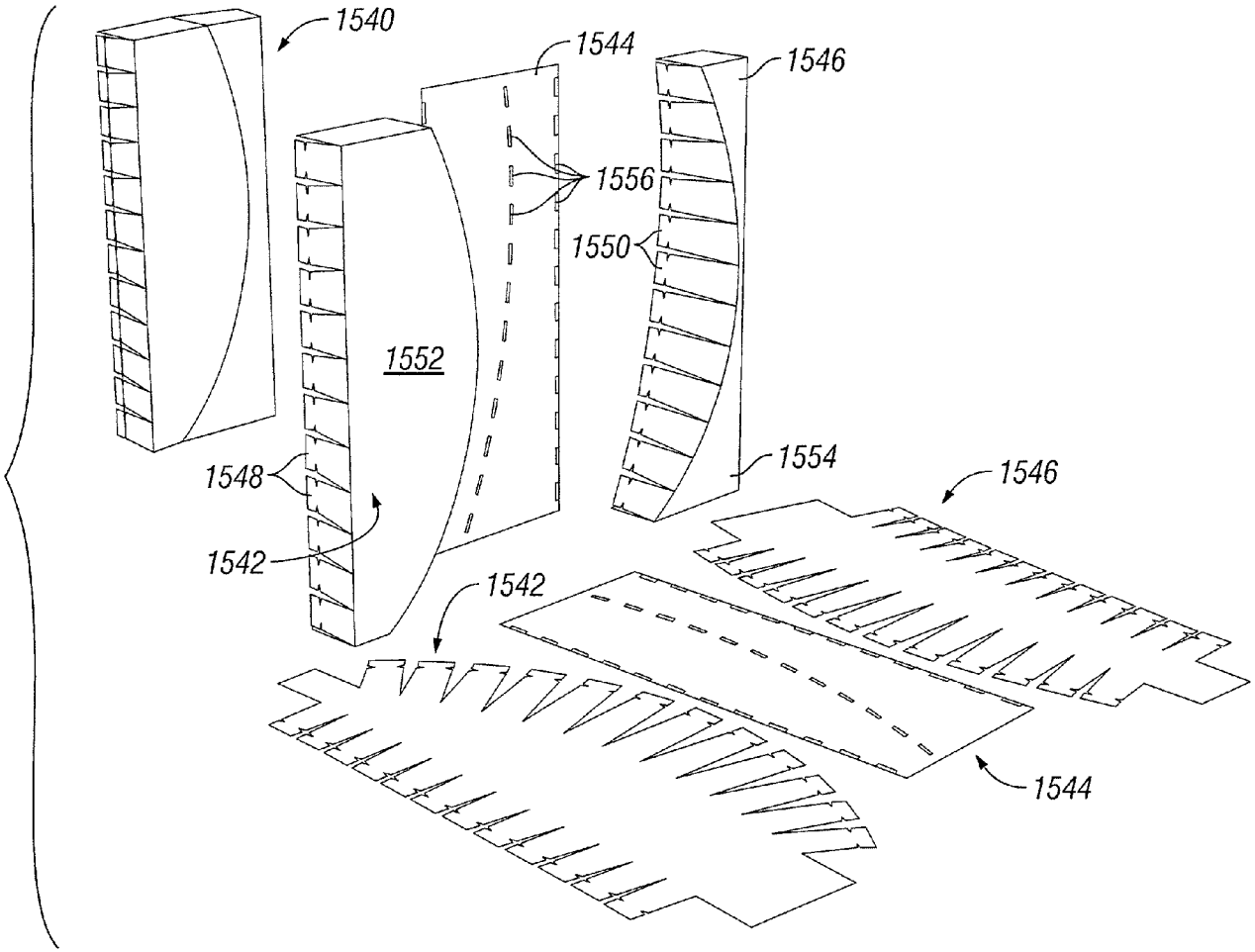
FIG. 61 is progression perspective views of a ruled surface relief box from flat blank condition to folded box condition.

A ruled surface relief box 1540 and the method of making the same are shown in FIG. 61. Box 1540 is made up of first portion 1542, back portion 1544, and second portion 1546. The front faces of 1542 and 1546 are twisted surfaces and the curvature is approximated, digitally modeled and unrolled using the technique described in FIG. 51. It is appreciated that the shape of portions 1542 through 1546 are illustrative and can comprise any combination of curve or straight surfaces. In this illustrative embodiment, a plurality of tabs 1548 and 1550 extend from surfaces 1552 and 1554 and engage slots 1556 disposed through back portion 1544 twisting the front faces of 1542 and 1554 into position. This view also shows how portions 1542, 1544, and 1546 begin life as flat cut sheets that can be folded into the box form. It is appreciated how the approximation of highly curved surfaces with such folding techniques gives rise to a large variety of design and construction options not available to conventional wall stud/drywall or paver/uni-size block wall construction.

Figure 62:
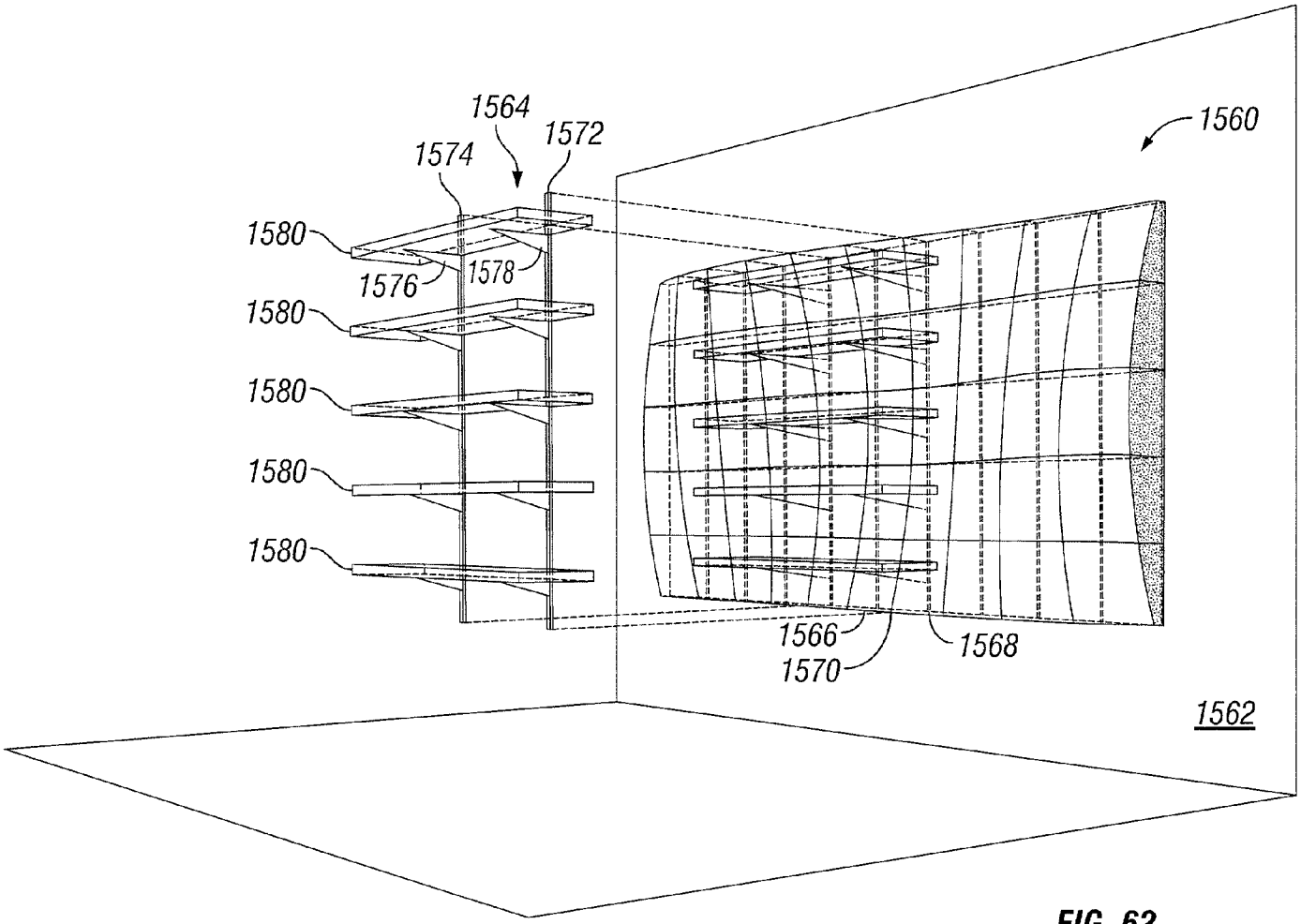
FIG. 62 is a perspective view of an illustrative shelf system that can be integrated into a wall structure system.
Figure 63:
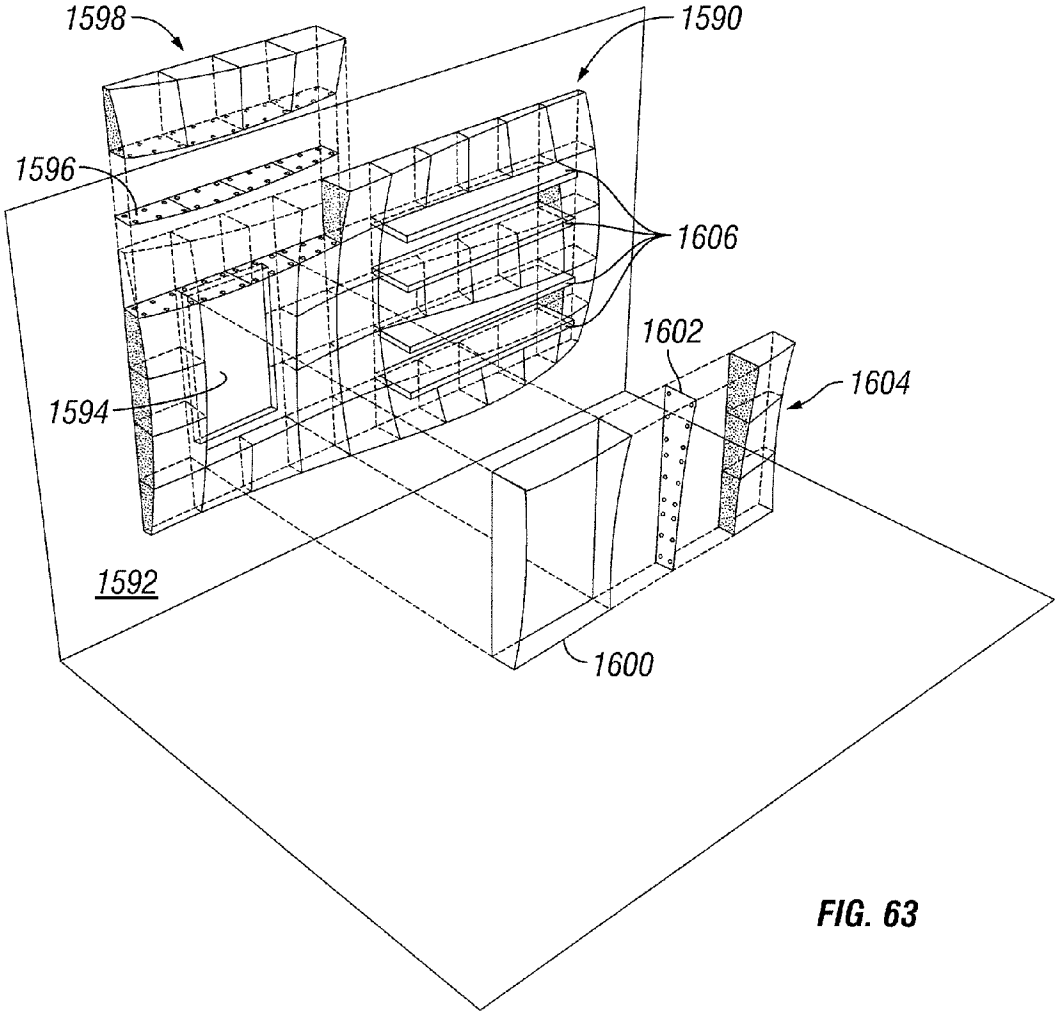
FIG. 63 is another perspective view of a wall structure that includes shelving and a fenestration.

A perspective view of a wall mounted structure 1560 attached to wall 1562 with a shelf system 1564 both in separated and attached view, is shown in FIG. 62. With respect to structure system 1560, it can be constructed and mounted similar to that described in FIGS. 4, 29*a-g*, 39, and 40, for example. In this present embodiment, however, columns of boxes, such as columns 1566 and 1568, may have a wider seam between the columns than in the prior embodiments. Typically, the columns of boxes would connect to each other via magnets, fasteners, or other attaching means; or the columns at least be located adjacent or abutting each other. In this case, the boxes are designed so that the columns have a space to accommodate other structures, such as shelf rails 1572 and 1574 of shelf system 1564 shown herein. Rails 1572 and 1574 may mount onto back wall 1562 via fasteners or other means commonly known in the art. A plurality of shelf brackets, such as 1576 and 1578, may attach to rails 1572 and 1574, respectively, by means conventionally known to those skilled in the art of shelf bracket and rail systems. As shown herein, both the rails 1572 and 1574 attached to the wall 1562 and brackets 1576 and 1578 attach to rails 1572 and 1574. Shelving, such as shelf 1580, may rest on brackets 1576 and 1578 to support the same as shown herein. It is appreciated in this illustrative embodiment that the shelving can abut the faces of the boxes forming structure 1560 and brackets 1576 and 1578 can be modified to accommodate additional length needed in some circumstances depending on the thickness of structure 1560.

Another illustrative embodiment of the present disclosure includes another wall structure 1590 attached to wall 1592 according to methods previously discussed herein. This embodiment illustratively demonstrates the ability to integrate fenestrations into the wall systems such as doors, televisions, or other objects that require removal of boxes. In this illustrative embodiment, a fenestration 1594 is illustratively a window that required the removal of some of the boxes of structure 1590. A header panel 1596 may be positioned over top the window opening 1594 to accommodate box cluster 1598. This view also shows how a trim piece 1600 may be used to border the boxes located at the periphery of window opening 1594. In addition, trim piece 1602 may attach to box cluster 1604 via magnets or other attachment means previously discussed to trim out the window. This view also shows how shelves 1606 can be located in sections of removed boxes as needed.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

Figure 64A:
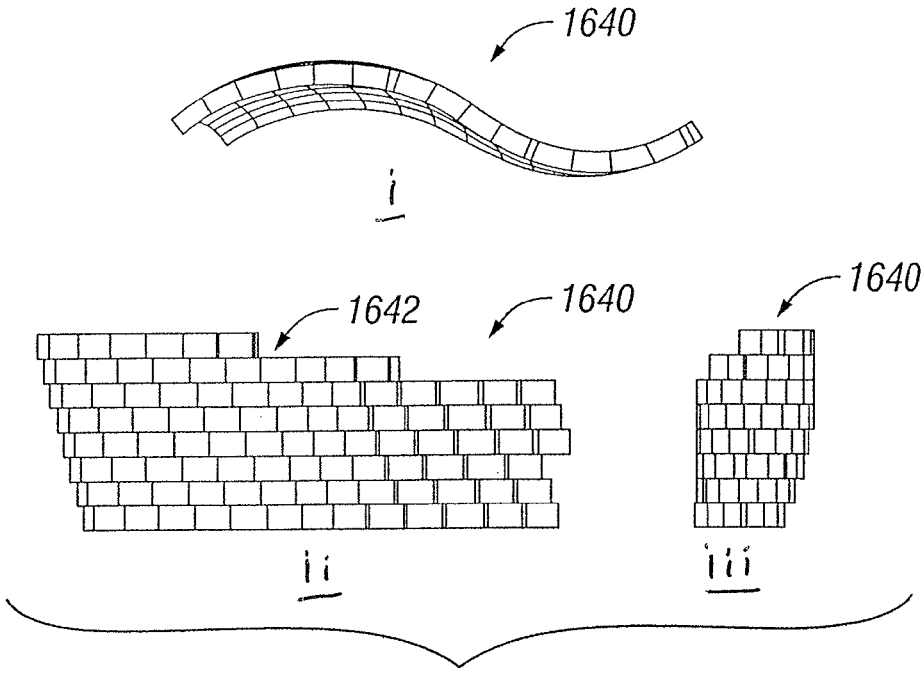
FIGS. 64*a-e* are various views of a structural wall made in different ways including the methods described herein and by conventional bricks or blocks.

FIG. 64*a-e* shows various views of a structural wall made in different ways. As shown in FIG. 64*a*, conventional bricks or blocks cannot achieve the curved-surface structure as by the method disclosed herein and shown in FIG. 64*b*.

Figure 64B:
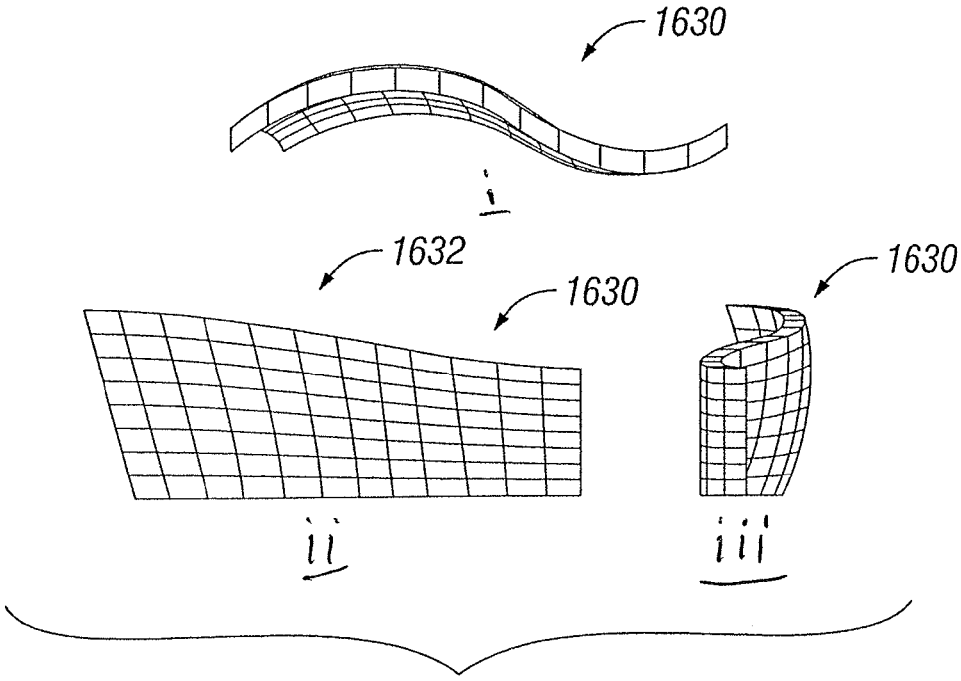
Figure 64C:
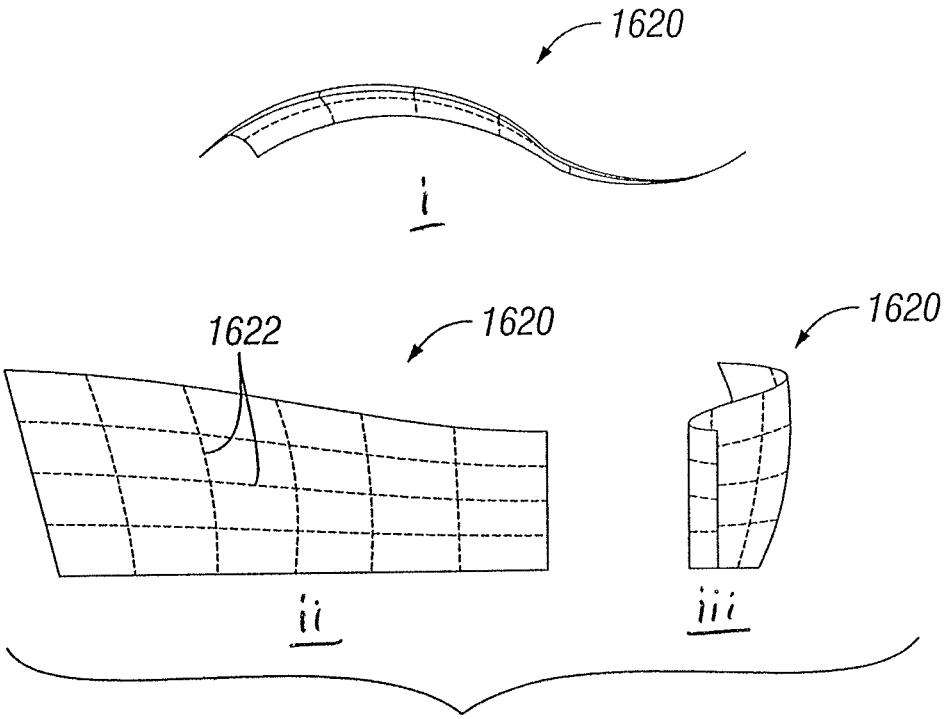

FIGS. 64*ci-iii* show a base surface 1620 in plan, front and side elevation views. The dashed lines 1622 represent the quad pattern for the smooth curving form of the surface. Structure 1630 of FIG. 64*b* is the complex curved wall based on base surface 1620 and formed by means previously discussed in this disclosure. In contrast, FIG. 64*a* shows how that same structure would appear if made from conventional bricks or single-sized building blocks as indicated by reference numeral 1640. The difference between the edge condition of structure 1630 at 1632 and 1640 at 1642 is obvious. Edge condition 1632 more closely approximates the smooth shape of base surface 1620 than the stepped blocks of edge condition 1642. This smooth evenness is due to the contiguous relationship of all the mating box edges such as mating edges 1634. The uneven jagged look of edge condition 1642 is due to the discontinuous (not contiguous) nature of the edge conditions of neighboring blocks in the structure. As the single-sized orthogonal blocks are placed in an attempt to match the multi-curving form, gaps, steps, and spaces must result between the blocks in and between rows.

Figures 64D, 64E:
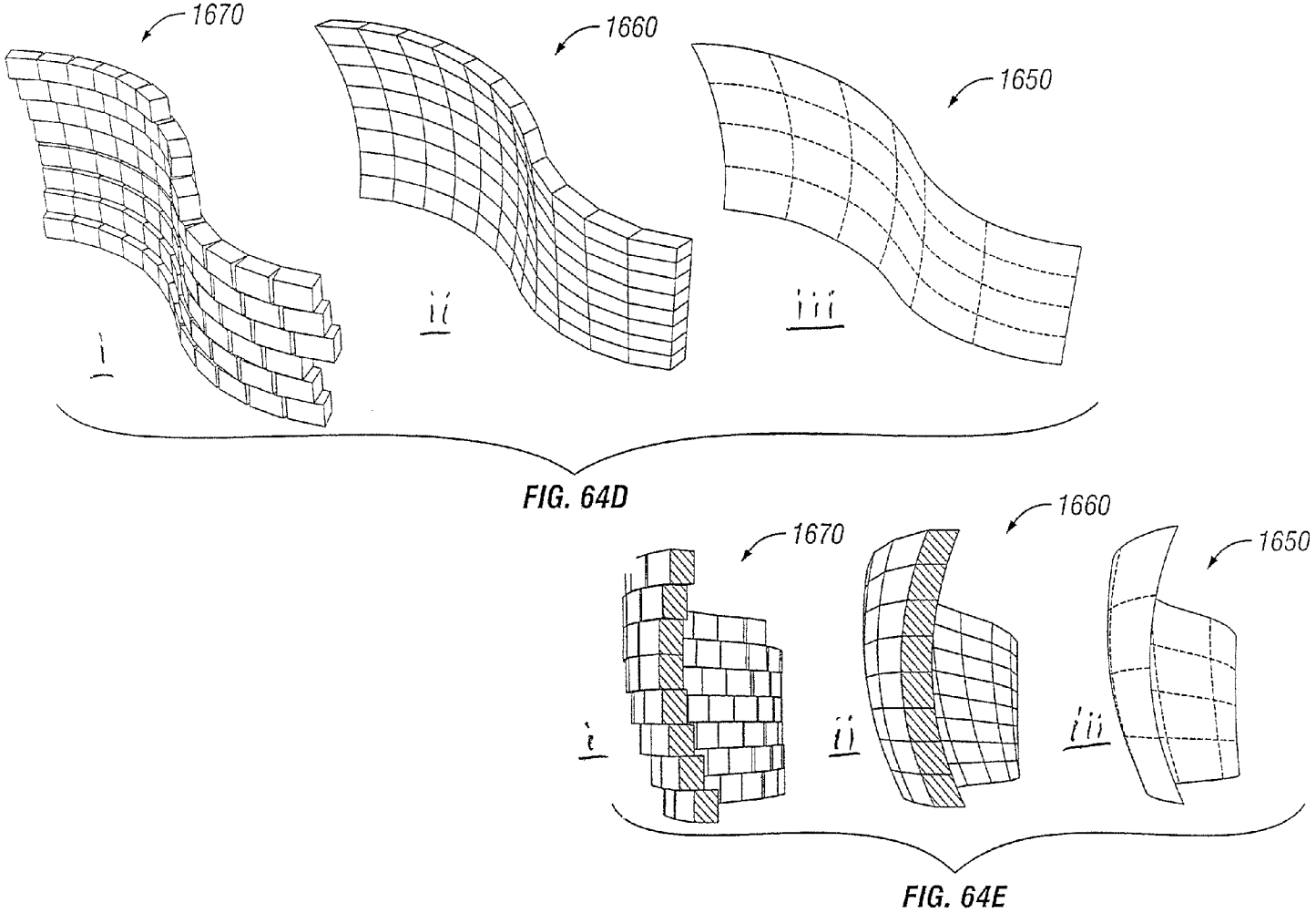

FIGS. 64*di-iii* and *ei-iii* show different views of base surface 1650, box structure 1660 made according to the present disclosure and conventional bricks 1670. Wall 1660 closely approximates base surface 1650 while structure 1670 does not. Note how the box system of structure 1660 with its individually sized boxes can more accurately represent both single and double-curving surface forms.

What is claimed is:

1. An architectural structure having a curved surface, the architectural structure comprising:

a plurality of folded boxes, each of the plurality of folded boxes comprising a front box portion and a rear box portion;

each of the front box portions comprising a front subsurface joined with a plurality of first sides along a plurality of first folds, and each of the rear box portions comprising a rear subsurface joined with a plurality of second sides along a plurality of second folds;

wherein form the curved surface is formed on at least one of the front subsurfaces and the rear subsurfaces of at least one of the plurality of folded boxes;

wherein the curved surface extends continuously across more than one of the plurality of folded boxes;

wherein the curved surface includes at least one doubly-curved portion extending across at least one of the plurality of folded boxes comprising a first curved portion along a first axis and a second curved portion along a second axis, wherein the first curved portion is different than the second curved portion;

wherein at least one of the plurality of folded boxes is a different size than another of the plurality of folded boxes;

wherein each of the front box portions are formed in one piece with the plurality of front sides as a flat blank and folded transverse, orthogonal or non-orthogonal to the front subsurface along each of the first folds;

wherein each of the rear box portions are formed in one piece with the plurality of rear sides as a flat blank and folded transverse, orthogonal or non-orthogonal to the rear subsurface along each of the second folds;

wherein each of the first sides of each of the front box portions are attached to a respective one of the second sides of a respective one of the rear box portions with a first attachment member selected from the group consisting of magnets, fasteners and adhesives;

wherein the plurality of folded boxes are attached to one another with a second attachment member selected from the group consisting of magnets, fasteners and adhesives; and wherein the plurality of folded boxes are not supported by a frame.

2. The architectural structure of claim 1, wherein at least one of the front subsurface or the rear subsurface of the plurality of folded boxes is curved in more than one direction.

3. The architectural structure of claim 1, wherein the plurality of folded boxes are self-supporting.

4. The architectural structure of claim 1, wherein the plurality of folded boxes are each made from a single flat blank of material configured to fold into a box.

5. The architectural structure of claim 1, wherein the plurality of folded boxes are each made from a single folded blank of material, and wherein each of the plurality of folded boxes is hollow.

6. The architectural structure of claim 1, wherein the curved surface is angled in at least two different, and non-parallel directions.

7. The architectural structure of claim 1, wherein each of the plurality of folded boxes has a predetermined order of arrangement such that at least one of the front subsurface or the rear subsurface of the plurality of folded boxes forms an angled surface.

8. The architectural structure of claim 7, wherein the at least one of the front subsurface or the rear subsurface of each of the plurality of folded boxes is uniquely shaped specific to a portion of the angled surface such that each of the plurality of folded boxes is a different shape.

9. The architectural structure of claim 1, wherein each of the plurality of folded boxes includes at least one fastener configured to engage a fastener from an adjacent one of said plurality of folded boxes to couple the plurality of folded boxes together.

10. The architectural structure of claim 9, wherein each fastener is a magnet.

11. The architectural structure of claim 1, wherein each of the plurality of first sides of each of the plurality of folded boxes is configured to couple to a respective second side of said plurality of second sides of an adjacent box of said plurality of folded boxes, and includes a magnet to attach to the a respective first side of said plurality of first sides to a respective second side of said plurality of second sides of the adjacent box to form an angled surface.

12. The architectural structure of claim 1, wherein each of the plurality of folded boxes includes a unique identifier that indicates a position of each of the plurality of folded boxes relative to another one of said plurality of folded boxes.

13. The architectural structure of claim 1, wherein at least one of the front subsurface or the rear subsurface of the plurality of folded boxes has a Gaussian curve.

14. The architectural structure of claim 1, wherein at least one folded box of the plurality of folded boxes contains components selected from a group consisting of raceways, power lines, data wiring, and ventilation ducts.

15. The architectural structure of claim 1, wherein at least one folded box of the plurality of folded boxes includes a surfacing selected from a group consisting of a lens, mirror, graphical design, relief, acoustic panel, lighting and printed panel.

16. The architectural structure of claim 1, wherein at the architectural structure is configured to be suspended from a surface.

17. The architectural structure of claim 1, wherein at the architectural structure is configured to be wall mounted.

18. The architectural structure of claim 1, wherein at least one folded box of the plurality of folded boxes has a surface that is further subdivided that variably angles at least one of the front subsurface or the rear subsurface.

19. The architectural structure of claim 1, wherein the curved surface is a complex curve.

20. The architectural structure of claim 1, wherein at least one of the plurality of folded boxes includes a fabric-wrapped skin on at least one of the front subsurface or the rear subsurface, and an inside portion of the at least one folded box includes a perforated surface and acoustic panel.

21. The architectural structure of claim 1, wherein at least one of the front subsurface or the rear subsurface of at least one of the plurality of folded boxes includes a translucent or transparent portion with at least one additional panel inside the at least one folded box configured such that when light is passed though the at least one folded box a shadow effect is created on the at least one of the front subsurface or the rear subsurface.

22. The architectural structure of claim 1, wherein at least one of the front subsurface or the rear subsurface of the plurality of folded boxes includes a translucent or transparent portion with at least one pair of nonparallel edge lines.

23. The architectural structure of claim 1, wherein the architectural structure is configured to be suspended and wherein at least one of the plurality of folded boxes includes a tab configured to attach the architectural structure to a ceiling.

24. The architectural structure of claim 1, wherein one of the front subsurface or the rear subsurface of each of the plurality of folded boxes includes an opening.

25. The architectural structure of claim 1, wherein each of the front subsurfaces and the rear subsurfaces the plurality of folded boxes has a shape selected from the group consisting of diamond, voronoi and hexagonal.

26. The architectural structure of claim 1, wherein each of the front subsurfaces and the rear subsurfaces of the plurality of folded boxes is subdivided into foldable panels that approximate a curved surface when folded.

27. The architectural structure of claim 1, wherein the each of the front subsurfaces and the rear subsurfaces of the plurality of folded boxes is subdivided into triangularly-shaped panels that approximate a curved surface.

28. The architectural structure of claim 1, wherein at least one of the plurality of folded boxes includes a side of said first and second sides that is spaced apart and facing another side of said first and second sides from a respective one of the plurality of boxes forming a gap between two respective folded boxes of the plurality of folded boxes.

29. The architectural structure of claim 28, further comprising a shelf rail configured to fit into the gap between the two respective folded boxes of the plurality of folded boxes.

30. The architectural structure of claim 29, further comprising a window configured to fit into the gap between the two respective folded boxes of the plurality of folded boxes.

* * * * *